US012800179B2

(12) United States Patent
Hatomura et al.

(10) Patent No.: US 12,800,179 B2
(45) Date of Patent: Nov. 17, 2026

(54) AIR-CONDITIONING APPARATUS

(71) Applicant: Mitsubishi Electric Corporation, Tokyo (JP)

(72) Inventors: Takeshi Hatomura, Tokyo (JP); Yuki Mizuno, Tokyo (JP); Soshi Ikeda, Tokyo (JP); Naofumi Takenaka, Tokyo (JP); Jun Nishio, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 88 days.

(21) Appl. No.: 18/842,820

(22) PCT Filed: Mar. 7, 2022

(86) PCT No.: PCT/JP2022/009690
§ 371 (c)(1),
(2) Date: Aug. 30, 2024

(87) PCT Pub. No.: WO2023/170734
PCT Pub. Date: Sep. 14, 2023

(65) Prior Publication Data
US 2025/0180245 A1 Jun. 5, 2025

(51) Int. Cl.
*F24F 11/84* (2018.01)

(52) U.S. Cl.
CPC ..... *F24F 11/84* (2018.01)

(58) Field of Classification Search
CPC ... F24F 11/84; F24F 49/02; F24F 1/00; F25B 13/00; F25B 49/02; F25B 49/025;
(Continued)

(56) References Cited

U.S. PATENT DOCUMENTS 4,709,554 A 12/1987 Umemura et al.
2013/0283843 A1 10/2013 Takenaka et al.
(Continued)

FOREIGN PATENT DOCUMENTS

JP S62-129659 A 6/1987
JP 2006-336930 A 12/2006
(Continued)

OTHER PUBLICATIONS

International Search Report and Written Opinion mailed on May 17, 2022, received for International Application No. PCT/JP2022/009690, filed on Mar. 7, 2022, 11 pages including English Translation.
(Continued)

*Primary Examiner* — Marc E Norman
(74) *Attorney, Agent, or Firm* — XSENSUS LLP

(57) ABSTRACT

An air-conditioning apparatus includes a refrigerant circuit having a compressor, a heat-source-side heat exchanger, a refrigerant flow switching device, a load-side heat exchanger, and a load-side expansion device. The air-conditioning apparatus includes a bypass pipe, a first opening and closing device provided in the bypass pipe, and a controller. The compressor, the heat-source-side heat exchanger, the refrigerant flow switching device, the bypass pipe, and the first opening and closing device are mounted in an outdoor unit. In defrosting the heat-source-side heat exchanger, the controller causes a flow passage of the refrigerant flow switching device to be a flow passage through which the refrigerant discharged from the compressor flows into the load-side heat exchanger, changes the first opening and closing device to an open state, changes the load-side expansion device to a closed state, and causes the refrigerant to flow into the heat-source-side heat exchanger from the bypass pipe.

11 Claims, 15 Drawing Sheets

(58) Field of Classification Search
CPC ..... F25B 2313/0233; F25B 2313/0314; F25B 2600/2501; F25B 2600/2513; F25B 2700/1933; F25B 2700/21152
See application file for complete search history.

(56) References Cited

U.S. PATENT DOCUMENTS

| | | | | |
|---|---|---|---|---|
| 2014/0026605 | A1 | 1/2014 | Ishimura et al. | |
| 2015/0300714 | A1* | 10/2015 | Ishimura | F25B 49/02 62/228.1 |
| 2019/0383535 | A1* | 12/2019 | Shinozaki | F25B 47/025 |
| 2020/0232693 | A1* | 7/2020 | Watanabe | F25B 41/385 |
| 2021/0341192 | A1 | 11/2021 | Matsusaka et al. | |

FOREIGN PATENT DOCUMENTS

| | | | |
|---|---|---|---|
| JP | 2011-189824 | A | 9/2011 |
| JP | 2018-141599 | A | 9/2018 |
| JP | 2020-056515 | A | 4/2020 |
| JP | 2021-130384 | A | 9/2021 |
| WO | 2012/104893 | A1 | 8/2012 |
| WO | 2012/160597 | A1 | 11/2012 |
| WO | 2020/189586 | A1 | 9/2020 |

OTHER PUBLICATIONS

Notice of Reasons for Refusal mailed on Jun. 4, 2023, received for JP Application 2023-520321, 20 pages including English Translation.

* cited by examiner

AIR-CONDITIONING APPARATUS

CROSS-REFERENCE TO RELATED APPLICATION

This application is a national stage application, pursuant to 35 U.S.C. § 371, of International Patent Application No. PCT/JP2022/009690, filed Mar. 7, 2022, the entire contents of which is incorporated herein by reference.

TECHNICAL FIELD

The present disclosure relates to an air-conditioning apparatus.

BACKGROUND ART

In some air-conditioning apparatus such as a variable refrigerant flow (VRF) system, for example, an outdoor unit placed as a heat source unit outside a building and an indoor unit placed inside the building are connected by a pipe and form a refrigerant circuit through which refrigerant circulates. Moreover, an air-conditioning target space is heated by heating indoor air through the utilization of rejection of heat by the refrigerant. Further, the air-conditioning target space is cooled by cooling the indoor air through the utilization of removal of heat by the refrigerant.

During heating operation of such an air-conditioning apparatus, a heat-source-side heat exchanger installed in the outdoor unit serves as an evaporator, so that low-temperature refrigerant and outdoor air exchange heat with each other. This causes moisture in the outdoor air to condense on fins and heat transfer tubes of the heat-source-side heat exchanger to form frost on the heat-source-side heat exchanger. Such formation of frost on the heat-source-side heat exchanger causes an air passageway in the heat-source-side heat exchanger to be clogged, reduces a heat transfer area of the heat-source-side heat exchanger that exchanges heat with the outdoor air, and therefore results in lack of heating capacity.

Such a problem is usually addressed by stopping heating operation upon formation of frost on the heat-source-side heat exchanger and performing defrosting operation for the heat-source-side heat exchanger by switching the flows of refrigerant with a refrigerant flow switching device to cause the heat-source-side heat exchanger, which is installed in the outdoor unit, to serve as a condenser. Executing such defrosting operation makes it possible to prevent a decrease in heating capacity. However, defrosting operation requires a smaller amount of refrigerant than does heating operation and therefore generates excess refrigerant. Further, the generation of excess refrigerant causes a liquid return to a compressor, causing degradation in reliability of the compressor.

To address this problem, some air-conditioning apparatus designed to reduce a liquid return to a compressor during defrosting operation has been proposed (see Patent Literature 1). Specifically, the air-conditioning apparatus described in Patent Literature 1 includes two indoor heat exchangers connected in parallel to each other. One of the two indoor heat exchangers is used as a heat exchanger in which to accumulate refrigerant in performing defrosting operation for a heat-source-side heat exchanger. Moreover, in the air-conditioning apparatus described in Patent Literature 1, in performing defrosting operation for the heat-source-side heat exchanger, refrigerant discharged from the compressor is supplied to the heat-source-side heat exchanger through the other one of the two indoor heat exchangers, so that the heat-source-side heat exchanger is defrosted. Thus, the air-conditioning apparatus described in Patent Literature 1 is designed to reduce a liquid return to the compressor by accumulating excess refrigerant in either of the two indoor heat exchangers during defrosting operation for the heat-source-side heat exchanger.

CITATION LIST

Patent Literature

Patent Literature 1: Japanese Unexamined Patent Application Publication No. 2020-056515

SUMMARY OF INVENTION

Technical Problem

In the air-conditioning apparatus described in Patent Literature 1, the refrigerant flows through the same flow passage both during defrosting operation and cooling operation. That is, during defrosting operation, the refrigerant discharged from the compressor passes through an indoor heat exchanger, further flows through a pipe connecting an indoor unit with an outdoor unit, and flows into the heat-source-side heat exchanger. For this reason, in the air-conditioning apparatus described in Patent Literature 1, during defrosting operation, a great pressure loss is generated in a flow passage through which the refrigerant discharged from the compressor flows into the heat-source-side heat exchanger, so that there is a decrease in the density of the refrigerant that flows into the heat-source-side heat exchanger. This causes the air-conditioning apparatus described in Patent Literature 1 to suffer from degradation in defrosting capacity.

The present disclosure is made to solve the aforementioned problem and has an object to provide an air-conditioning apparatus capable of reducing a liquid return to a compressor during defrosting operation and capable of also reducing degradation in defrosting capacity.

Solution to Problem

An air-conditioning apparatus according to an embodiment of the present disclosure includes a refrigerant circuit that has a compressor configured to compress and discharge refrigerant, a heat-source-side heat exchanger configured to function as an evaporator in a heating only operation mode in which all indoor units in operation perform heating operation, a refrigerant flow switching device configured to switch flow passages of the refrigerant according to an operation mode, a load-side heat exchanger configured to function as a condenser during heating operation, and a load-side expansion device configured such that the refrigerant flowing from the load-side heat exchanger functioning as a condenser and flowing into the heat-source-side heat exchanger functioning as an evaporator flows through the load-side expansion device, that is formed by the compressor, the heat-source-side heat exchanger, the load-side expansion device, and the load-side heat exchanger being connected by a refrigerant pipe, and through which the refrigerant circulates, a bypass pipe that has one end that is an inlet-side end connected to a point in the refrigerant circuit located between a discharge outlet of the compressor and the refrigerant flow switching device and the other end that is an outlet-side end connected to a point in the refrigerant circuit located between the load-side expansion device and the heat-source-side heat exchanger, a first opening and closing device provided in the bypass pipe and configured to open and close a flow passage of the refrigerant at a place at which the first opening and closing device is installed, a controller configured to control the refrigerant flow switching device, the load-side expansion device, and the first opening and closing device, and an outdoor unit mounted with the compressor, the heat-source-side heat exchanger, the refrigerant flow switching device, the bypass pipe, and the first opening and closing device. The controller is configured to, in executing a defrosting operation mode of defrosting the heat-source-side heat exchanger, cause a flow passage of the refrigerant through the refrigerant flow switching device to be a flow passage through which the refrigerant discharged from the compressor flows into the load-side heat exchanger, change the first opening and closing device from a closed state to an open state, change the load-side expansion device from an open state to a closed state, and cause the refrigerant discharged from the compressor to flow into the heat-source-side heat exchanger from the bypass pipe.

Advantageous Effects of Invention

The air-conditioning apparatus according to an embodiment of the present disclosure is configured to retain excess refrigerant in the load-side heat exchanger during defrosting operation for the heat-source-side heat exchanger and therefore reduce a liquid return to the compressor. Further, in the air-conditioning apparatus according to an embodiment of the present disclosure, during defrosting operation for the heat-source-side heat exchanger, the refrigerant discharged from the compressor flows into the heat-source-side heat exchanger by flowing only inside the outdoor unit. This enables the air-conditioning apparatus according to an embodiment of the present disclosure to, during defrosting operation for the heat-source-side heat exchanger, prevent the density of the refrigerant that flows into the heat-source-side heat exchanger from decreasing because of a pressure loss and to also reduce degradation in defrosting capacity.

DESCRIPTION OF EMBODIMENTS

Figure 1:
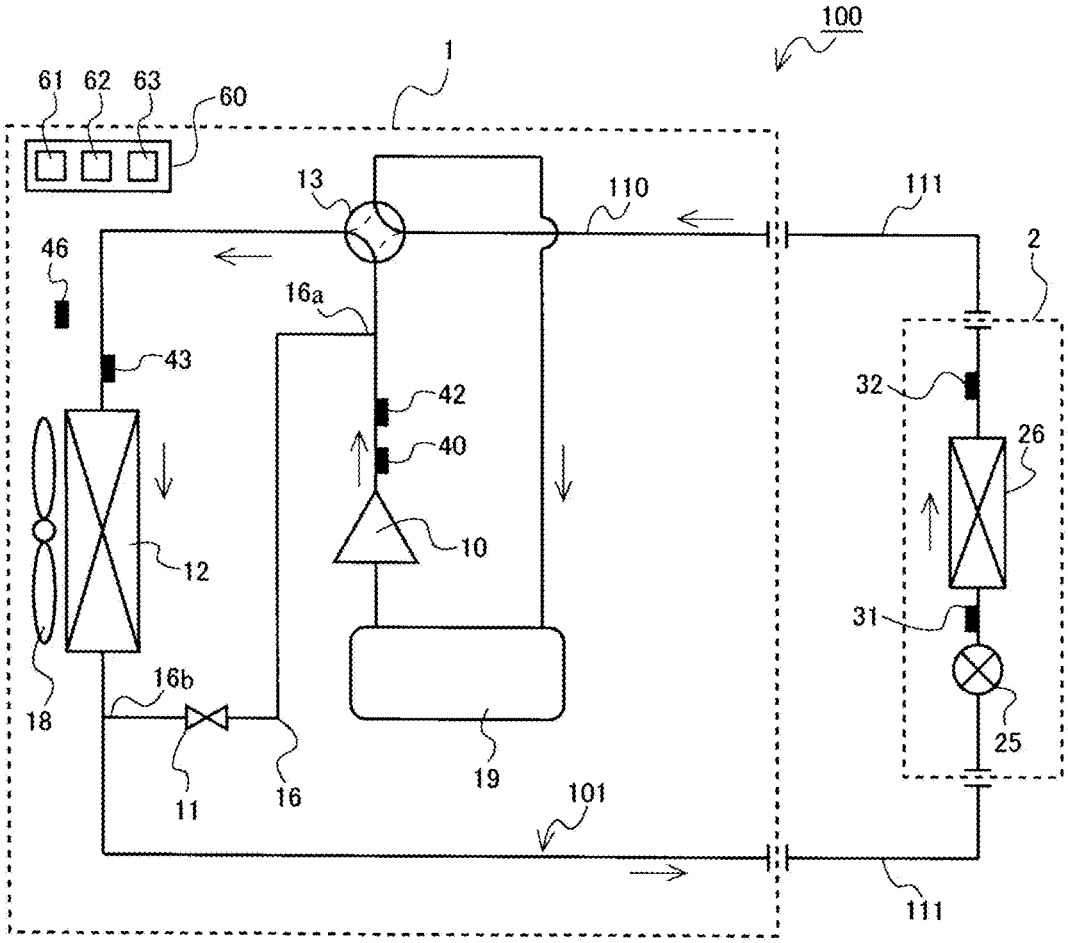
FIG. 1 is a schematic view showing a circuit configuration of an air-conditioning apparatus according to Embodiment 1 and a diagram showing a state in which the air-conditioning apparatus is operating in a cooling only operation mode.

In each of the following embodiments, an example of an air-conditioning apparatuses according to the present disclosure is described with reference to the drawings. Constituent elements given identical reference signs in the drawings are identical or equivalent to each other, and these reference signs are adhered to throughout the full text of the description. Further, the forms of constituent elements illustrated in the full text of the description are merely examples of air-conditioning apparatuses according to the present disclosure. Air-conditioning apparatuses according to the present disclosure are not limited to the forms of constituent elements illustrated in the full text of the description.

Embodiment 1

[Configuration of Air-Conditioning Apparatus 100]

FIG. 1 is a schematic view showing a circuit configuration of an air-conditioning apparatus according to Embodiment 1 and a diagram showing a state in which the air-conditioning apparatus is operating in a cooling only operation mode.

The air-conditioning apparatus 100 is configured to perform air conditioning through the utilization of a refrigeration cycle by causing refrigerant to circulate through a refrigerant circuit 101. The air-conditioning apparatus 100 is configured to selectively operate in the cooling only operation mode, in which all indoor units 2 in operation perform cooling operation, a heating only operation mode in which all indoor units 2 in operation perform heating operation, or a defrosting operation mode of defrosting a heat-source-side heat exchanger 12 inside an outdoor unit 1.

As shown in FIG. 1, the air-conditioning apparatus 100 includes the outdoor unit 1 and an indoor unit 2 and is configured such that the outdoor unit 1 and the indoor unit 2 are connected by a main pipe 111. As will be mentioned later, constituent elements mounted in the outdoor unit 1 and the indoor unit 2 are connected by a refrigerant pipe 110 and form the refrigerant circuit 101. The main pipe 111 is part of the refrigerant pipe 110.

[Configuration of Refrigerant Circuit 101]

The refrigerant circuit 101 includes a compressor 10, a refrigerant flow switching device 13, the heat-source-side heat exchanger 12, a load-side heat exchanger 26, a load-side expansion device 25, and an accumulator 19. Moreover, the compressor 10, the refrigerant flow switching device 13, the heat-source-side heat exchanger 12, the load-side heat exchanger 26, and the load-side expansion device 25 are connected by the refrigerant pipe 110 and form the refrigerant circuit 101, through which the refrigerant circulates.

The compressor 10 is configured to compress and discharge the refrigerant. Specifically, the compressor 10 sucks the refrigerant and compresses it into a high-temperature and high-pressure state. The compressor 10 is, for example, a capacity-controllable inverter compressor or other device. The refrigerant flow switching device 13 is configured to switch flow passages of the refrigerant according to an operation mode. Specifically, the refrigerant flow switching device 13 switches among the flow of the refrigerant during the heating only operation mode, the flow of the refrigerant during the cooling only operation mode, and the flow of the refrigerant during the defrosting operation mode.

The heat-source-side heat exchanger 12 is configured to function as an evaporator in the heating only operation mode and function as a condenser in the cooling only operation mode and the defrosting operation mode. In Embodiment 1, the heat-source-side heat exchanger 12 is configured such that the refrigerant flowing inside and outdoor air exchange heat with each other. For this purpose, the air-conditioning apparatus 100 according to Embodiment 1 includes a heat-source-side air-sending device 18 configured to supply the outdoor air to the heat-source-side heat exchanger 12.

The load-side heat exchanger 26 is configured to function as a condenser during heating operation and function as an evaporator during cooling operation. In Embodiment 1, the load-side heat exchanger 26 is configured such that the refrigerant flowing inside and indoor air exchange heat with each other. For this purpose, the air-conditioning apparatus 100 according to Embodiment 1 includes a load-side air-sending device (not illustrated) configured to supply the indoor air to the load-side heat exchanger 26. That is, the indoor air cooled by the load-side heat exchanger 26 serves as cooling air that is supplied to an air-conditioning target space. Further, the indoor air heated by the load-side heat exchanger 26 serves as heating air that is supplied to the air-conditioning target space.

The load-side expansion device 25 has an opening degree that can be regulated, for example, either a continuous or multistep manner. Usable examples of the load-side expansion device 25 include an electronic expansion valve. The load-side expansion device 25 functions as a pressure reducing valve and an expansion valve. In other words, the load-side expansion device 25 decompresses and expands the refrigerant. The load-side expansion device 25 is placed in the refrigerant circuit 101 and downstream of the load-side heat exchanger 26 when the load-side heat exchanger 26 functions as a condenser. Specifically, the load-side expansion device 25 is configured such that the refrigerant flowing out from the load-side heat exchanger 26 functioning as a condenser and flowing into the heat-source-side heat exchanger 12 functioning as an evaporator flows through the load-side expansion device 25. Further, in Embodiment 1, during cooling operation, the load-side expansion device 25 decompresses the refrigerant flowing into the load-side heat exchanger 26. That is, the load-side expansion device 25 is placed in the refrigerant circuit 101 and upstream of the load-side heat exchanger 26 when the load-side heat exchanger 26 functions as an evaporator.

The accumulator 19 is configured to accumulate the refrigerant. Specifically, the accumulator 19 is a liquid receiver provided at a suction side of the compressor 10 and configured to store excess refrigerant. The excess refrigerant is generated, for example, by a difference in operational state during the heating only operation mode, the cooling only operation mode, and the defrosting operation mode. Further, for example, the excess refrigerant is generated by a transient change in operation of the air-conditioning apparatus 100.

[Configuration of Outdoor Unit 1]

The outdoor unit 1 is mounted with the compressor 10, the heat-source-side heat exchanger 12, the heat-source-side air-sending device 18, the refrigerant flow switching device 13, and the accumulator 19. Further, the outdoor unit 1 is mounted with a bypass pipe 16 and a first opening and closing device 11 that the air-conditioning apparatus 100 includes.

The bypass pipe 16 is a pipe through which, in the defrosting operation mode, high-temperature and high-pressure refrigerant discharged from the compressor 10 is supplied to the heat-source-side heat exchanger 12. That is, the bypass pipe 16 is a pipe through which refrigerant for melting frost forming on the heat-source-side heat exchanger 12 passes. The bypass pipe 16 has one end that is an inlet-side end 16*a* connected to a point in the refrigerant circuit 101 located between a discharge outlet of the compressor 10 and the refrigerant flow switching device 13. Further, the bypass pipe 16 has the other end that is an outlet-side end 16*b* connected to a point in the refrigerant circuit 101 located between the load-side expansion device 25 and the heat-source-side heat exchanger 12. More specifically, the outlet-side end 16*b*, which is the other end of the bypass pipe 16, is connected to a section of the refrigerant pipe 100 situated between the load-side expansion device 25 and the heat-source-side heat exchanger 12 and located closer to the heat-source-side heat exchanger 12 than is the main pipe 111.

The first opening and closing device 11 is provided in the bypass pipe 16 and configured to open and close a flow passage of the refrigerant at a place at which the first opening and closing device 11 is installed. That is, when the first opening and closing device 11 changes from a closed state to an open state, the high-temperature and high-pressure refrigerant discharged from the compressor 10 is supplied to the heat-source-side heat exchanger 12. The first opening and closing device 11 may be preferably, for example, a device capable of opening and closing a flow passage of refrigerant, such as a two-way valve, a solenoid valve, and an electronic expansion valve capable of adjusting the flow rate of refrigerant.

Further, the outdoor unit 1 is installed with a heat-source-side heat exchanger temperature sensor 43, a discharge temperature sensor 42, a discharge pressure sensor 40, and an outside air temperature sensor 46. The heat-source-side heat exchanger temperature sensor 43, the discharge temperature sensor 42, and the outside air temperature sensor 46 are, for example, thermistors or other devices. In the heating only operation mode and the defrosting operation mode, the heat-source-side heat exchanger temperature sensor 43 detects the temperature of the refrigerant flowing out from the heat-source-side heat exchanger 12. Further, in the cooling only operation mode, the heat-source-side heat exchanger temperature sensor 43 detects the temperature of the refrigerant flowing into the heat-source-side heat exchanger 12. Further, the heat-source-side heat exchanger temperature sensor 43 outputs the temperature of the refrigerant thus detected to an after-mentioned controller 60 as a detection signal. The discharge temperature sensor 42 detects the temperature of the refrigerant discharged from the compressor 10. Further, the discharge temperature sensor 42 outputs the temperature of the refrigerant thus detected to the after-mentioned controller 60 as a detection signal. The discharge pressure sensor 40 detects the pressure of the refrigerant discharged from the compressor 10. Further, the discharge pressure sensor 40 outputs the pressure of the refrigerant thus detected to the after-mentioned controller 60 as a detection signal. The outside air temperature sensor 46 is installed in a portion of the outdoor unit 1 through which air flows into the heat-source-side heat exchanger 12. The outside air temperature sensor 46 detects, for example, the temperature of the outdoor air, that is, the temperature of an area around the outdoor unit 1. Further, the outside air temperature sensor 46 outputs the temperature thus detected to the after-mentioned controller 60 as a detection signal.

[Configuration of Indoor Unit 2]

The indoor unit 2 is mounted with the load-side expansion device 25 and the load-side heat exchanger 26.

Further, the indoor unit 2 is installed with a load-side first temperature sensor 31 and a load-side second temperature sensor 32. The load-side first temperature sensor 31 and the load-side second temperature sensor 32 are, for example, thermistors or other devices. While the indoor unit 2 is performing cooling operation, the load-side first temperature sensor 31 detects the temperature of the refrigerant flowing into the load-side heat exchanger 26. Further, while the indoor unit 2 is performing heating operation, the load-side first temperature sensor 31 detects the temperature of the refrigerant flowing out from the load-side heat exchanger 26. While the indoor unit 2 is performing cooling operation, the load-side second temperature sensor 32 detects the temperature of the refrigerant flowing out from the load-side heat exchanger 26. Further, while the indoor unit 2 is performing heating operation, the load-side second temperature sensor 32 detects the temperature of the refrigerant flowing into the load-side heat exchanger 26. Further, the load-side first temperature sensor 31 and the load-side second temperature sensor 32 output the temperatures of the refrigerant thus detected to the after-mentioned controller 60 as detection signals.

It should be noted that FIG. 1 illustrates one indoor unit 2. However, the air-conditioning apparatus 100 may include any number of indoor units 2. The air-conditioning apparatus 100 may include two or more indoor units 2. In a case in which the air-conditioning apparatus 100 includes a plurality of indoor units 2, for example, each indoor unit 2 is connected in parallel to the outdoor unit 1.

The air-conditioning apparatus 100 thus configured includes a controller 60 configured to execute each operation mode. The controller 60 controls the compressor 10, the heat-source-side air-sending device 18, the load-side air-sending device (not illustrated), the refrigerant flow switching device 13, the load-side expansion device 25, the first opening and closing device 11, or other devices, for example, in accordance with input information from each sensor that the air-conditioning apparatus 100 includes and instructions from a remote controller (not illustrated). Specifically, the controller 60 controls the driving and stopping of the compressor 10. Further, the controller 60 controls the driving frequency of the compressor 10. Further, the controller 60 controls the driving and stopping of the heat-source-side air-sending device 18 and the load-side air-sending device. Further, the controller 60 controls the rotation frequencies of the heat-source-side air-sending device 18 and the load-side air-sending device while the heat-source-side air-sending device 18 and the load-side air-sending device are being driven. Further, the controller 60 switches flow passages of the refrigerant flow switching device 13. Further, the controller 60 controls the opening and closing of the load-side expansion device 25. Further, the controller 60 controls the opening degree of the load-side expansion device 25 while the load-side expansion device 25 is in an open state. Further, the controller 60 controls the opening and closing of the first opening and closing device 11.

Such a controller 60 is dedicated hardware or a central processing unit (CPU) configured to execute programs stored in a memory. It should be noted that the CPU is also referred to as a central processing apparatus, a processing apparatus, an arithmetic apparatus, a microprocessor, a microcomputer, or a processor.

In a case in which the controller 60 is the dedicated hardware, the controller 60 corresponds, for example, to a single circuit, a composite circuit, an application specific integrated circuit (ASIC), a field-programmable gate array (FPGA), or a combination of the foregoing. Functional units that the controller 60 implements may be implemented by separate pieces of hardware, or the functional units may be implemented by a single piece of hardware.

In a case in which the controller 60 is the CPU, functions that the controller 60 executes are implemented by software, firmware, or a combination of the software and the firmware. The software and the firmware are described as programs and stored in the memory. The CPU implements the functions of the controller 60 by reading out and executing the programs stored in the memory. Note here that the memory is for example a nonvolatile or volatile semiconductor memory such as a RAM, a ROM, a flash memory, an EPROM, and an EEPROM.

It should be noted that some of the functions of the controller 60 may be implemented by the dedicated hardware, and others may be implemented by the software or the firmware.

Further, although, in FIG. 1, the controller 60 is mounted in the outdoor unit 1, this is merely an example. The controller 60 may be mounted in the indoor unit 2. Further, the controller 60 may be divided into portions mounted in the outdoor unit 1 and the indoor unit 2. In this case, the portion of the controller 60 mounted in the outdoor unit 1 and the portion of the controller 60 mounted in the indoor unit 2 may be preferably connected either by wires or wirelessly and configured to be controlled in cooperation with each other.

The controller 60 thus configured includes, for example, an input unit 61, an arithmetic unit 62, and a control unit 63 as functional units. The input unit 61 is a functional unit to which a detection signal representing a detection result is input from each sensor that the air-conditioning apparatus 100 includes. Further, to the input unit 61, an instruction from the remote controller (not illustrated) is input too. The arithmetic unit 62 is a functional unit by which information needed for control is calculated by use of information input to the input unit 61. For example, the arithmetic unit 62 converts the pressure of the refrigerant detected by the discharge pressure sensor 40 into the saturation temperature of the refrigerant. Further, for example, the arithmetic unit 62 calculates the degree of superheat and degree of subcooling of the refrigerant by use of two pieces of temperature information included in the information that the input unit 61 and the arithmetic unit 62 have. The control unit 63 is a functional unit configured to control the compressor 10, the heat-source-side air-sending device 18, the load-side air-sending device (not illustrated), the refrigerant flow switching device 13, the load-side expansion device 25, the first opening and closing device 11, or other devices in accordance with the information that the input unit 61 and the arithmetic unit 62 have.

Next, each operation mode that the air-conditioning apparatus 100 executes is described.

The following describes each operation mode with reference to the flow of the refrigerant.

[Cooling Only Operation Mode]

The cooling only operation mode that the air-conditioning apparatus 100 executes is described with reference to FIG. 1. As mentioned above, the cooling only operation mode is a mode in which all indoor units 2 in operation perform cooling operation. In the case shown in FIG. 1, a cooling load is generated in the load-side heat exchanger 26 provided in the indoor unit 2. In FIG. 1, the direction of flow of the refrigerant is indicated by solid arrows.

In the cooling only operation mode, the refrigerant flow switching device 13 is switched to a flow passage indicated by solid lines in FIG. 1. The first opening and closing device 11 is switched to a closed state to block the flow passage of the refrigerant.

When the compressor 10 is driven, the compressor 10 compresses low-temperature and low-pressure refrigerant into high-temperature and high-pressure gas refrigerant and discharges the high-temperature and high-pressure gas refrigerant through the discharge outlet. The high-temperature and high-pressure gas refrigerant discharged from the compressor 10 passes through the refrigerant flow switching device 13 and flows into the heat-source-side heat exchanger 12. The high-temperature and high-pressure gas refrigerant flowing into the heat-source-side heat exchanger 12 turns into high-pressure liquid refrigerant by rejecting heat to the outdoor air at the heat-source-side heat exchanger 12. The high-pressure liquid refrigerant flowing out from the heat-source-side heat exchanger 12 flows out from the outdoor unit 1.

The high-pressure liquid refrigerant flowing out from the outdoor unit 1 passes through the main pipe 111, flows into the indoor unit 2, and is expanded by the load-side expansion device 25 into low-temperature and low-pressure two-phase refrigerant. This two-phase refrigerant flows into the load-side heat exchanger 26, which functions as an evaporator, and turns into low-temperature and low-pressure gas refrigerant while cooling the indoor air by removing heat from the indoor air. The gas refrigerant flowing out from the load-side heat exchanger 26 passes through the main pipe 111 and again flows into the outdoor unit 1. The gas refrigerant flowing into the outdoor unit 1 passes through the refrigerant flow switching device 13 and the accumulator 19 and is again sucked into the compressor 10.

The controller 60 controls the opening degree of the load-side expansion device 25 such that the degree of superheat obtained as the difference between the temperature of the refrigerant detected by the load-side first temperature sensor 31 and the temperature of the refrigerant detected by the load-side second temperature sensor 32 becomes constant. It should be noted that the degree of superheat may be referred to as "superheat".

[Heating Only Operation Mode]

Figure 2:
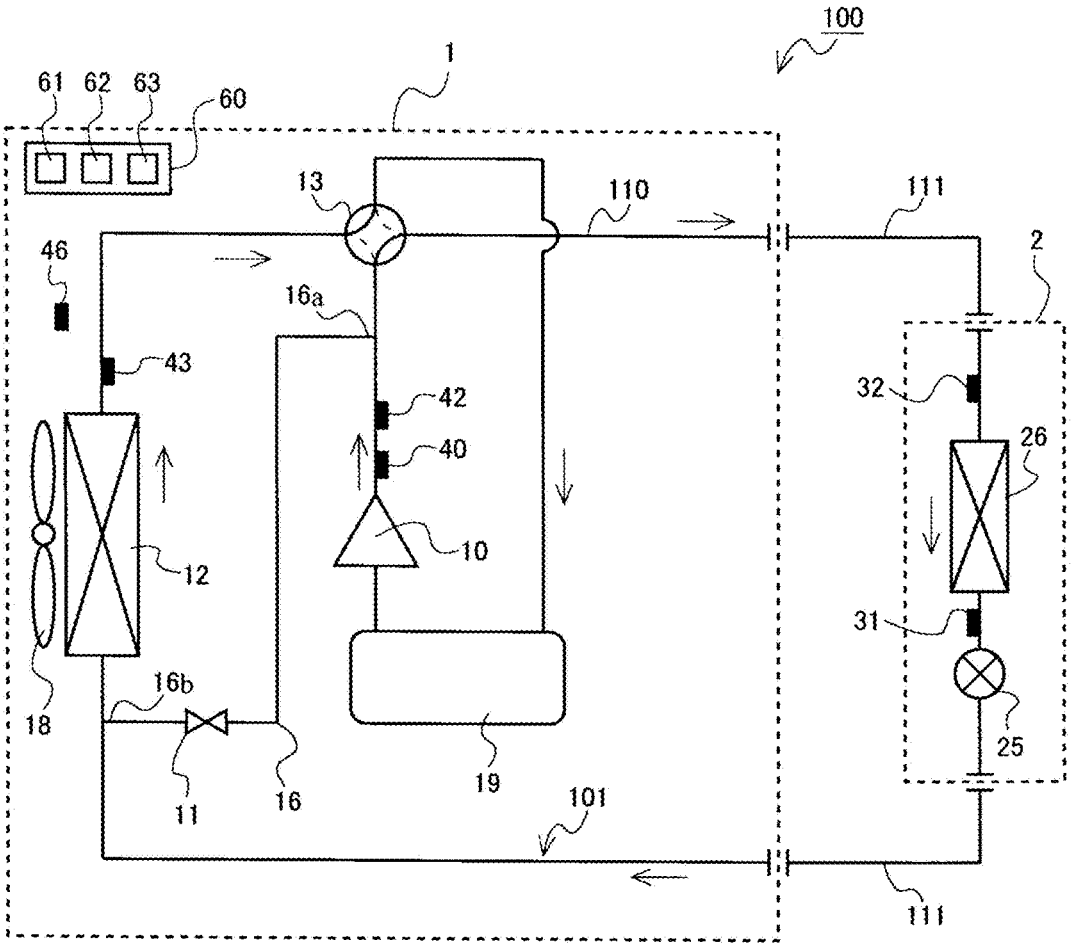
FIG. 2 is a schematic view showing the circuit configuration of the air-conditioning apparatus according to Embodiment 1 and a diagram showing a state in which the air-conditioning apparatus is operating in a heating only operation mode.

FIG. 2 is a schematic view showing the circuit configuration of the air-conditioning apparatus according to Embodiment 1 and a diagram showing a state in which the air-conditioning apparatus is operating in the heating only operation mode.

The heating only operation mode that the air-conditioning apparatus 100 executes is described with reference to FIG. 2. As mentioned above, the heating only operation mode is a mode in which all indoor units 2 in operation perform heating operation. In the case shown in FIG. 2, a heating load is generated in the load-side heat exchanger 26 provided in the indoor unit 2. In FIG. 2, the direction of flow of the refrigerant is indicated by solid arrows.

In the heating only operation mode, the refrigerant flow switching device 13 is switched to a flow passage indicated by solid lines in FIG. 2. The first opening and closing device 11 is switched to a closed state to block the flow passage of the refrigerant.

When the compressor 10 is driven, the compressor 10 compresses low-temperature and low-pressure refrigerant into high-temperature and high-pressure gas refrigerant and discharges the high-temperature and high-pressure gas refrigerant through the discharge outlet. The high-temperature and high-pressure gas refrigerant discharged from the compressor 10 passes through the refrigerant flow switching device 13 and flows out from the outdoor unit 1.

The high-temperature and high-pressure gas refrigerant flowing out from the outdoor unit 1 passes through the main pipe 111, flows into the indoor unit 2, and turns into liquid refrigerant while heating the indoor air by rejecting heat to the indoor air at the load-side heat exchanger 26. The liquid refrigerant flowing out from the load-side heat exchanger 26 is expanded by the load-side expansion device 25 into low-temperature and low-pressure two-phase or liquid refrigerant that then passes through the main pipe 111 and again flows into the outdoor unit 1.

The low-temperature and low-pressure refrigerant flowing into the outdoor unit 1 flows into the heat-source-side heat exchanger 12. The refrigerant flowing into the heat-source-side heat exchanger 12 turns into low-temperature and low-pressure gas refrigerant by removing heat from the outdoor air, passes through the refrigerant flow switching device 13 and the accumulator 19, and is again sucked into the compressor 10.

The controller 60 controls the opening degree of the load-side expansion device 25 such that the degree of subcooling obtained as the difference between a value obtained by converting the pressure of the refrigerant detected by the discharge pressure sensor 40 into the saturation temperature of the refrigerant and the temperature detected by the load-side first temperature sensor 31 becomes constant. It should be noted that the degree of subcooling may be referred to as "subcooling".

[Defrosting Operation Mode]

As mentioned above, the defrosting operation mode is an operation mode of defrosting the heat-source-side heat exchanger 12 inside the outdoor unit 1. The heat-source-side heat exchanger temperature sensor 43 is provided in a position beside an outlet of the heat-source-side heat exchanger 12 in the direction of flow of the refrigerant in the heating only operation mode. That is, the heat-source-side heat exchanger temperature sensor 43 is provided in a position beside an outlet of the heat-source-side heat exchanger 12 through which the refrigerant flows out in a state in which the heat-source-side heat exchanger 12 is functioning as an evaporator. The defrosting operation mode is executed when a temperature detected by the heat-source-side heat exchanger temperature sensor 43 in the heating only operation mode is lower than or equal to a specified temperature. That is, when the controller 60 executes the heating only operation mode and a temperature detected by the heat-source-side heat exchanger temperature sensor 43 is lower than or equal to the specified temperature, the controller 60 determines that a predetermined amount of frost has formed on fins of the heat-source-side heat exchanger 12, and executes the defrosting operation mode. The specified temperature is for example −10 degrees C.

Alternatively, the heat-source-side heat exchanger temperature sensor 43 may be provided in a position beside an inlet of the heat-source-side heat exchanger 12 through which the refrigerant flows in in a state in which the heat-source-side heat exchanger 12 is functioning as an evaporator. That is, the heat-source-side heat exchanger temperature sensor 43 needs only be able to detect the evaporating temperature of the refrigerant flowing through the heat-source-side heat exchanger 12 during the heating only operation mode.

Further, the aforementioned method for determining whether frost has formed on the heat-source-side heat exchanger 12 is merely an example. For example, when the saturation temperature of the refrigerant converted from the pressure of the refrigerant that the compressor 10 sucks is lower by at least the specified temperature than a preset outdoor air temperature, it may be determined that the predetermined amount of frost has formed on the fins of the heat-source-side heat exchanger 12. Further, for example, when the temperature difference between the outside air temperature and the evaporating temperature continues to be greater than or equal to a preset value for a certain period of time, it may be determined that the predetermined amount of frost has formed on the fins of the heat-source-side heat exchanger 12.

Figure 3:
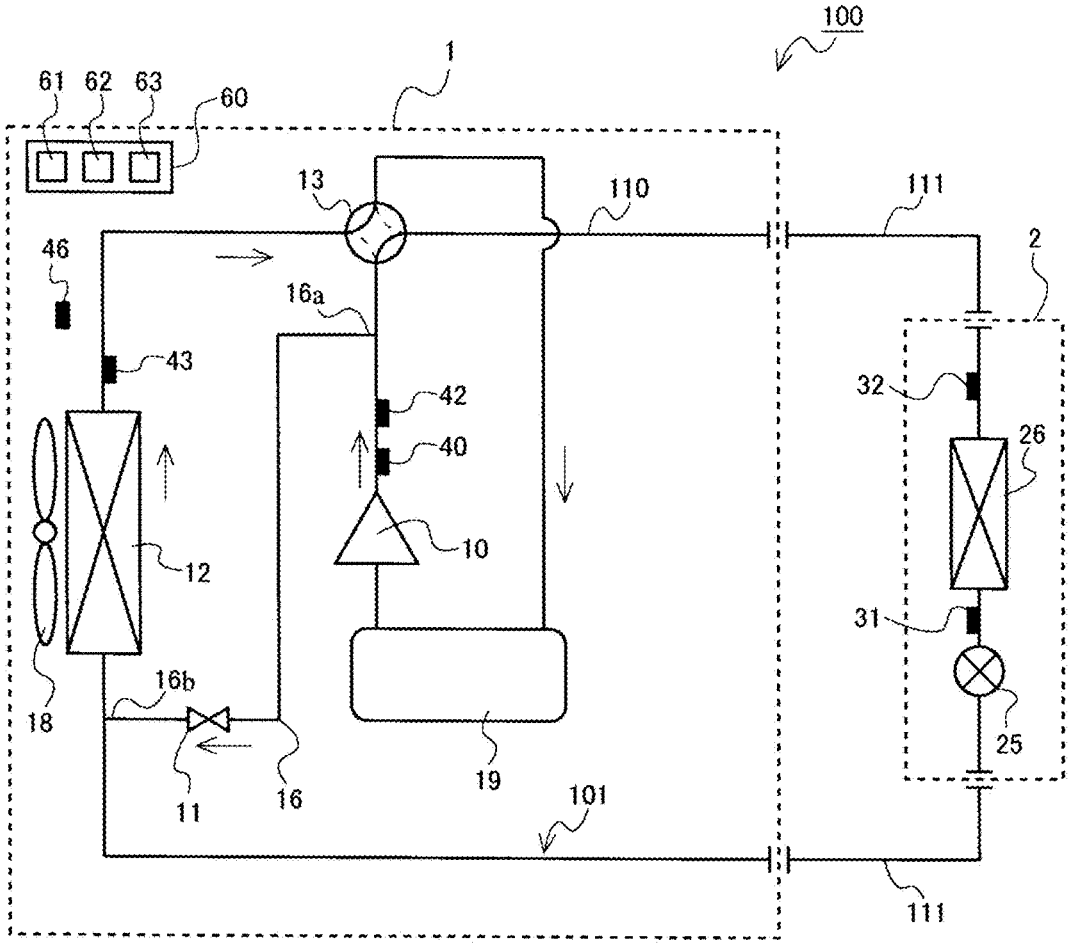
FIG. 3 is a schematic view showing the circuit configuration of the air-conditioning apparatus according to Embodiment 1 and a diagram showing a state in which the air-conditioning apparatus is operating in a defrosting operation mode.

FIG. 3 is a schematic view showing the circuit configuration of the air-conditioning apparatus according to Embodiment 1 and a diagram showing a state in which the air-conditioning apparatus is operating in the defrosting operation mode. In FIG. 3, solid arrows indicate the direction of flow of the refrigerant.

In the defrosting operation mode, the refrigerant flow switching device 13 is kept in the same state as the heating only operation mode indicated by solid lines in FIG. 2. That is, in the defrosting operation mode, a flow passage of the refrigerant through the refrigerant flow switching device 13 is the same as a flow passage through which the refrigerant discharged from the compressor 10 flows into the load-side heat exchanger 26. The load-side expansion device 25 changes from an open state to a closed state. The first opening and closing device 11 changes from a closed state to an open state to allow passage of the refrigerant through the bypass pipe 16. Further, the heat-source-side air-sending device 18 and the load-side air-sending device (not illustrated) are suspended in operation.

In Embodiment 1, in executing the defrosting operation mode, the controller 60 brings the load-side expansion device 25 into a closed state after bringing the first opening and closing device 11 into an open state. This makes it possible to prevent a clogging of refrigerant flow passages and prevent an excessive rise in pressure in the refrigerant circuit 101.

The high-temperature and high-pressure gas refrigerant discharged from the compressor 10 passes through the bypass pipe 16 and flows into the heat-source-side heat exchanger 12. The high-temperature gas refrigerant flowing into the heat-source-side heat exchanger 12 flows through the heat-source-side heat exchanger 12 while melting the frost forming on the heat-source-side heat exchanger 12 and flows out from the heat-source-side heat exchanger 12. The refrigerant flowing out from the heat-source-side heat exchanger 12 may be low-temperature gas refrigerant on one occasion, may be two-phase refrigerant on another occasion, or may be liquid refrigerant on still another occasion. The refrigerant flowing out from the heat-source-side heat exchanger 12 passes through the refrigerant flow switching device 13 and flows into the accumulator 19. Then, of the refrigerant flowing into the accumulator 19, liquid refrigerant stays in the accumulator 19, and gas refrigerant flows into a suction unit of the compressor 10.

In Embodiment 1, the high-temperature and high-pressure gas refrigerant discharged from the compressor 10 is decompressed by the first opening and closing device 11 to such an extent as to be higher than 0 degrees C. for conversion in terms of saturation temperature and flows into the heat-source-side heat exchanger 12. The high-temperature and medium-pressure refrigerant thus decompressed is higher in temperature than frost and flows as two-phase refrigerant into the heat-source-side heat exchanger 12. This makes it possible to utilize latent heat of the refrigerant and bring about an improved defrosting effect.

For example, in a case in which any of the following conditions meets a specified condition, defrosting of the heat-source-side heat exchanger 12 is terminated on the basis of the determination that termination conditions are met. A determination on whether to terminate the defrosting operation mode is made, for example, by the control unit 63. Specifically, in a case in which a period of time that elapses since the start of execution of the defrosting operation mode is longer than or equal to a specified period of time, the defrosting operation mode is terminated on the basis of the determination that the defrosting of the heat-source-side heat exchanger 12 is completed. The specified period of time is for example 10 minutes. It should be noted that the period of time that elapses since the start of execution of the defrosting operation mode is calculated, for example, by the arithmetic unit 62. Further, for example, in a case in which the temperature of the refrigerant detected by the heat-source-side heat exchanger temperature sensor 43 is higher than or equal to a specified temperature, the defrosting operation mode is terminated on the basis of the determination that the defrosting of the heat-source-side heat exchanger 12 is completed. The specified temperature is for example 5 degrees C. It should be noted that when high-temperature refrigerant is let in in a case is considered in which frost has formed entirely on the heat-source-side heat exchanger 12 without any gap, the aforementioned specified time may be preferably set to be longer than or equal to time required for all of the frost to melt away.

It should be noted that the aforementioned specified period of time of 10 minutes is merely an example. Further, the aforementioned specified temperature of 5 degrees C. too is merely an example. Specific values of the aforementioned specified period of time and the aforementioned specified temperature need only be appropriately determined in consideration of the capacity of the heat-source-side heat exchanger 12, the conceivable state of formation of frost on the heat-source-side heat exchanger 12, or other conditions such that all of the frost on the heat-source-side heat exchanger 12 can melt away.

A flow passage of the high-temperature and high-pressure gas refrigerant discharged from the compressor 10 is connected to a flow passage of the load-side heat exchanger 26 via the main pipe 111. Further, the pressure of the high-temperature and high-pressure gas refrigerant discharged from the compressor 10 is higher than the pressure of the refrigerant present in the load-side heat exchanger 26. Further, in the defrosting operation mode, the load-side expansion device 25 is in a closed state. For this reason, in the defrosting operation mode, the pressure of the high-temperature and high-pressure gas refrigerant discharged from the compressor 10 causes the refrigerant present between the refrigerant flow switching device 13 and the load-side expansion device 25 during the heating only operation mode to be retained between the refrigerant flow switching device 13 and the load-side expansion device 25.

Note here that in the heating only operation mode, the load-side heat exchanger 26, which is located between the refrigerant flow switching device 13 and the load-side expansion device 25, functions as a condenser. For this reason, a large amount of refrigerant is present in the load-side heat exchanger 26. This makes it possible to retain excess refrigerant in the load-side heat exchanger 26 by executing the defrosting operation mode shown in Embodiment 1, thus making it possible to reduce the amount of excess refrigerant that stays in the accumulator 19. Accordingly, during the defrosting operation mode, the air-conditioning apparatus 100 is configured to prevent the liquid refrigerant from overflowing from the accumulator 19 and being sucked into the compressor 10. That is, during the defrosting operation mode, the air-conditioning apparatus 100 is configured to reduce a liquid return to the compressor 10.

Further, in the air-conditioning apparatus 100 according to Embodiment 1, during the defrosting operation mode, the high-temperature refrigerant discharged from the compressor 10 can flow into the heat-source-side heat exchanger 12 by flowing only inside the outdoor unit 1. In other words, in the air-conditioning apparatus 100 according to Embodiment 1, during the defrosting operation mode, the high-temperature refrigerant discharged from the compressor 10 can flow into the heat-source-side heat exchanger 12 without passing through the main pipe 111 or the indoor unit 2. For this reason, during the defrosting operation mode, the air-conditioning apparatus 100 according to Embodiment 1 is configured to prevent the density of the refrigerant that flows into the heat-source-side heat exchanger 12 from decreasing because of a pressure loss. This makes it possible to increase the amount of refrigerant that circulates between the compressor 10 and the heat-source-side heat exchanger 12, making it also possible to reduce degradation in defrosting capacity.

Furthermore, the air-conditioning apparatus 100 according to Embodiment 1 is configured to heat the air-conditioning target space in the heating only operation mode soon after the termination of the defrosting operation mode, thus making it possible to improve user's comfort.

Specifically, in resuming the heating only operation mode after the termination of the defrosting operation mode, the control unit 63 of the controller 60 switches the load-side expansion device 25 from a closed state to an open state. This causes the refrigerant to start to circulate through the refrigerant circuit 101. Further, in resuming the heating only operation mode after the termination of the defrosting operation mode, the control unit 63 switches the first opening and closing device 11 from an open state to a closed state to block the refrigerant from flowing through the bypass pipe 16. Further, in resuming the heating only operation mode after the termination of the defrosting operation mode, the control unit 63 causes the heat-source-side air-sending device 18 to rotate. This causes the refrigerant flowing through the heat-source-side heat exchanger 12 to evaporate by removing heat from the outdoor air.

When the heating only operation mode is resumed after the termination of the defrosting operation mode, the excess refrigerant retained in the load-side heat exchanger 26 passes through the load-side expansion device 25 and the main pipe 111, flows into the heat-source-side heat exchanger 12, and evaporates by removing heat from the outdoor air. That is, the excess refrigerant retained in the load-side heat exchanger 26 can be evaporated in the heat-source-side heat exchanger 12 immediately after the resumption of the heating only operation mode. For this reason, the air-conditioning apparatus 100 according to Embodiment 1 allows more gas refrigerant to flow into the compressor 10 than in a case in which the excess refrigerant during the defrosting operation mode does not flow into the heat-source-side heat exchanger 12, making it possible to increase the amount of refrigerant that is discharged from the compressor 10. Accordingly, the air-conditioning apparatus 100 according to Embodiment 1 allows a larger amount of high-temperature and high-pressure gas refrigerant to flow into the load-side heat exchanger 26 than in a case in which the excess refrigerant during the defrosting operation mode does not flow into the heat-source-side heat exchanger 12. As a result, the air-conditioning apparatus 100 according to Embodiment 1 is configured to heat the air-conditioning target space in the heating only operation mode soon after the termination of the defrosting operation mode, thus making it possible to improve user's comfort.

It should be noted that the first opening and closing device 11 may be preferably of a size selected as follows. Specifically, as mentioned above, during the defrosting operation mode, the high-temperature and high-pressure gas refrigerant discharged from the compressor 10 is decompressed by the first opening and closing device 11 to such an extent as to be higher than 0 degrees C. for conversion in terms of saturation temperature. In a case in which the size of the first opening and closing device 11 is small for the amount of circulating gas refrigerant, the pressure of the high-pressure gas refrigerant discharged from the compressor 10 may excessively rise. For this reason, the first opening and closing device 11 may be preferably of a size selected according to the amount of circulating gas refrigerant during the defrosting operation mode such that the pressure of the high-pressure gas refrigerant discharged from the compressor 10 is lower than operating pressure. A case is described, for example, in which the refrigerant used is R410A and the design pressure of a high-pressure side of the refrigerant circuit 101 is 4.15 MPa. Then, a case is also described, for example, in which an upper limit to the operating pressure at the high-pressure side of the refrigerant circuit 101 during actual execution of the defrosting operation mode is 3.8 MPa, which is lower than 4.15 MPa, in consideration of pressure overshooting. In this case, the first opening and closing device 11 needs only be of a size selected such that the operating pressure during actual execution of the defrosting operation mode is lower than or equal to 3.8 MPa.

Further, during the defrosting operation mode, it is preferable that the control unit 63 control the driving frequency of the compressor 10 in the following manner. For example, as the frost on the heat-source-side heat exchanger 12 melts away during the defrosting operation mode, a path in which the frost hardly melts may exist because of the influence of the amount of frost forming on each path of heat transfer tubes of the heat-source-side heat exchanger 12 and the difference in flow rate of refrigerant. In such a case, the temperature of the gas refrigerant that flows out from the heat-source-side heat exchanger 12 rises beyond 0 degrees C., which is the melting point of frost, and the temperature of the refrigerant that is sucked into the compressor 10 rises. This causes an excessive rise in the temperature of the refrigerant that is discharged from the compressor 10.

The temperature of the refrigerant that is discharged from the compressor 10 affects deterioration of refrigerating machine oil or other phenomena. For this reason, the reliability of the air-conditioning apparatus 100, such as deterioration prevention for refrigerating machine oil, is ensured by setting an upper limit to the temperature of the refrigerant that is discharged from the compressor 10. The upper limit is for example 120 degrees C. For this reason, it is preferable that the control unit 63 control the driving frequency of the compressor 10 such that the temperature of the refrigerant that is discharged from the compressor 10 does not exceed the upper limit. Specifically, it is preferable that in the defrosting operation mode, the control unit 63 lower the driving frequency of the compressor 10 when a temperature detected by the discharge temperature sensor 42 is higher than or equal to a specified temperature. For example, the control unit 63 lowers the driving frequency of the compressor 10 by 20%. The specified temperature is for example 110 degrees C. Lowering the driving frequency of the compressor 10 makes it possible to lower the temperature of the refrigerant that is discharged from the compressor 10, thus making it possible to stably execute the defrosting operation mode. The temperature of the refrigerant that is discharged from the compressor 10 may be hereinafter referred to as "discharge temperature of the compressor 10".

It should be noted that the value of 120 degrees C. of the upper limit to the discharge temperature and the value of 110 degrees C. of the specified temperature of the compressor 10 are merely examples. Specific values of the upper limit to the discharge temperature and the specified temperature of the compressor 10 need only be appropriately determined on the basis of the reliability of the compressor 10 and the refrigerating machine oil actually used or other conditions. Further, the amount by which the driving frequency of the compressor 10 lowers is not limited to 20%, either. The amount by which the driving frequency of the compressor 10 lowers may be any amount, provided the discharge temperature of the compressor 10 can be lowered.

The following describes a control operation that the controller 60 performs in executing the defrosting operation mode.

Figure 4:
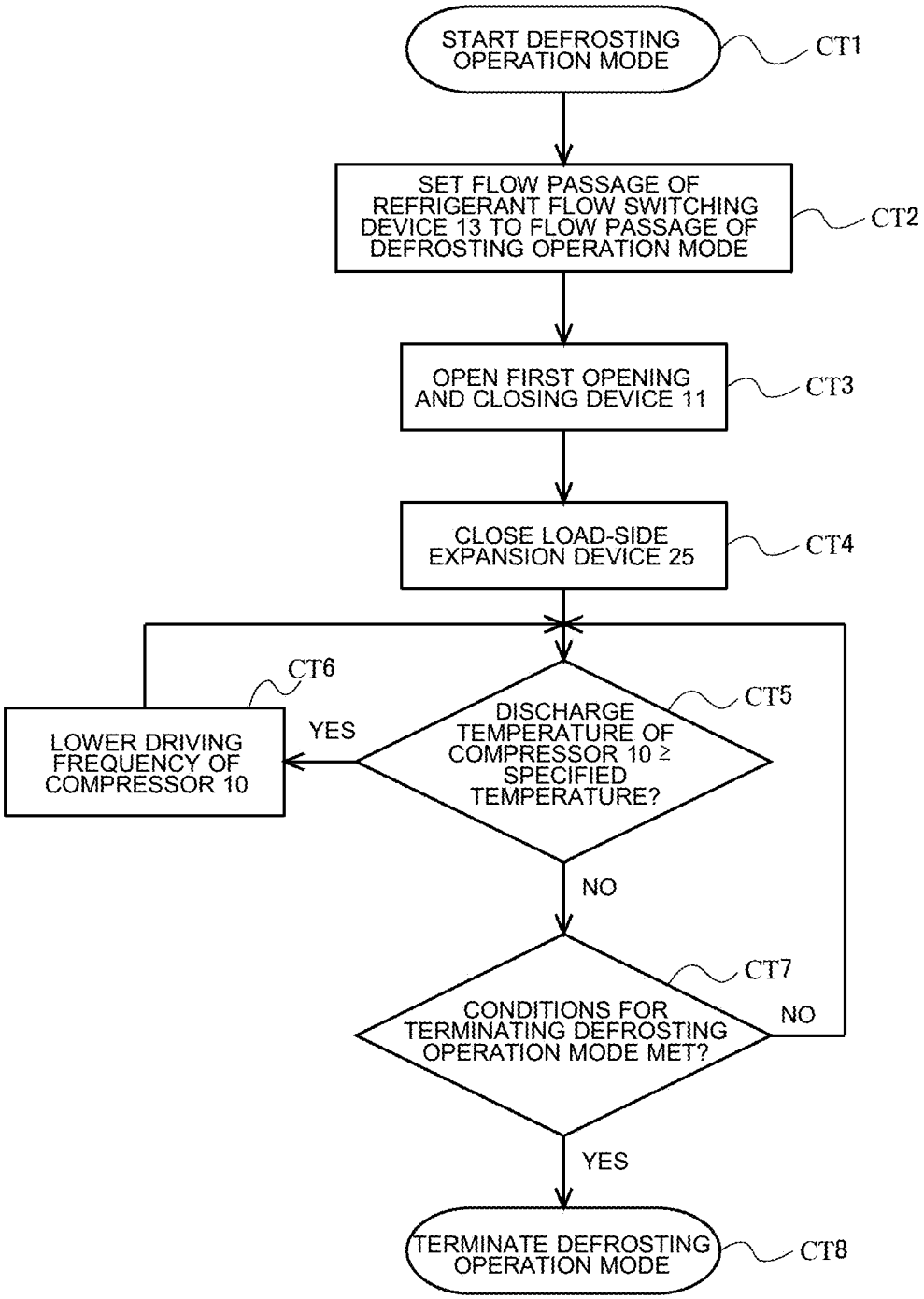
FIG. 4 is a flow chart showing a control operation in which a controller of the air-conditioning apparatus according to Embodiment 1 executes the defrosting operation mode.

FIG. 4 is a flow chart showing a control operation in which the controller of the air-conditioning apparatus according to Embodiment 1 executes the defrosting operation mode.

In a case in which conditions for executing the defrosting operation mode are met, the controller 60 starts the defrosting operation mode in step CT1. In step CT2, which follows step CT1, the control unit 63 of the controller 60 sets the flow passage of the refrigerant flow switching device 13 to a flow passage of the defrosting operation mode. Specifically, the control unit 63 causes the flow passage of the refrigerant flow switching device 13 to be the flow passage through which the refrigerant discharged from the compressor 10 flows into the load-side heat exchanger 26. In the case of Embodiment 1, the control unit 63 switches from the heating only operation mode to the defrosting operation mode. For this reason, in the case of Embodiment 1, the control unit 63 keeps the flow passage of the refrigerant flow switching device 13 the same as a flow passage of the heating only operation mode.

In step CT3, which follows step CT2, the control unit 63 changes the first opening and closing device 11 from a closed state to an open state. Then, in step CT4, which follows step CT3, the control unit 63 changes the load-side expansion device 25 from an open state to a closed state. This allows the refrigerant discharged from the compressor 10 to flow into the heat-source-side heat exchanger 12 from the bypass pipe 16.

Step CT5, which follows step CT4, is a step of determining whether to change the driving frequency of the compressor 10. Specifically, step CT5 is a step of determining whether the discharge temperature of the compressor 10 is higher than or equal to the specified temperature. In other words, step CT5 is a step of determining whether a temperature detected by the discharge temperature sensor 42 and input to the input unit 61 is higher than or equal to the specified temperature. This determination is made, for example, by the control unit 63.

In a case in which a temperature detected by the discharge temperature sensor 42 and input to the input unit 61 is higher than or equal to the specified temperature in step CT5, the control unit 63 proceeds to step CT6, in which the control unit 63 lowers the driving frequency of the compressor 10. For example, the control unit 63 lowers the driving frequency of the compressor 10 by 20%. This makes it possible to lower the discharge temperature of the compressor 10. After step CT6, the controller 60 returns to step CT5.

On the other hand, in a case in which a temperature detected by the discharge temperature sensor 42 and input to the input unit 61 is not higher than or equal to the specified temperature in step CT5, the controller 60 proceeds to step CT7 without changing the driving frequency of the compressor 10.

Step CT7 is a step of determining whether conditions for terminating the defrosting operation mode are met. For example, the arithmetic unit 62 calculates the period of time that elapses since the start of execution of the defrosting operation mode. Then, in a case in which the period of time that elapses since the start of execution of the defrosting operation mode is longer than or equal to the specified period of time, the control unit 63 determines that conditions for terminating the defrosting operation mode are met. On the other hand, in a case in which the period of time that elapses since the start of execution of the defrosting operation mode is shorter than the specified period of time, the control unit 63 determines that conditions for terminating the defrosting operation mode are not met. Further, for example, in a case in which the temperature of the refrigerant flowing out from the heat-source-side heat exchanger 12 is higher than or equal to the specified temperature, the control unit 63 determines that conditions for terminating the defrosting operation mode are met. On the other hand, in a case in which the temperature of the refrigerant flowing out from the heat-source-side heat exchanger 12 is lower than the specified temperature, the control unit 63 determines that conditions for terminating the defrosting operation mode are not met. The temperature of the refrigerant flowing out from the heat-source-side heat exchanger 12 is a temperature detected by the heat-source-side heat exchanger temperature sensor 43 and input to the input unit 61. It should be noted that at least either termination conditions based on the period of time that elapses since the start of execution of the defrosting operation mode or termination conditions based on the temperature of the refrigerant flowing out from the heat-source-side heat exchanger 12 are met, the control unit 63 may determine that conditions for terminating the defrosting operation mode are met.

In a case in which the control unit 63 determines in step CT7 that conditions for terminating the defrosting operation mode are met, the controller 60 terminates the defrosting operation mode in step CT8. Specifically, the control unit 63 changes the load-side expansion device 25 from a closed state to an open state. Subsequently, the control unit 63 changes the first opening and closing device 11 from an open state to a closed state. Then, the control unit 63 executes the heating only operation mode.

On the other hand, in a case in which the control unit 63 determines in step CT7 that conditions for terminating the defrosting operation mode are not met, the controller 60 returns to step CT5.

Modification of Embodiment 1

The aforementioned air-conditioning apparatus 100 is merely an example. The following introduces some modification of the air-conditioning apparatus 100 according to Embodiment 1.

Figure 5:
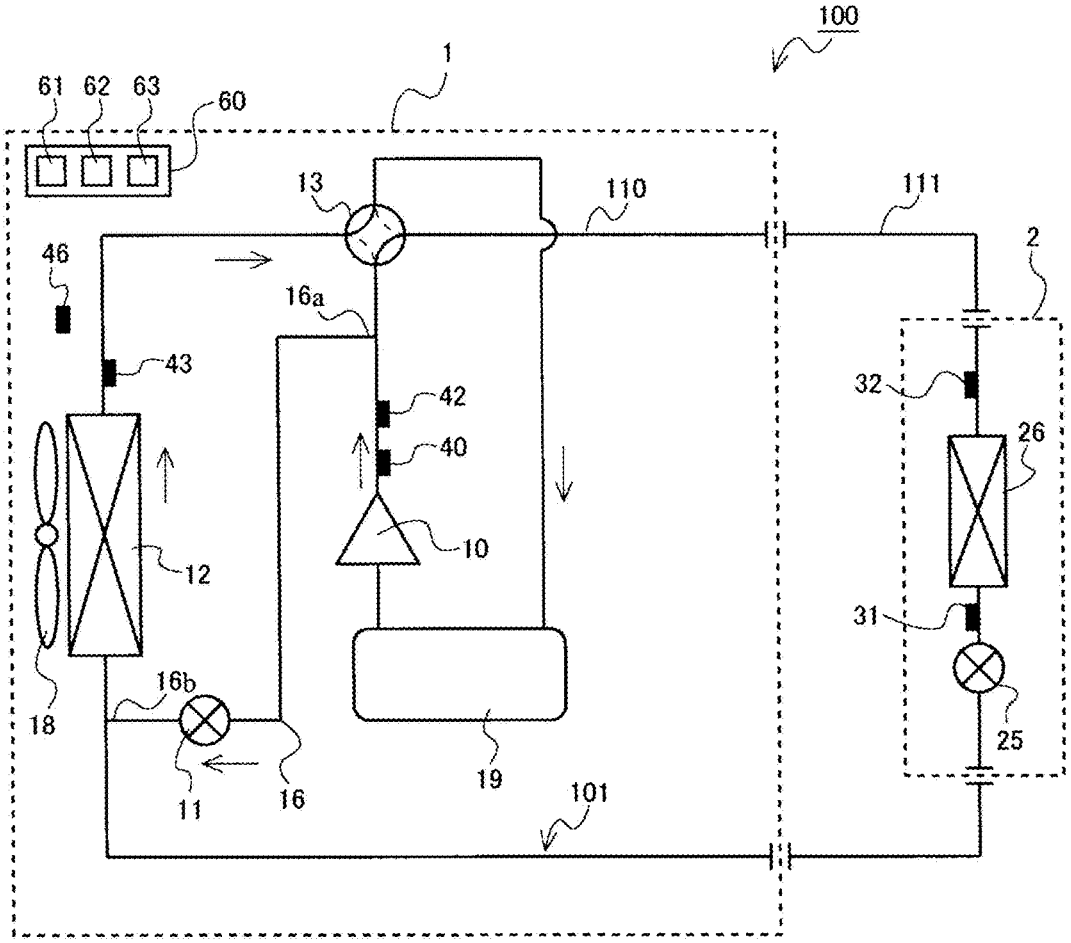
FIG. 5 is a schematic view showing a circuit configuration of another example of the air-conditioning apparatus according to Embodiment 1 and a diagram showing a state in which the air-conditioning apparatus is operating in the defrosting operation mode.

FIG. 5 is a schematic view showing a circuit configuration of another example of the air-conditioning apparatus according to Embodiment 1 and a diagram showing a state in which the air-conditioning apparatus is operating in the defrosting operation mode. In FIG. 5, the direction of flow of the refrigerant is indicated by solid arrows.

In the air-conditioning apparatus 100 shown in FIG. 5, the first opening and closing device 11 is an electronic expansion valve capable of adjusting the flow rate of refrigerant.

A case is described in which with progression of the defrosting operation mode, most of the frost on the heat-source-side heat exchanger 12 melts away and part of the frost remains on the heat-source-side heat exchanger 12. In such a situation, the heat-source-side heat exchanger 12 is heated by the refrigerant, so that there may be a rise in the low pressure of the refrigerant that circulates between the compressor 10 and the heat-source-side heat exchanger 12 and a rise in the pressure of the high-pressure gas refrigerant discharged from the compressor 10. However, using as the first opening and closing device 11 an electronic expansion valve capable of adjusting the flow rate of refrigerant enables the control unit 63 to, during the defrosting operation mode, adjust the opening degree of the first opening and closing device 11 such that the pressure of the high-pressure gas refrigerant discharged from the compressor 10 becomes equal to a first specified pressure. The first specified pressure is for example 3.0 MPa. Further, for example, during the defrosting operation mode, the control unit 63 increases the opening degree of the first opening and closing device 11 in a case in which the pressure of the high-pressure gas refrigerant discharged from the compressor 10 becomes higher than or equal to a second specified pressure. The second specified pressure is for example 3.8 MPa. Using as the first opening and closing device 11 an electronic expansion valve capable of adjusting the flow rate of refrigerant makes it possible to thus adjust the pressure of the high-pressure gas refrigerant discharged from the compressor 10 and reduce a rise in the pressure of the high-pressure gas refrigerant discharged from the compressor 10. That is, using as the first opening and closing device 11 an electronic expansion valve capable of adjusting the flow rate of refrigerant makes it possible to stably execute the defrosting operation mode.

In the aforementioned example, the air-conditioning apparatus 100 includes the accumulator 19 as a container in which to accumulate an excess of the refrigerant. However, the container in which to accumulate excess refrigerant is not limited to the accumulator 19. A known example of the container in which to accumulate excess refrigerant is a receiver that is provided between the heat-source-side heat exchanger 12 and the load-side expansion device 25. The air-conditioning apparatus 100 may include a container other than the accumulator 19, such as the receiver, as the container in which to accumulate excess refrigerant. As mentioned above, in the defrosting operation mode, the air-conditioning apparatus 100 according to Embodiment 1 is configured to reduce the amount of liquid refrigerant that is accumulated in the container in which to accumulate excess refrigerant. For this reason, in the air-conditioning apparatus 100 according to Embodiment 1, it is preferable that the capacity of the container in which to accumulate excess refrigerant be smaller than the volume of refrigerant that is charged into the refrigerant circuit 101 when all of the refrigerant is in liquid form. This makes it possible to reduce the size of the outdoor unit 1 and reduce the size of the air-conditioning apparatus 100.

Further, in a case in which excess refrigerant is generated only during the defrosting operation mode and the excess refrigerant can be retained in the load-side heat exchanger 26, the air-conditioning apparatus 100 does not need to include a container such as the accumulator 19 in which to accumulate excess refrigerant.

Further, in the aforementioned example of the air-conditioning apparatus 100, the load-side expansion device 25 is mounted in the indoor unit 2. However, the load-side expansion device 25 may be mounted in any position. For example, the load-side expansion device 25 may be mounted in the outdoor unit 1. Further, as shown in an embodiment described later, the air-conditioning apparatus 100 may include a relay unit that connects the outdoor unit 1 with the indoor unit 2. In such a case, for example, the load-side expansion device 25 may be mounted in the relay unit.

Further, in the aforementioned example of the air-conditioning apparatus 100, the heat-source-side heat exchanger 12 and the load-side heat exchanger 26 are configured to cause refrigerant and air supplied from an air-sending device to exchange heat with each other. However, the heat-source-side heat exchanger 12 and the load-side heat exchanger 26 may be configured in any way, provided they can reject or remove heat to or from refrigerant. For example, the heat-source-side heat exchanger 12 and the load-side heat exchanger 26 may be configured to cause refrigerant and a heat medium to exchange heat with each other. The term "heat medium" refers to liquid, such as water and antifreeze, that is different from refrigerant that circulates through the heat-source-side heat exchanger 12 and the load-side heat exchanger 26. Further, for example, the load-side heat exchanger 26 may be a radiation panel heater. Further, in a case in which the load-side heat exchanger 26 is configured to cause refrigerant and a heat medium to exchange heat with each other, the load-side heat exchanger 26 is not limited to being mounted in the indoor unit 2. For example, the load-side heat exchanger 26 may be mounted in the outdoor unit 1. Further, for example, in a case in which the air-conditioning apparatus 100 includes a relay unit, the load-side heat exchanger 26 may be mounted in the relay unit. The air-conditioning target space can be cooled or heated by providing the indoor unit 2 with an indoor heat exchanger through which the heat medium subjected to heat exchange with the refrigerant in the load-side heat exchanger 26 flows and supplying the indoor heat exchanger with the heat medium cooled or heated in the load-side heat exchanger 26.

Further, in the aforementioned example, the air-conditioning apparatus 100 includes one heat-source-side heat exchanger 12, one refrigerant flow switching device 13, one first opening and closing device 11, and one bypass pipe 16. Without being limited to this example, the air-conditioning apparatus 100 may include a plurality of heat-source-side heat exchangers 12, a plurality of refrigerant flow switching devices 13, a plurality of first opening and closing devices 11, and a plurality of bypass pipes 16.

Further, in the aforementioned example of the air-conditioning apparatus 100, the refrigerant used is R410A. However, the refrigerant used in the air-conditioning apparatus 100 is not limited to R410A. For example, any single component refrigerant or mixed refrigerants having a two-phase gas-liquid state can be used in the air-conditioning apparatus 100.

As noted above, an air-conditioning apparatus 100 according to Embodiment 1 includes a refrigerant circuit 101 in which a compressor 10, a heat-source-side heat exchanger 12, a refrigerant flow switching device 13, a load-side heat exchanger 26, and a load-side expansion device 25 are connected by a refrigerant pipe 110. Further, the air-conditioning apparatus 100 includes a bypass pipe 16 of which inlet-side end 16*a* is connected to a point in the refrigerant circuit 101 located between a discharge outlet of the compressor 10 and the refrigerant flow switching device 13 and of which outlet-side end 16*b* is connected to a point in the refrigerant circuit 101 located between the load-side expansion device 25 and the heat-source-side heat exchanger 12. Further, the air-conditioning apparatus 100 includes a first opening and closing device 11 provided in the bypass pipe 16 and configured to open and close a flow passage of the refrigerant at a place at which the first opening and closing device 11 is installed. Further, the air-conditioning apparatus 100 includes a controller 60 configured to control the refrigerant flow switching device 13, the load-side expansion device 25, and the first opening and closing device 11. Further, the air-conditioning apparatus 100 includes an outdoor unit 1 mounted with the compressor 10, the heat-source-side heat exchanger 12, the refrigerant flow switching device 13, the bypass pipe 16, and the first opening and closing device 11. Moreover, in executing a defrosting operation mode of defrosting the heat-source-side heat exchanger 12, the controller 60 causes a flow passage of the refrigerant through the refrigerant flow switching device 13 to be a flow passage through which the refrigerant discharged from the compressor 10 flows into the load-side heat exchanger 26. Further, the controller 60 changes the first opening and closing device 11 from a closed state to an open state, changes the load-side expansion device 25 from an open state to a closed state, and causes the refrigerant discharged from the compressor 10 to flow into the heat-source-side heat exchanger 12 from the bypass pipe 16.

As mentioned above, during the defrosting operation mode, the air-conditioning apparatus 100 thus formed is also configured to reduce a liquid return to the compressor 10 and also reduce degradation in defrosting capacity.

Embodiment 2

As shown in Embodiment 2, the air-conditioning apparatus 100 may include a second opening and closing device 15. It should be noted that matters that are not referred to in Embodiment 2 are similar to those referred to in Embodiment 1.

Figure 6:
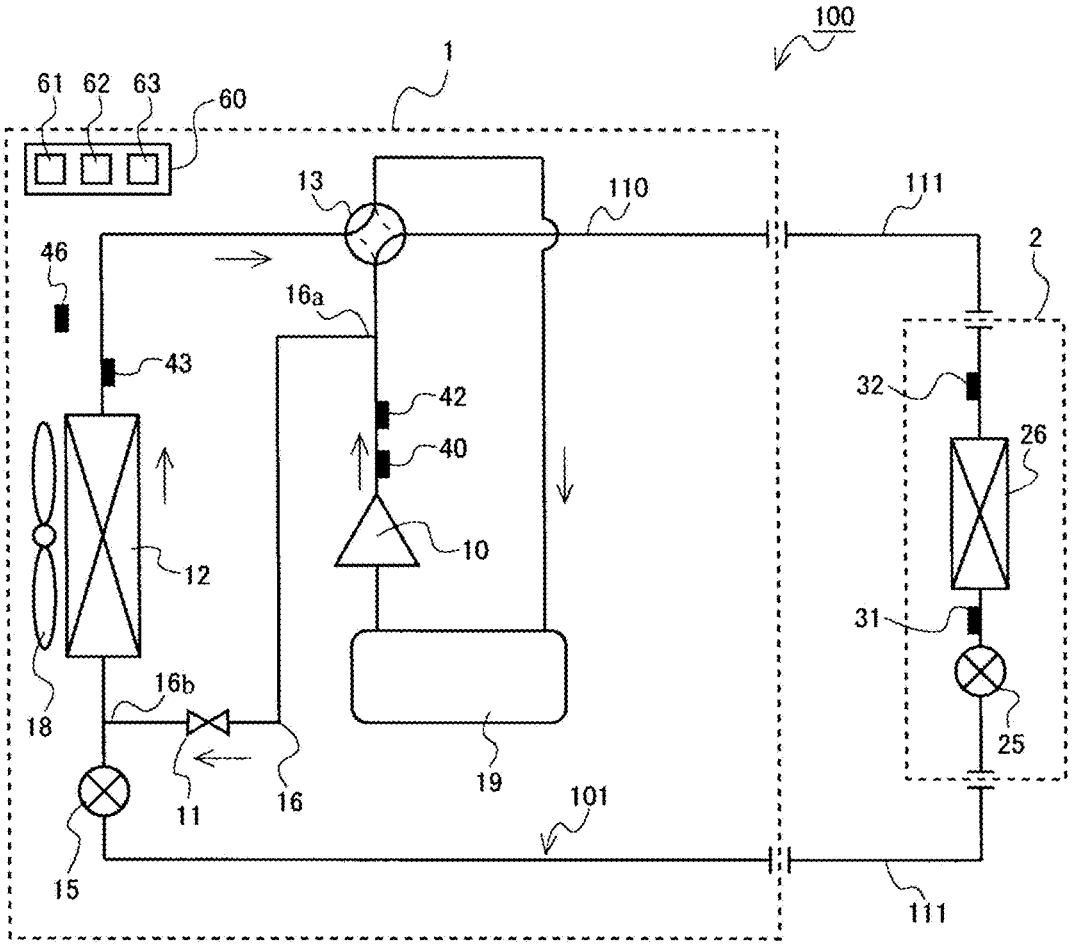
FIG. 6 is a schematic view showing a circuit configuration of an air-conditioning apparatus according to Embodiment 2 and a diagram showing a state in which the air-conditioning apparatus is operating in the defrosting operation mode.

FIG. 6 is a schematic view showing a circuit configuration of an air-conditioning apparatus according to Embodiment 2 and a diagram showing a state in which the air-conditioning apparatus is operating in the defrosting operation mode. In FIG. 6, the direction of flow of the refrigerant is indicated by solid arrows.

The air-conditioning apparatus 100 according to Embodiment 2 includes a second opening and closing device 15. The second opening and closing device 15 is configured to open and close a flow passage of the refrigerant at a place at which the second opening and closing device 15 is installed. The second opening and closing device 15 is provided in the refrigerant circuit 101 and at an inflow side of the heat-source-side heat exchanger 12 through which the refrigerant flows into the heat-source-side heat exchanger 12 when the heat-source-side heat exchanger 12 functions as an evaporator and faces the heat-source-side heat exchanger 12 across a place with which the outlet-side end 16*b* of the bypass pipe 16 is connected. Further, in Embodiment 2, the second opening and closing device 15 is mounted in the outdoor unit 1. The second opening and closing device 15 may be preferably, for example, a device capable of opening and closing a flow passage of refrigerant, such as a two-way valve, a solenoid valve, and an electronic expansion valve capable of adjusting the flow rate of refrigerant. The second opening and closing device 15 is controlled by the controller 60. Specifically, during the cooling only operation mode and the heating only operation mode, the control unit 63 of the controller 60 keeps the second opening and closing device 15 in an open state. Further, in executing the defrosting operation mode, the control unit 63 changes the second opening and closing device 15 from an open state to a closed state.

During the defrosting operation mode, the high-temperature and high-pressure gas refrigerant discharged from the compressor 10 passes through the bypass pipe 16 and flows into the heat-source-side heat exchanger 12. In a case in which the second opening and closing device 15 is not provided, part of the high-temperature and high-pressure gas refrigerant discharged from the compressor 10 is to flow toward the load-side expansion device 25 after flowing out from the bypass pipe 16. Note here that a section of the refrigerant pipe 110 situated between the second opening and closing device 15 and the load-side expansion device 25 is lower in temperature than the refrigerant discharged from the compressor 10. For this reason, when the refrigerant discharged from the compressor 10 flows into the section of the refrigerant pipe 110 situated between the second opening and closing device 15 and the load-side expansion device 25, the high-temperature and high-pressure gas refrigerant discharged from the compressor 10 may condense and stay.

However, keeping the second opening and closing device 15 in a closed state during the defrosting operation mode makes it possible to prevent the refrigerant discharged from the compressor 10 from flowing into the section of the refrigerant pipe 110 situated between the second opening and closing device 15 and the load-side expansion device 25. That is, keeping the second opening and closing device 15 in a closed state during the defrosting operation mode makes it possible to prevent the high-temperature and high-pressure gas refrigerant discharged from the compressor 10 from condensing or staying in the section of the refrigerant pipe 110 situated between the second opening and closing device 15 and the load-side expansion device 25. Accordingly, the air-conditioning apparatus 100 according to Embodiment 2 allows more of the high-temperature and high-pressure gas refrigerant discharged from the compressor 10 to flow into the heat-source-side heat exchanger 12, thus bringing about further improvement in defrosting capacity.

Figure 7:
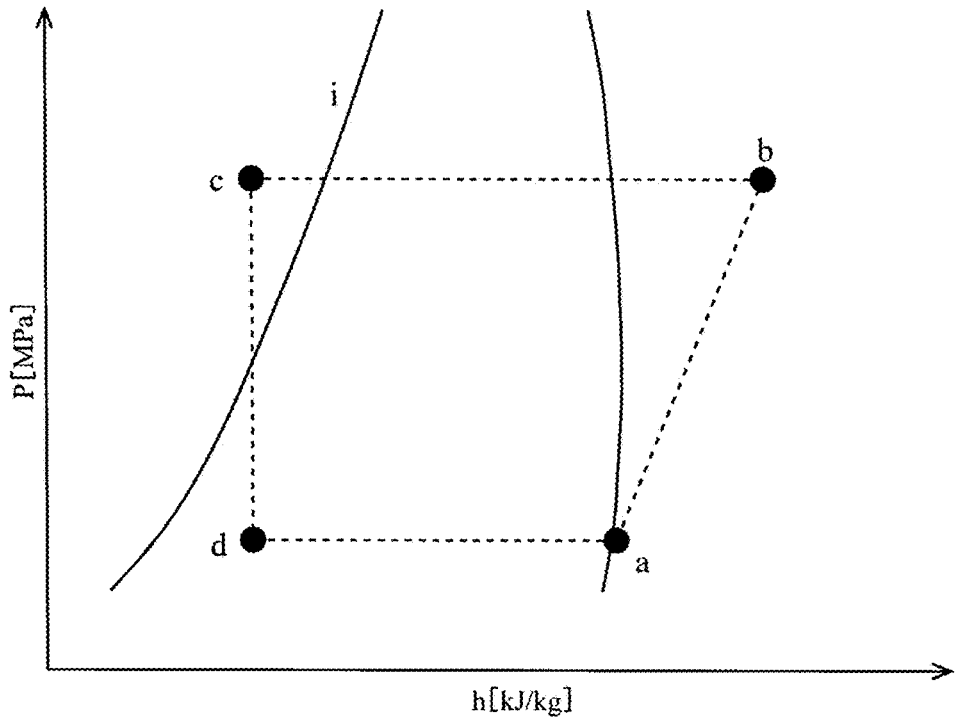
FIG. 7 is a schematic view of a Mollier chart showing states of refrigerant when the air-conditioning apparatus according to Embodiment 2 is operating in the heating only operation mode.

FIG. 7 is a schematic view of a Mollier chart showing states of the refrigerant when the air-conditioning apparatus according to Embodiment 2 is operating in the heating only operation mode. In FIG. 7, the horizontal axis represents specific enthalpy h [KJ/kg]. Further, in FIG. 7, the vertical axis represents pressure P [MPa]. A distribution of the amount of refrigerant in the heating only operation mode of the air-conditioning apparatus 100 is described with reference to FIG. 7. In a case in which the air-conditioning apparatus 100 shown in Embodiment 1 operates in the heating only operation mode too, the refrigerant is in states that are similar to those shown in FIG. 7.

In FIG. 7, i indicates saturation lines. On the right side of a right one of the saturation lines i, the refrigerant is in a single-phase gas state. Further, on the left side of a left one of the saturation lines i, the refrigerant is in a single-phase liquid state. Further, between the right and left saturation lines i, the refrigerant is in a two-phase gas-liquid state. When in a single-phase liquid state, the refrigerant is approximately 30 times higher in density than it is when in a single-phase gas state. For example, in a case in which R410A has a pressure of 1.0 MPa, the density of single-phase gas refrigerant is approximately 38 kg/m$^3$, and the density of single-phase liquid refrigerant is approximately 1,140 kg/cm$^3$. For this reason, as two-phase gas-liquid refrigerant approaches the left saturation line i, the required amount of refrigerant increases.

In FIG. 7, the gas refrigerant discharged from the compressor 10 is in a state indicated by a point b. This gas refrigerant is condensed by the load-side heat exchanger 26 into liquid refrigerant, which is in a state indicated by a point c. This liquid refrigerant is decompressed by the load-side expansion device 25, passes through the main pipe 111, and turns into two-phase gas-liquid refrigerant, which is in a state indicated by a point d. This two-phase gas-liquid refrigerant is evaporated by the heat-source-side heat exchanger 12, passes through the accumulator 19, and is sucked into the compressor 10 as gas refrigerant, which is in a state indicated by a point a. Therefore, most of the refrigerant charged into the air-conditioning apparatus 100 stays in the load-side heat exchanger 26, the main pipe 111, and the heat-source-side heat exchanger 12, where it changes from a two-phase gas-liquid state to a liquid-phase state.

Figure 8:
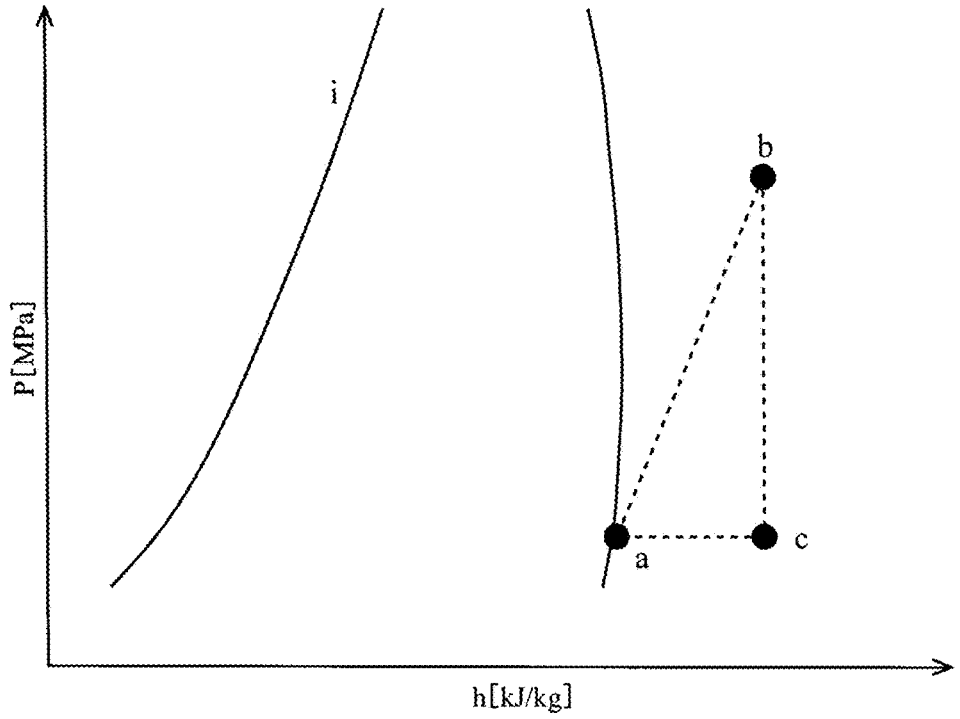
FIG. 8 is a schematic view of a Mollier chart showing states of the refrigerant when the air-conditioning apparatus according to Embodiment 2 is operating in the defrosting operation mode.

FIG. 8 is a schematic view of a Mollier chart showing states of the refrigerant when the air-conditioning apparatus according to Embodiment 2 is operating in the defrosting operation mode. In FIG. 8, the horizontal axis represents specific enthalpy h [KJ/kg], as in FIG. 7. Further, in FIG. 8, the vertical axis represents pressure P [MPa], as in FIG. 7. A distribution of the amount of refrigerant in the defrosting operation mode of the air-conditioning apparatus 100 is described with reference to FIG. 8. In a case in which the air-conditioning apparatus 100 shown in Embodiment 1 operates in the defrosting operation mode too, the refrigerant is in states that are similar to those shown in FIG. 8.

FIG. 8 shows saturation lines i that are the same as those shown in FIG. 7. That is, on the right side of a right one of the saturation lines i, the refrigerant is in a single-phase gas state. Further, on the left side of a left one of the saturation lines i, the refrigerant is in a single-phase liquid state. Further, between the right and left saturation lines i, the refrigerant is in a two-phase gas-liquid state. As mentioned above, when in a single-phase liquid state, the refrigerant is approximately 30 times higher in density than it is when in a single-phase gas state. For this reason, as two-phase gas-liquid refrigerant approaches the left saturation line i, the required amount of refrigerant increases.

In FIG. 8, the gas refrigerant discharged from the compressor 10 is in a state indicated by a point b. This gas refrigerant is decompressed in the first opening and closing device 11 into gas refrigerant, which is in a state indicated by a point c. The gas refrigerant at the point c is cooled by melting frost forming on the heat-source-side heat exchanger 12, passes through the accumulator 19, and is sucked into the compressor 10 as gas refrigerant, which is in a state indicated by a point a. Thus, the gas refrigerant is the only refrigerant that is needed in the defrosting operation mode. For this reason, a portion of the refrigerant used in the heating only operation mode that is no longer used in the defrosting operation mode stays as excess refrigerant in the load-side heat exchanger 26 and the accumulator 19.

Because of limitations of installation environment, some air-conditioning apparatus may have a long main pipe between an outdoor unit and an indoor unit. For example, a variable refrigerant flow (VRF) system has an outdoor unit installed on the roof of a building and a plurality of indoor units installed on lower levels of the building. In such a case, a main pipe between the outdoor unit and an indoor unit may be long. Because of limitations of installation environment, the air-conditioning apparatus 100 according to Embodiment 2 too may have a long main pipe 111 between the outdoor unit 1 and the indoor unit 2. In such a case in which the main pipe 111 is long, the amount of refrigerant that is present in the main pipe 111 increases. For this reason, a large amount of refrigerant can be accumulated in the main pipe 111 by providing the second opening and closing device 15 and keeping the second opening and closing device 15 in a closed state during the defrosting operation mode. This results in making it possible to reduce the amount of refrigerant that is accumulated in the accumulator 19 during the defrosting operation mode. For this reason, it is preferable that an air-conditioning apparatus 100 including an accumulator 19 of which capacity is smaller than the volume of refrigerant that is charged into the refrigerant circuit 101 when all of the refrigerant is in liquid form be provided with a second opening and closing device 15.

The following describes a control operation that the controller 60 performs when the air-conditioning apparatus 100 according to Embodiment 2 executes the defrosting operation mode.

Figure 9:
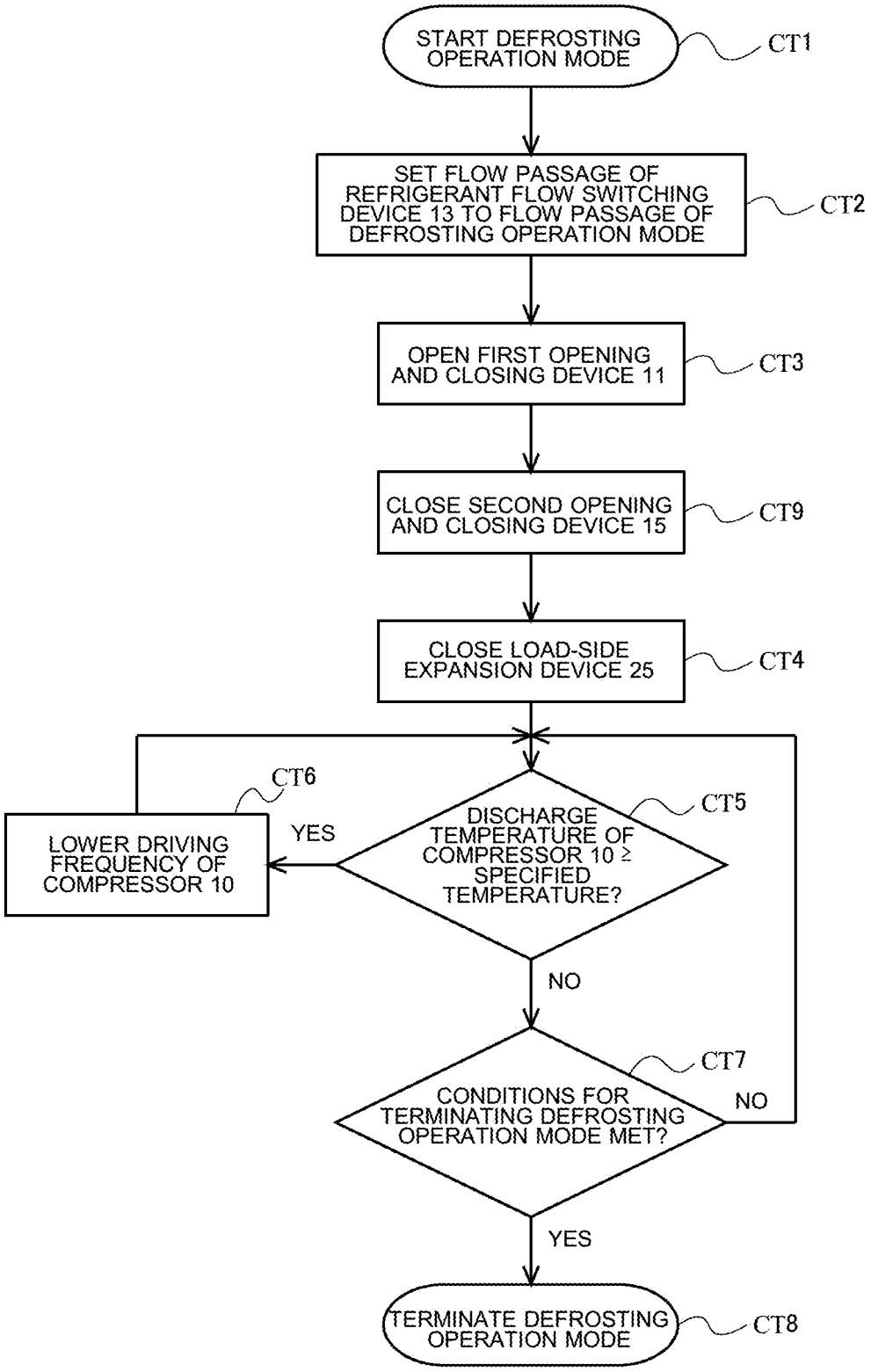
FIG. 9 is a flow chart showing a control operation in which a controller of the air-conditioning apparatus according to Embodiment 2 executes the defrosting operation mode.

FIG. 9 is a flow chart showing a control operation in which the controller of the air-conditioning apparatus according to Embodiment 2 executes the defrosting operation mode.

When the air-conditioning apparatus 100 according to Embodiment 2 executes the defrosting operation mode, the control operation that the controller 60 performs includes an action of step CT9 added to the control operation shown in FIG. 4 of Embodiment 1. This step CT9 is made between step CT3 and step CT4. It should be noted that step CT9 needs only be made between step CT3 and step CT5. For example, step CT9 may be made between step CT4 and step CT5.

Specifically, in executing the defrosting operation mode, the control unit 63 of the controller 60 changes the second opening and closing device 15 from an open state to a closed state in step CT9, which follows step CT3, and shifts to step CT5. That is, in executing the defrosting operation mode, the control unit 63 brings the first opening and closing device 11 into an open state before bringing the load-side expansion device 25 and the second opening and closing device 15 each into a closed state. This makes it possible to prevent a clogging of refrigerant flow passages and prevent an excessive rise in pressure in the refrigerant circuit 101.

Embodiment 3

As mentioned above, the air-conditioning apparatus 100 may include a relay unit that connects the outdoor unit 1 with the indoor unit 2. Embodiment 3 illustrates an example of an air-conditioning apparatus 100 including a relay unit. It should be noted that matters that are not referred to in Embodiment 3 are similar to those referred to in Embodiment 1 or 2.

[Configuration of Air-Conditioning Apparatus 100]

Figure 10:
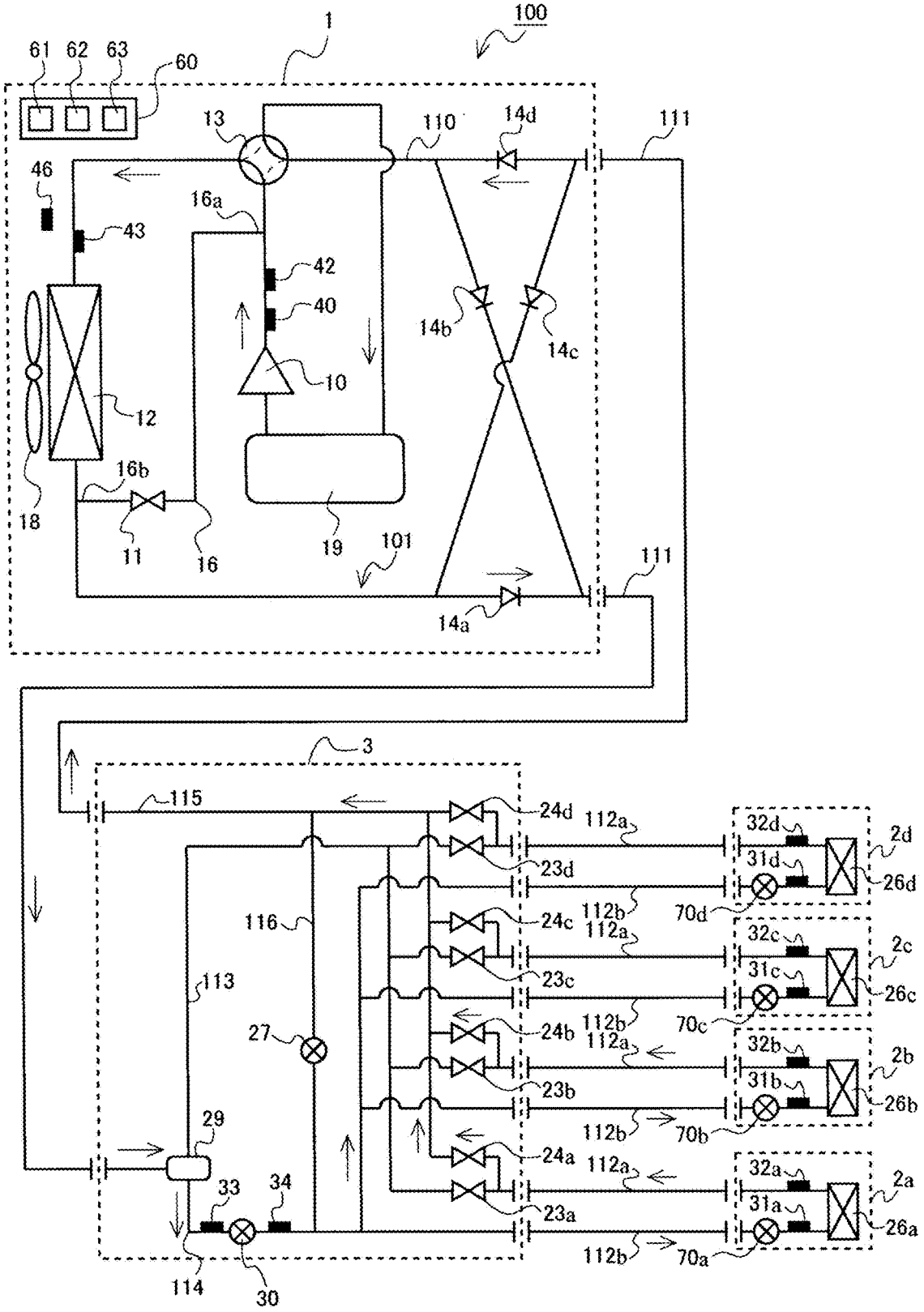
FIG. 10 is a schematic view showing a circuit configuration of an air-conditioning apparatus according to Embodiment 3 and a diagram showing a state in which the air-conditioning apparatus is operating in the cooling only operation mode.

FIG. 10 is a schematic view showing a circuit configuration of an air-conditioning apparatus according to Embodiment 3 and a diagram showing a state in which the air-conditioning apparatus is operating in the cooling only operation mode.

As shown in FIG. 10, the air-conditioning apparatus 100 includes one outdoor unit 1, a plurality of indoor units 2, and one relay unit 3. The relay unit 3 connects the outdoor unit 1 with the indoor units 2. The outdoor unit 1 and the relay unit 3 are connected by a plurality of main pipes 111 through which refrigerant flows. The main pipes 111 are parts of the refrigerant pipe 110 of the refrigerant circuit 101. Further, the relay unit 3 and each of the indoor units 2 are connected by corresponding ones of a plurality of branch pipes 112. The branch pipes 112 are parts of the refrigerant pipe 110 of the refrigerant circuit 101. Cooling energy or heating energy generated in the outdoor unit 1 is supplied to each indoor unit 2 via the relay unit 3.

In the following, the indoor units 2 may be distinguished from each other with a letter of the alphabet added at the end of a reference sign. FIG. 1 illustrates an indoor unit 2*a*, an indoor unit 2*b*, an indoor unit 2*c*, and an indoor unit 2*d* as the plurality of indoor units 2. Further, in the following, a plurality of components provided for the respective indoor units 2 too may be distinguished from each other with a letter of the alphabet added at the end of a reference sign. For example, as will be mentioned later, each indoor unit 2 is mounted with a load-side heat exchanger 26. In this case, for example, the load-side heat exchanger 26 mounted in the indoor unit 2*a* may be referred to as "load-side heat exchanger 26*a*".

In Embodiment 3, the outdoor unit 1 and the relay unit 3 are connected by two main pipes 111. Further, the relay unit 3 and each of the indoor units 2 are connected by two branch pipes 112. Specifically, the relay unit 3 and each of the indoor units 2 are connected by a branch pipe 112*a* and a branch pipe 112*b*. Since the outdoor unit 1 and the relay unit 3 are connected by two pipes and the relay unit 3 and each indoor unit 2 are connected by two pipes, the air-conditioning apparatus 100 can be easily installed.

[Configuration of Outdoor Unit 1]

As in the case of Embodiment 1, the outdoor unit 1 is mounted with a compressor 10, a refrigerant flow switching device 13, a heat-source-side heat exchanger 12, an accumulator 19, a first opening and closing device 11, a bypass pipe 16, and a heat-source-side air-sending device 18.

Furthermore, the outdoor unit 1 is provided with a backflow prevention device 14*a*, a backflow prevention device 14*b*, a backflow prevention device 14*c*, and a backflow prevention device 14*d*. The backflow prevention devices 14*a* to 14*d* are for example check valves. The backflow prevention device 14*a* is configured to prevent high-temperature and high-pressure gas refrigerant discharged from the compressor 10 from flowing back to the heat-source-side heat exchanger 12 during the heating only operation mode and the after-mentioned heating main operation mode. The backflow prevention device 14*b* is configured to prevent high-pressure liquid or two-phase gas-liquid refrigerant from flowing back from a section of the refrigerant pipe 110 situated beside an outlet of the backflow prevention device 14*a* to the accumulator 19 during the cooling only operation mode and a cooling main operation mode. The backflow prevention device 14*c* is configured to prevent high-pressure liquid or two-phase gas-liquid refrigerant from flowing back from a section of the refrigerant pipe 110 situated beside an inlet of the backflow prevention device 14*a* to the accumulator 19 during the cooling only operation mode and the cooling main operation mode. The backflow prevention device 14*d* is configured to prevent high-temperature and high-pressure gas refrigerant from flowing back from a flow passage situated beside a discharge side of the compressor 10 to a main pipe 111 during the heating only operation mode the heating main operation mode.

By thus providing the backflow prevention devices 14*a* to 14*d*, the flow of refrigerant that flows into the relay unit 3 can be made unidirectional regardless of operation requested by an indoor unit 2. Although, in Embodiment 3, the backflow prevention devices 14*a* to 14*d* used are check valves, the backflow prevention devices 14*a* to 14*d* are not limited to this configuration, provided they are configured to prevent backflow of refrigerant. For example, as the backflow prevention devices 14*a* to 14*d*, opening and closing devices or expansion devices each having a full-close function can be used.

[Configuration of Indoor Units 2*a* to 2*d*]

The indoor units 2 are for example identical in configuration to each other. Each indoor unit 2 includes an indoor-side expansion device 70, which functions as a load-side expansion device 25, and a load-side heat exchanger 26. That is, the indoor unit 2*a* includes an indoor-side expansion device 70*a* and a load-side heat exchanger 26*a*. The indoor unit 2*b* includes an indoor-side expansion device 70*b* and a load-side heat exchanger 26*b*. The indoor unit 2*c* includes an indoor-side expansion device 70*c* and a load-side heat exchanger 26*c*. The indoor unit 2*d* includes an indoor-side expansion device 70*d* and a load-side heat exchanger 26*d*. Each of the load-side heat exchangers 26*a* to 26*d* is connected to the outdoor unit 1 via the branch pipes 112, the relay unit 3, and the main pipes 111.

Each of the load-side heat exchangers 26 is configured such that refrigerant flowing inside and indoor air exchange heat with each other. For this purpose, the air-conditioning apparatus 100 according to Embodiment 3 includes load-side air-sending devices (not illustrated) configured to supply the indoor air separately to each of the load-side heat exchangers 26. That is, the indoor air cooled by each of the load-side heat exchangers 26 serves as cooling air that is supplied to an air-conditioning target space. Further, the indoor air heated by the load-side heat exchanger 26 serves as heating air that is supplied to the air-conditioning target space.

Each of the indoor-side expansion devices 70*a* has an opening degree that can be regulated, for example, either a continuous or multistep manner. Usable examples of each of the indoor-side expansion devices 70*a* include an electronic expansion valve. Each of the indoor-side expansion devices 70*a* functions as a pressure reducing valve and an expansion valve. In other words, each of the indoor-side expansion devices 70*a* decompresses and expands the refrigerant. Each of the indoor-side expansion devices 70 is placed in the refrigerant circuit 101 and downstream of a corresponding one of the load-side heat exchangers 26 when the corresponding load-side heat exchanger 26 functions as a condenser. That is, during heating operation, each of the indoor-side expansion devices 70*a* decompresses the refrigerant flowing out from a corresponding one of the load-side heat exchangers 26. Further, during cooling operation, each of the indoor-side expansion devices 70*a* decompresses the refrigerant flowing into a corresponding one of the load-side heat exchangers 26. That is, each of the indoor-side expansion devices 70*a* is placed in the refrigerant circuit 101 and upstream of a corresponding one of the load-side heat exchangers 26 when the corresponding load-side heat exchanger 26 functions as an evaporator.

Further, each indoor unit 2 is installed with a load-side first temperature sensor 31 and a load-side second temperature sensor 32. That is, the indoor unit 2*a* is installed with a load-side first temperature sensor 31*a* and a load-side second temperature sensor 32*a*. The indoor unit 2*b* is installed with a load-side first temperature sensor 31*b* and a load-side second temperature sensor 32*b*. The indoor unit 2*c* is installed with a load-side first temperature sensor 31*c* and a load-side second temperature sensor 32*c*. The indoor unit 2*d* is installed with a load-side first temperature sensor 31*d* and a load-side second temperature sensor 32*d*. Each load-side first temperature sensor 31 and each load-side second temperature sensor 32 are, for example, thermistors or other devices. While a corresponding one of the indoor units 2 is performing cooling operation, each load-side first temperature sensor 31 detects the temperature of the refrigerant flowing into a corresponding one of the load-side heat exchangers 26. Further, while a corresponding one of the indoor units 2 is performing heating operation, each load-side first temperature sensor 31 detects the temperature of the refrigerant flowing out from a corresponding one of the load-side heat exchangers 26. While a corresponding one of the indoor units 2 is performing cooling operation, each load-side second temperature sensor 32 detects the temperature of the refrigerant flowing out from a corresponding one of the load-side heat exchangers 26. Further, while a corresponding one of the indoor units 2 is performing heating operation, each load-side second temperature sensor 32 detects the temperature of the refrigerant flowing into a corresponding one of the load-side heat exchangers 26. Further, each load-side first temperature sensor 31 and each load-side second temperature sensor 32 output the temperatures of the refrigerant thus detected to a controller 60 as detection signals.

It should be noted that FIG. 10 illustrates four indoor units 2*a* to 2*d*. However, the air-conditioning apparatus 100 may include two indoor units 2, three indoor units 2, or five or more indoor units 2.

[Configuration of Relay Unit 3]

The relay unit 3 includes a gas-liquid separator 29, a plurality of relay unit first opening and closing devices 23, a plurality of relay unit second opening and closing devices 24, a relay unit first expansion device 30, and a relay unit second expansion device 27 as components of the refrigerant circuit 101.

The gas-liquid separator 29 is provided at an inlet of the relay unit 3 in the flow of the refrigerant. The gas-liquid separator 29 separates the refrigerant flowing in from the outdoor unit 1 into liquid refrigerant and gas refrigerant. A gas refrigerant outflow pipe 113, which is part of the refrigerant pipe 110, is connected to an outlet of the gas-liquid separator 29 for the gas refrigerant. Further, one end of a liquid refrigerant outflow pipe 114, which is part of the refrigerant pipe 110, is connected to an outlet of the gas-liquid separator 29 for the liquid refrigerant. It should be noted that the other end of the liquid refrigerant outflow pipe 114 divides into branches that are connected to the respective indoor-side expansion devices 70. Specifically, in the after-mentioned cooling main operation mode, the gas-liquid separator 29 separates the high-pressure two-phase gas-liquid refrigerant generated in the outdoor unit 1 into liquid refrigerant and gas refrigerant. The gas-liquid separator 29 allows the liquid refrigerant thus separated to flow into the liquid refrigerant outflow pipe 114 and thereby supplies cooling energy to one or more of the indoor units 2. Further, the gas-liquid separator 29 allows the gas refrigerant thus separated to flow into the gas refrigerant outflow pipe 113 and thereby supplies heating energy to another one or more of the indoor units 2.

One end of each of the relay unit first opening and closing devices 23 is connected to the gas refrigerant outflow pipe 113. Further, the relay unit first opening and closing devices 23 are provided for the respective indoor units 2, and the other end of each of the relay unit first opening and closing devices 23 is connected to the load-side heat exchanger 26 of a corresponding one of the indoor units 2. That is, the relay unit first opening and closing device 23*a* is connected to the load-side heat exchanger 26*a* of the indoor unit 2*a*. The relay unit first opening and closing device 23*b* is connected to the load-side heat exchanger 26*b* of the indoor unit 2*b*. The relay unit first opening and closing device 23*c* is connected to the load-side heat exchanger 26*c* of the indoor unit 2*c*. The relay unit first opening and closing device 23*d* is connected to the load-side heat exchanger 26*d* of the indoor unit 2*d*. Each relay unit first opening and closing device 23 is configured to open and close a flow passage of high-temperature and high-pressure gas refrigerant that is supplied to a corresponding one of the indoor units 2. The relay unit first opening and closing devices 23 are, for example, solenoid valves or other devices. The relay unit first opening and closing devices 23 need only be able to perform the opening and closing of flow passages and may be expansion devices each having a full close function.

One of each of the relay unit second opening and closing devices 24 is connected to a relay unit outflow pipe 115. The relay unit outflow pipe 115 is a pipe that is part of the refrigerant pipe 110 and through which the refrigerant flowing out from the relay unit 3 passes. Further, the relay unit second opening and closing devices 24 are provided for the respective indoor units 2, and the other end of each of the relay unit second opening and closing devices 24 is connected to the load-side heat exchanger 26 of a corresponding one of the indoor units 2. That is, the relay unit second opening and closing device 24*a* is connected to the load-side heat exchanger 26*a* of the indoor unit 2*a*. The relay unit second opening and closing device 24*b* is connected to the load-side heat exchanger 26*b* of the indoor unit 2*b*. The relay unit second opening and closing device 24*c* is connected to the load-side heat exchanger 26*c* of the indoor unit 2*c*. The relay unit second opening and closing device 24*d* is connected to the load-side heat exchanger 26*d* of the indoor unit 2*d*. Each relay unit second opening and closing device 24 is configured to open and close a flow passage of low-temperature and low-pressure refrigerant flowing out from a corresponding one of the indoor units 2. The relay unit second opening and closing devices 24 are, for example, solenoid valves or other devices. The relay unit second opening and closing devices 24 need only be able to perform the opening and closing of flow passages and may be expansion devices each having a full close function.

That is, the air-conditioning apparatus 100 according to Embodiment 3 can be said to include a plurality of sets that each have an indoor unit 2, a relay unit first opening and closing device 23, and a relay unit second opening and closing device 24.

The relay unit first expansion device 30 is provided in the liquid refrigerant outflow pipe 114 and configured to decompress the refrigerant flowing through a place at which the relay unit first expansion device 30 is installed. Specifically, the relay unit first expansion device 30 functions as a pressure reducing valve and an on-off valve. The relay unit first expansion device 30 is configured to decompress the liquid refrigerant such that it has a predetermined pressure and open and close a flow passage of the liquid refrigerant. The relay unit first expansion device 30 has an opening degree that can be regulated, for example, either a continuous or multistep manner. Usable examples of the relay unit first expansion device 30 include an electronic expansion valve.

The relay unit second expansion device 27 is provided in the relay unit bypass pipe 116 and configured to decompress the refrigerant flowing through a place at which the relay unit second expansion device 27 is installed. The relay unit bypass pipe 116 is a pipe that is part of the refrigerant pipe 110. One end of the relay unit bypass pipe 116 is connected to a point in the liquid refrigerant outflow pipe 114 located between the relay unit first expansion device 30 and the indoor-side expansion devices 70. Further, the other end of the relay unit bypass pipe 116 is connected to the relay unit outflow pipe 115. Specifically, the relay unit second expansion device 27 functions as a pressure reducing valve and an on-off valve. The relay unit second expansion device 27 is configured to open and close a refrigerant flow passage in the heating only operation mode. Further, the relay unit second expansion device 27 is configured to, in the after-mentioned heating main operation mode, regulate, according to an indoor-side load, the flow rate of refrigerant that flows through the relay unit bypass pipe 116. The relay unit second expansion device 27 has an opening degree that can be regulated, for example, either a continuous or multistep manner. Usable examples of the relay unit second expansion device 27 include an electronic expansion valve.

Further, the relay unit 3 is installed with an inlet-side pressure sensor 33 and an outlet-side pressure sensor 34. The inlet-side pressure sensor 33 is provided in a position in the liquid refrigerant outflow pipe 114 beside an inlet of the relay unit first expansion device 30. The inlet-side pressure sensor 33 is configured to detect the pressure of high-pressure refrigerant. The outlet-side pressure sensor 34 is provided in a position in the liquid refrigerant outflow pipe 114 beside an outlet of the relay unit first expansion device 30. The outlet-side pressure sensor 34 is configured to detect the intermediate pressure of liquid refrigerant at a position beside the outlet of the relay unit first expansion device 30 in the after-mentioned cooling main operation mode.

The controller 60 of the air-conditioning apparatus 100 according to Embodiment 3 executes each operation mode described below. As in the case of Embodiment 1, the controller 60 according to Embodiment 3 controls the compressor 10, the heat-source-side air-sending device 18, the load-side air-sending device (not illustrated), the refrigerant flow switching device 13, the first opening and closing device 11, or other devices, for example, in accordance with input information from each sensor that the air-conditioning apparatus 100 includes and instructions from a remote controller (not illustrated).

Further, the controller 60 according to Embodiment 3 controls the indoor-side expansion devices 70, the relay unit first opening and closing devices 23, the relay unit second opening and closing devices 24, the relay unit first expansion device 30, the relay unit second expansion device 27, or other devices, for example, in accordance with input information from each sensor that the air-conditioning apparatus 100 includes and instructions from the remote controller (not illustrated). Specifically, the control unit 63 of the controller 60 controls the opening and closing of the indoor-side expansion devices 70. Further, the control unit 63 controls the opening degrees of the indoor-side expansion devices 70 each in an open state. Further, the control unit 63 controls the opening and closing of the relay unit first opening and closing devices 23 and the relay unit second opening and closing devices 24. Further, the control unit 63 of the controller 60 controls the opening and closing of the relay unit first expansion device 30. Further, the control unit 63 control the opening degree of the relay unit first expansion device 30 in an open state. Further, the control unit 63 of the controller 60 controls the opening and closing of the relay unit second expansion device 27. Further, the control unit 63 control the opening degree of the relay unit second expansion device 27 in an open state.

Further, although, in FIG. 10, the controller 60 is mounted in the outdoor unit 1, this is merely an example. The controller 60 may be mounted in an indoor unit 2. The controller 60 may be mounted in the relay unit 3. Further, the controller 60 may be divided into portions mounted in at least two of the outdoor unit 1, the indoor unit 2, and the relay unit 3.

Each operation mode that is executed in the air-conditioning apparatus 100 is described. The controller 60 of the air-conditioning apparatus 100 is capable of performing cooling operation or heating operation independently in each of the indoor units 2*a* to 2*d* in accordance with instructions from the indoor units 2*a* to 2*d*. That is, the air-conditioning apparatus 100 is configured to perform the same operation in all indoor units 2*a* to 2*d*. Specifically, the air-conditioning apparatus 100 is configured to perform cooling operation in all indoor units 2*a* to 2*d*. The air-conditioning apparatus 100 is configured to perform heating operation in all indoor units 2*a* to 2*d*. Further, the air-conditioning apparatus 100 is configured to perform different types of operation separately in each of the indoor units 2*a* to 2*d*.

Operation modes that are executed in the air-conditioning apparatus 100 are broadly divided into cooling operation modes and heating operation modes. The cooling operation modes include the cooling only operation mode and the cooling main operation mode.

The cooling only operation mode is an operation mode in which all of the indoor units 2*a* to 2*d* in operation perform cooling operation. That is, in the cooling only operation mode, all of the load-side heat exchangers 26*a* to 26*d* in operation function as evaporators. The cooling main operation mode is a cooling and heating mixed operation mode in which one or more of the indoor units 2*a* to 2*d* perform cooling operation and another one or more of the indoor units 2*a* to 2*d* perform heating operation, and is an operation mode in which a cooling load is higher than a heating load. That is, in the cooling main operation mode, one or more of the load-side heat exchangers 26*a* to 26*d* function as evaporators, and another one or more of the load-side heat exchangers 26*a* to 26*d* function as condensers.

The heating operation modes include the heating only operation mode and the heating main operation mode. The heating only operation mode is an operation mode in which all of the indoor units 2*a* to 2*d* in operation perform heating operation. That is, in the heating only operation mode, all of the load-side heat exchangers 26*a* to 26*d* in operation function as condensers. The heating main operation mode is a cooling and heating mixed operation mode in which one or more of the indoor units 2*a* to 2*d* perform cooling operation and another one or more of the indoor units 2*a* to 2*d* perform heating operation, and is an operation mode in which a heating load is higher than a cooling load. The following describes each operation mode.

[Cooling Only Operation Mode]

The cooling only operation mode that the air-conditioning apparatus 100 executes is described with reference to FIG. 10. FIG. 10 illustrates the cooling only operation mode by taking as an example a case in which cooling loads are generated only in the load-side heat exchanger 26*a* and the load-side heat exchanger 26*b*. That is, FIG. 10 illustrates the cooling only operation mode by taking as an example a case in which only the indoor unit 2*a* and the indoor unit 2*b* perform cooling operation. In FIG. 10, the direction of flow of the refrigerant is indicated by solid arrows.

In the case of the cooling only operation mode, the controller 60 switches the refrigerant flow switching device 13 of the outdoor unit 1 such that refrigerant discharged from the compressor 10 flows into the heat-source-side heat exchanger 12.

First, the compressor 10 compresses low-temperature and low-pressure refrigerant into high-temperature and high-pressure gas refrigerant and discharges the high-temperature and high-pressure gas refrigerant through the discharge outlet. The high-temperature and high-pressure gas refrigerant discharged from the compressor 10 passes through the refrigerant flow switching device 13, flows into the heat-source-side heat exchanger 12, and then turns into high-pressure liquid refrigerant while rejecting heat to the outdoor air at the heat-source-side heat exchanger 12. The high-pressure liquid refrigerant flowing out from the heat-source-side heat exchanger 12 passes through the backflow prevention device 14*a*, flows out from the outdoor unit 1, passes through a main pipe 111, and flows into the relay unit 3.

The high-pressure liquid refrigerant flowing into the relay unit 3 passes through the gas-liquid separator 29, the liquid refrigerant outflow pipe 114, the relay unit first expansion device 30, and branch pipes 112*b* and is expanded by the indoor-side expansion device 70*a* and the indoor-side expansion device 70*b* into low-temperature and low-pressure two-phase gas-liquid refrigerant.

The refrigerant expanded by the indoor-side expansion device 70*a* and the indoor-side expansion device 70*b* into a two-phase gas-liquid state flows separately into the load-side heat exchanger 26*a* and the load-side heat exchanger 26*b*, which function as evaporators. The two-phase gas-liquid refrigerant flowing into the load-side heat exchanger 26*a* and the load-side heat exchanger 26*b* turns into low-temperature and low-pressure gas refrigerant while cooling the indoor air by removing heat from the indoor air. In this case, the opening degree of the indoor-side expansion device 70*a* is controlled such that the degree of superheat obtained as the difference between a temperature detected by the load-side first temperature sensor 31*a* and a temperature detected by the load-side second temperature sensor 32*a* becomes constant. Similarly, the opening degree of the indoor-side expansion device 70*b* is controlled such that the degree of superheat obtained as the difference between a temperature detected by the load-side first temperature sensor 31*b* and a temperature detected by the load-side second temperature sensor 32*b* becomes constant.

The gas refrigerant flowing out from the load-side heat exchanger 26*a* and the gas refrigerant flowing out from the load-side heat exchanger 26*b* passes through branch pipes 112*a* and flows into the relay unit second opening and closing device 24*a* and the relay unit second opening and closing device 24*b*. Then, the gas refrigerant flowing out from the relay unit second opening and closing device 24*a* and the relay unit second opening and closing device 24*b*, passes through the relay unit outflow pipe 115, flows out from the relay unit 3, passes through a main pipe 111, and again flows into the outdoor unit 1. The refrigerant flowing into the outdoor unit 1 passes through the backflow prevention device 14*d*, passes through the refrigerant flow switching device 13 and the accumulator 19, and is again sucked into the compressor 10.

Since it is not necessary to cause refrigerant to flow through the load-side heat exchanger 26*c* and the load-side heat exchanger 26*d*, in which no thermal loads are generated, the indoor-side expansion device 70*c* and the indoor-side expansion device 70*d*, which correspond to the load-side heat exchanger 26*c* and the load-side heat exchanger 26*d*, respectively, are each in a closed state. In a case in which a cooling load is generated in the load-side heat exchanger 26*c* or the load-side heat exchanger 26*d*, the indoor-side expansion device 70*c* or the indoor-side expansion device 70*d* is opened, so that the refrigerant circulates. In this case, the opening degree of the indoor-side expansion device 70*c* or the indoor-side expansion device 70*d* is controlled such that the degree of superheat obtained as the difference between a temperature detected by the load-side first temperature sensor 31 and a temperature detected by the load-side second temperature sensor 32 becomes constant, as in the described case of the indoor-side expansion device 70*a* or the indoor-side expansion device 70*b*.

[Cooling Main Operation Mode]

Figure 11:
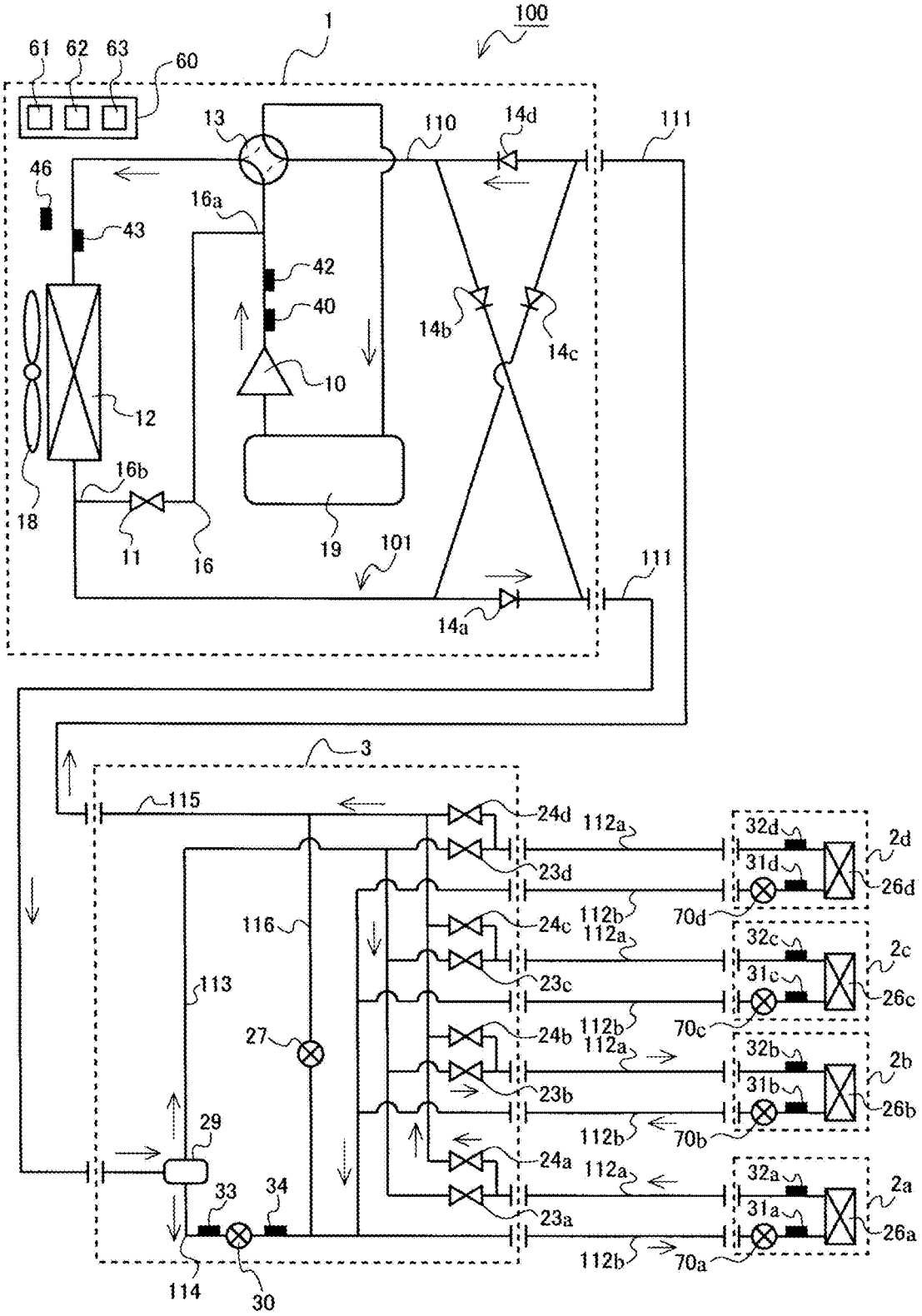
FIG. 11 is a schematic view showing the circuit configuration of the air-conditioning apparatus according to Embodiment 3 and a diagram showing a state in which the air-conditioning apparatus is operating in a cooling main operation mode.

FIG. 11 is a schematic view showing the circuit configuration of the air-conditioning apparatus according to Embodiment 3 and a diagram showing a state in which the air-conditioning apparatus is operating in a cooling main operation mode. In FIG. 11, the direction of flow of the refrigerant is indicated by solid arrows. A case is described here in which a cooling load is generated only in the load-side heat exchanger 26*a* and a heating load is generated only in the load-side heat exchanger 26*b*. That is, a case is described in which only the indoor unit 2*a* performs cooling operation and only the indoor unit 2*b* performs heating operation.

In the case of the cooling main operation mode, the controller 60 switches the refrigerant flow switching device 13 such that refrigerant discharged from the compressor 10 flows into the heat-source-side heat exchanger 12.

The compressor 10 compresses low-temperature and low-pressure refrigerant into high-temperature and high-pressure gas refrigerant and discharges the high-temperature and high-pressure gas refrigerant through the discharge outlet. The high-temperature and high-pressure gas refrigerant discharged from the compressor 10 passes through the refrigerant flow switching device 13, flows into the heat-source-side heat exchanger 12, and then turns into two-phase gas-liquid refrigerant while rejecting heat to the outdoor air at the heat-source-side heat exchanger 12. The refrigerant flowing out from the heat-source-side heat exchanger 12 passes through the backflow prevention device 14*a* and a main pipe 111 and flows into the relay unit 3.

The two-phase gas-liquid refrigerant flowing into the relay unit 3 is separated by the gas-liquid separator 29 into high-pressure gas refrigerant and high-pressure liquid refrigerant. The high-pressure gas refrigerant passes through the gas refrigerant outflow pipe 113, the relay unit first opening and closing device 23*b*, and a branch pipe 112*a* and then flows into the load-side heat exchanger 26*b*, which functions as a condenser. The high-pressure gas refrigerant turns into liquid refrigerant while heating the indoor air by rejecting heat to the indoor air. In this case, the opening degree of the indoor-side expansion device 70*b* is controlled such that the degree of subcooling obtained as the difference between a value obtained by converting a pressure detected by the inlet-side pressure sensor 33 into a saturation temperature and a temperature detected by the load-side first temperature sensor 31*b* becomes constant. The liquid refrigerant flowing out from the load-side heat exchanger 26*b* is expanded by the indoor-side expansion device 70*b* and flows through a branch pipe 112*b*.

Subsequently, intermediate-pressure liquid refrigerant separated by the gas-liquid separator 29 ad then expanded by the relay unit first expansion device 30 into intermediate pressure and liquid refrigerant passing through the indoor-side expansion device 70*b* merge in the liquid refrigerant outflow pipe 114. In this case, the opening degree of the relay unit first expansion device 30 is controlled such that a pressure difference between a pressure detected by the inlet-side pressure sensor 33 and a pressure detected by the outlet-side pressure sensor 34 becomes equal to a specified pressure difference. The specified pressure difference is for example 0.3 MPa.

The refrigerant having merged passes through a branch pipe 112*b* and flows into the indoor unit 2*a*. The refrigerant expanded by the indoor-side expansion device 70*a* of the indoor unit 2*a* into a two-phase gas-liquid state flows into the load-side heat exchanger 26*a*, which functions as an evaporator, and turns into low-temperature and low-pressure gas refrigerant while cooling the indoor air by removing heat from the indoor air. In this case, the opening degree of the indoor-side expansion device 70*a* is controlled such that the degree of superheat obtained as the difference between a temperature detected by the load-side first temperature sensor 31*a* and a temperature detected by the load-side second temperature sensor 32*a* becomes constant. The gas refrigerant flowing out from the load-side heat exchanger 26*a* passes through a branch pipe 112*a*, the relay unit second opening and closing device 24*a*, and the relay unit outflow pipe 115 and flows out from the relay unit 3.

The gas refrigerant flowing out from the relay unit 3 passes through a main pipe 111 and again flows into the outdoor unit 1. The refrigerant flowing into the outdoor unit 1 passes through the backflow prevention device 14*d*, passes through the refrigerant flow switching device 13 and the accumulator 19, and is again sucked into the compressor 10.

Since it is not necessary to cause refrigerant to flow through the load-side heat exchanger 26*c* and the load-side heat exchanger 26*d*, in which no thermal loads are generated, the indoor-side expansion device 70*c* and the indoor-side expansion device 70*d*, which correspond to the load-side heat exchanger 26*c* and the load-side heat exchanger 26*d*, respectively, are each in a closed state. In a case in which a cooling load is generated in the load-side heat exchanger 26*c* or the load-side heat exchanger 26*d*, the indoor-side expansion device 70*c* or the indoor-side expansion device 70*d* is opened, so that the refrigerant circulates. In this case, the opening degree of the indoor-side expansion device 70*c* or the indoor-side expansion device 70*d* is controlled such that the degree of superheat obtained as the difference between a temperature detected by the load-side first temperature sensor 31 and a temperature detected by the load-side second temperature sensor 32 becomes constant, as in the described case of the indoor-side expansion device 70*a*. Further, in a case in which a heating load is generated in the load-side heat exchanger 26*c* or the load-side heat exchanger 26*d*, the opening degree of the indoor-side expansion device 70*c* or the indoor-side expansion device 70*d* is controlled such that the degree of subcooling obtained as the difference between a value obtained by converting a pressure detected by the inlet-side pressure sensor 33 into a saturation temperature and a temperature detected by the load-side first temperature sensor 31 becomes constant, as in the described case of the indoor-side expansion device 70*b*.

[Heating Only Operation Mode]

Figure 12:
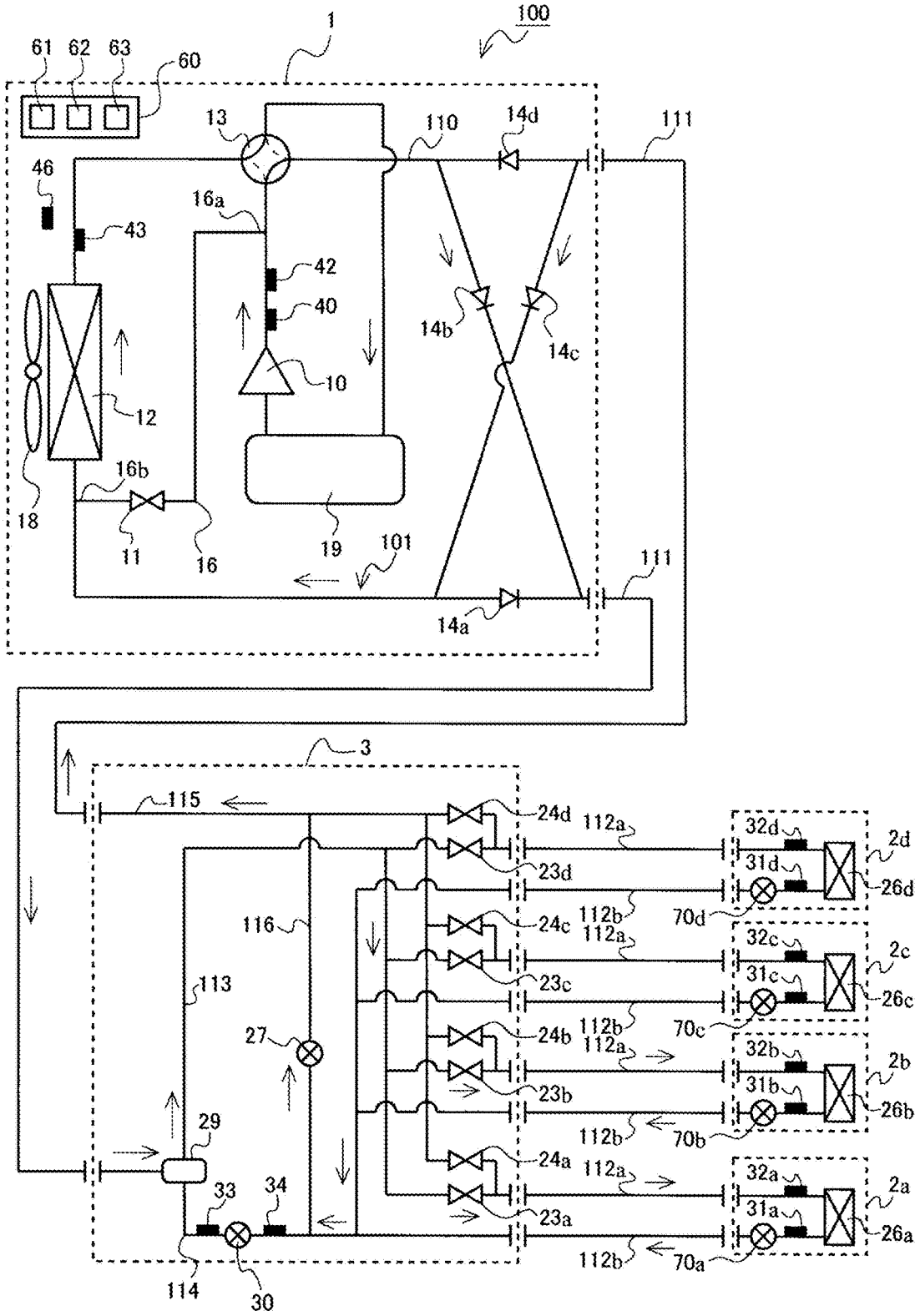
FIG. 12 is a schematic view showing the circuit configuration of the air-conditioning apparatus according to Embodiment 3 and a diagram showing a state in which the air-conditioning apparatus is operating in the heating only operation mode.

FIG. 12 is a schematic view showing the circuit configuration of the air-conditioning apparatus according to Embodiment 3 and a diagram showing a state in which the air-conditioning apparatus is operating in the heating only operation mode. In FIG. 12, the direction of flow of the refrigerant is indicated by solid arrows. A case is described here in which heating loads are generated only in the load-side heat exchanger 26*a* and the load-side heat exchanger 26*b*. That is, a case is described in which only the indoor unit 2*a* and the indoor unit 2*b* perform heating operation.

In the case of the heating only operation mode, the controller 60 switches the refrigerant flow switching device 13 such that refrigerant discharged from the compressor 10 flows into the relay unit 3 without passing through the heat-source-side heat exchanger 12.

First, the compressor 10 compresses low-temperature and low-pressure refrigerant into high-temperature and high-pressure gas refrigerant and discharges the high-temperature and high-pressure gas refrigerant through the discharge outlet. The high-temperature and high-pressure gas refrigerant discharged from the compressor 10 passes through the refrigerant flow switching device 13 and the backflow prevention device 14*b* and flows out from the outdoor unit 1. The high-temperature and high-pressure gas refrigerant flowing out from the outdoor unit 1 passes through a main pipe 111 and flows into the relay unit 3.

The high-temperature and high-pressure gas refrigerant flowing into the relay unit 3 passes through the gas-liquid separator 29 and the gas refrigerant outflow pipe 113 and flows into the relay unit first opening and closing device 23*a* and the relay unit first opening and closing device 23*b*. The high-temperature and high-pressure gas refrigerant flowing into each of the relay unit first opening and closing device 23*a* and the relay unit first opening and closing device 23*b* passes through branch pipes 112*a* and then flows into a corresponding one of the load-side heat exchanger 26*a* and the load-side heat exchanger 26*b*, which function as condensers. The refrigerant flowing into the load-side heat exchanger 26*a* and the load-side heat exchanger 26*b* turns into liquid refrigerant while heating the indoor air by rejecting heat to the indoor air. The liquid refrigerant flowing out from the load-side heat exchanger 26*a* and the load-side heat exchanger 26*b* is expanded by the indoor-side expansion device 70*a* and the indoor-side expansion device 70*b*, passes through branch pipes 112*b*, the relay unit bypass pipe 116, and the relay unit second expansion device 27, which is in an open state, and again flows into the outdoor unit 1. In this case, the opening degree of the indoor-side expansion device 70*a* is controlled such that the degree of subcooling obtained as the difference between a value obtained by converting a pressure detected by the inlet-side pressure sensor 33 into a saturation temperature and a temperature detected by the load-side first temperature sensor 31*a* becomes constant. Similarly, the opening degree of the indoor-side expansion device 70*b* is controlled such that the degree of subcooling obtained as the difference between a value obtained by converting a pressure detected by the inlet-side pressure sensor 33 into a saturation temperature and a temperature detected by the load-side first temperature sensor 31*b* becomes constant.

The refrigerant flowing into the outdoor unit 1 passes through the backflow prevention device 14*c*, turns into low-temperature and low-pressure gas refrigerant while removing heat from the outdoor air at the heat-source-side heat exchanger 12, passes through the refrigerant flow switching device 13 and the accumulator 19, and is again sucked into the compressor 10.

Since it is not necessary to cause refrigerant to flow through the load-side heat exchanger 26*c* and the load-side heat exchanger 26*d*, in which no thermal loads are generated, the indoor-side expansion device 70*c* and the indoor-side expansion device 70*d*, which correspond to the load-side heat exchanger 26*c* and the load-side heat exchanger 26*d*, respectively, are each in a closed state. In a case in which a heating load is generated in the load-side heat exchanger 26*c* or the load-side heat exchanger 26*d*, the indoor-side expansion device 70*c* or the indoor-side expansion device 70*d* is opened, so that the refrigerant circulates. In this case, the opening degree of the indoor-side expansion device 70*c* or the indoor-side expansion device 70*d* is controlled such that the degree of subcooling obtained as the difference between a value obtained by converting a pressure detected by the inlet-side pressure sensor 33 into a saturation temperature and a temperature detected by the load-side first temperature sensor 31 becomes constant, as in the described case of the indoor-side expansion device 70*a* or the indoor-side expansion device 70*b*.

[Heating Main Operation Mode]

Figure 13:
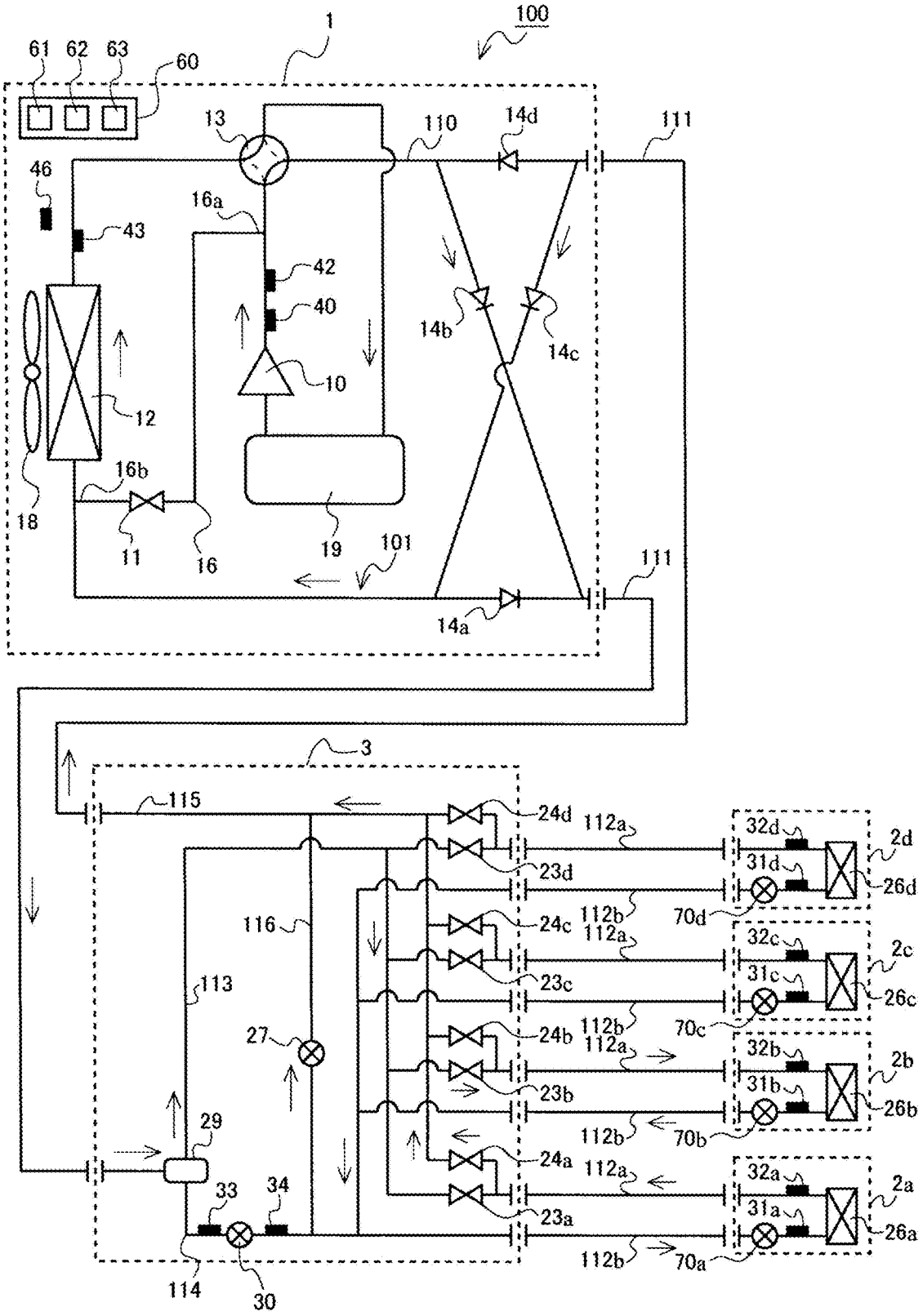
FIG. 13 is a schematic view showing the circuit configuration of the air-conditioning apparatus according to Embodiment 3 and a diagram showing a state in which the air-conditioning apparatus is operating in a heating main operation mode.

FIG. 13 is a schematic view showing the circuit configuration of the air-conditioning apparatus according to Embodiment 3 and a diagram showing a state in which the air-conditioning apparatus is operating in a heating main operation mode. In FIG. 13, the direction of flow of the refrigerant is indicated by solid arrows. A case is described here in which a cooling load is generated only in the load-side heat exchanger 26*a* and a heating load is generated only in the load-side heat exchanger 26*b*. That is, a case is described in which only the indoor unit 2*a* performs cooling operation and only the indoor unit 2*b* performs heating operation.

In the case of the heating main operation mode, the controller 60 switches the refrigerant flow switching device 13 such that refrigerant discharged from the compressor 10 flows into the relay unit 3 without passing through the heat-source-side heat exchanger 12.

The compressor 10 compresses low-temperature and low-pressure refrigerant into high-temperature and high-pressure gas refrigerant and discharges the high-temperature and high-pressure gas refrigerant through the discharge outlet. The high-temperature and high-pressure gas refrigerant discharged from the compressor 10 passes through the refrigerant flow switching device 13 and the backflow prevention device 14*b* and flows out from the outdoor unit 1. The high-temperature and high-pressure gas refrigerant flowing out from the outdoor unit 1 passes through a main pipe 111 and flows into the relay unit 3.

The high-temperature and high-pressure gas refrigerant flowing into the relay unit 3 passes through the gas-liquid separator 29, the gas refrigerant outflow pipe 113, the relay unit first opening and closing device 23*b*, and a branch pipe 112*a* and then flows into the load-side heat exchanger 26*b*, which functions as a condenser. The refrigerant flowing into the load-side heat exchanger 26*b* turns into liquid refrigerant while heating the indoor air by rejecting heat to the indoor air. The liquid refrigerant flowing out from the load-side heat exchanger 26*b* is expanded by the indoor-side expansion device 70*b*, passes through a branch pipe 112*b*, and flows into the relay unit 3. Subsequently, a large portion of the refrigerant flowing into the relay unit 3 passes through a branch pipe 112*b* and is then expanded by the indoor-side expansion device 70*a* into low-temperature and low-pressure two-phase gas-liquid refrigerant. A remaining portion of the refrigerant flowing into the relay unit 3 passes through the relay unit bypass pipe 116 and is expanded by the relay unit second expansion device 27 into liquid or two-phase gas-liquid refrigerant that then flows into the relay unit outflow pipe 115.

The refrigerant expanded by the indoor-side expansion device 70*a* into a two-phase gas-liquid state flows into the load-side heat exchanger 26*a*, which functions as an evaporator, and turns into gas refrigerant while cooling the indoor air by removing heat from the indoor air. The gas refrigerant flowing out from the load-side heat exchanger 26*a* passes through a branch pipe 112*a* and the relay unit second opening and closing device 24*a* and merges in the relay unit outflow pipe 115 with the remaining portion of the refrigerant flowing out from the relay unit second expansion device 27. The refrigerant having merged flows out from the relay unit 3, passes through a main pipe 111, and again flows into the outdoor unit 1. The refrigerant flowing into the outdoor unit 1 passes through the backflow prevention device 14*c* and turns into low-temperature and low-pressure gas refrigerant while removing heat from the outside air at the heat-source-side heat exchanger 12. The gas refrigerant passes through the refrigerant flow switching device 13 and the accumulator 19 and is again sucked into the compressor 10.

In this case, the opening degree of the indoor-side expansion device 70*b* is controlled such that the degree of subcooling obtained as the difference between a value obtained by converting a pressure detected by the inlet-side pressure sensor 33 into a saturation temperature and a temperature detected by the load-side first temperature sensor 31*b* becomes constant. Meanwhile, the opening degree of the indoor-side expansion device 70*a* is controlled such that the degree of superheat obtained as the difference between a temperature detected by the load-side first temperature sensor 31*a* and a temperature detected by the load-side second temperature sensor 32*b* becomes constant.

Further, the opening degree of the relay unit second expansion device 27 is controlled such that a pressure difference between a pressure detected by the inlet-side pressure sensor 33 and a pressure detected by the outlet-side pressure sensor 34 becomes equal to a specified pressure difference. The specified pressure difference is for example 0.3 MPa.

Since it is not necessary to cause refrigerant to flow through the load-side heat exchanger 26*c* and the load-side heat exchanger 26*d*, in which no thermal loads are generated, the indoor-side expansion device 70*c* and the indoor-side expansion device 70*d*, which correspond to the load-side heat exchanger 26*c* and the load-side heat exchanger 26*d*, respectively, are each in a closed state. In a case in which a cooling load is generated in the load-side heat exchanger 26*c* or the load-side heat exchanger 26*d*, the indoor-side expansion device 70*c* or the indoor-side expansion device 70*d* is opened, so that the refrigerant circulates. In this case, the opening degree of the indoor-side expansion device 70*c* or the indoor-side expansion device 70*d* is controlled such that the degree of superheat obtained as the difference between a temperature detected by the load-side first temperature sensor 31 and a temperature detected by the load-side second temperature sensor 32 becomes constant, as in the described case of the indoor-side expansion device 70*a*. Further, in a case in which a heating load is generated in the load-side heat exchanger 26*c* or the load-side heat exchanger 26*d*, the opening degree of the indoor-side expansion device 70*c* or the indoor-side expansion device 70*d* is controlled such that the degree of subcooling obtained as the difference between a value obtained by converting a pressure detected by the inlet-side pressure sensor 33 into a saturation temperature and a temperature detected by the load-side first temperature sensor 31 becomes constant, as in the described case of the indoor-side expansion device 70*b*.

[Defrosting Operation Mode]

Figure 14:
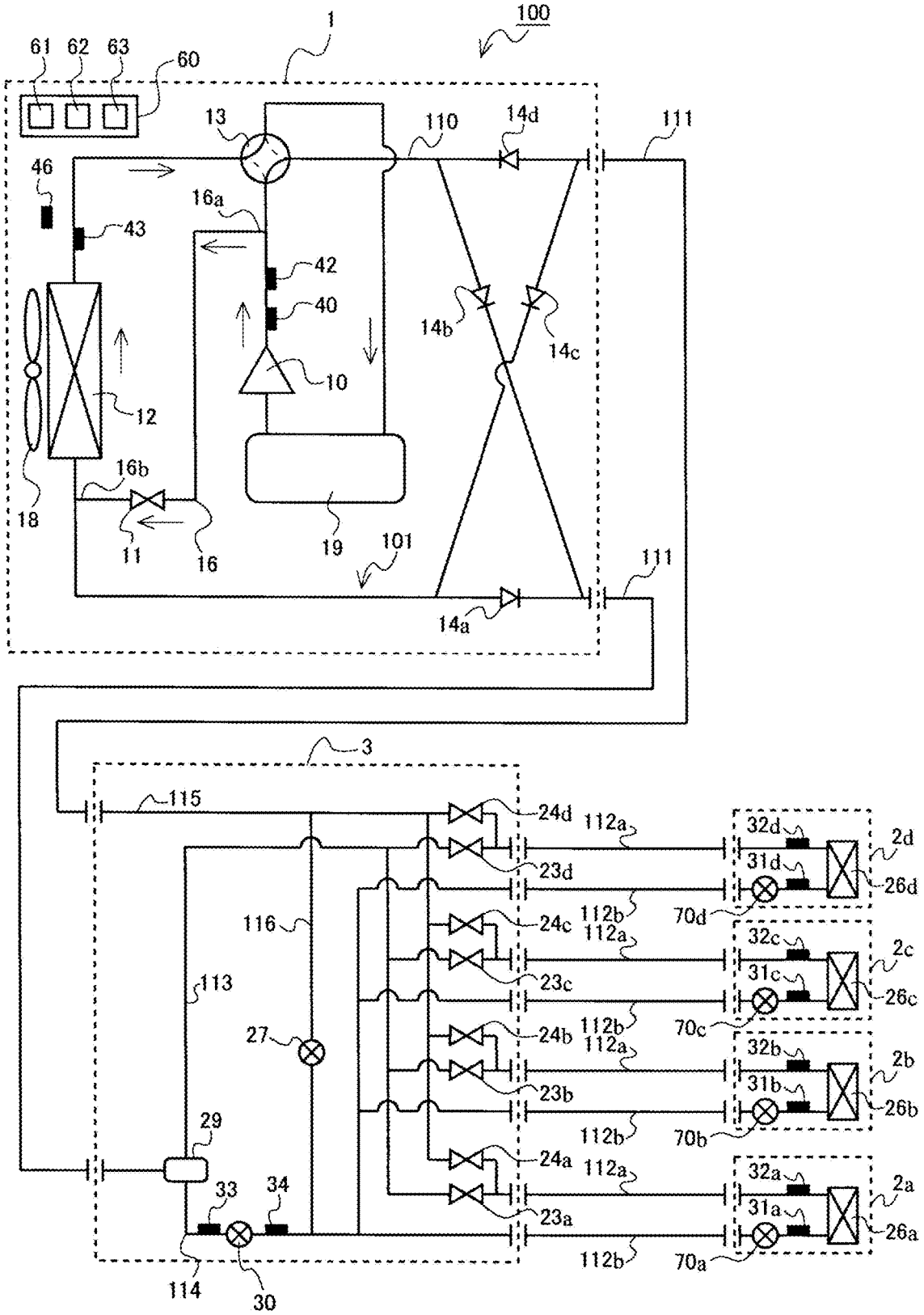
FIG. 14 is a schematic view showing the circuit configuration of the air-conditioning apparatus according to Embodiment 3 and a diagram showing a state in which the air-conditioning apparatus is operating in the defrosting operation mode.

FIG. 14 is a schematic view showing the circuit configuration of the air-conditioning apparatus according to Embodiment 3 and a diagram showing a state in which the air-conditioning apparatus is operating in the defrosting operation mode. In FIG. 14, the direction of flow of the refrigerant is indicated by solid arrows.

In a case in which conditions for executing the defrosting operation mode in the heating only operation mode or the heating main operation mode are met, the controller 60 starts the defrosting operation mode. In the defrosting operation mode, a flow passage of the refrigerant flow switching device 13 is kept in the same state as the heating only operation mode indicated by solid lines in FIG. 12 and the heating main operation mode indicated by solid lines in FIG. 13. That is, in the defrosting operation mode, a flow passage of the refrigerant through the refrigerant flow switching device 13 is the same as a flow passage through which the refrigerant discharged from the compressor 10 flows into a load-side heat exchanger 26. The indoor-side expansion device 70, which functions as a load-side expansion device 25, is brought into a closed state when it is in an open state. The first opening and closing device 11 changes from a closed state to an open state to allow passage of the refrigerant through the bypass pipe 16. Further, the heat-source-side air-sending device 18 and the load-side air-sending device (not illustrated) are suspended in operation. In this case, the indoor-side expansion device 70 may be preferably brought into a closed state after the first opening and closing device 11 is brought into an open state. This makes it possible to prevent a clogging of refrigerant flow passages and prevent an excessive rise in pressure in the refrigerant circuit 101.

The high-temperature and high-pressure gas refrigerant discharged from the compressor 10 passes through the bypass pipe 16 and flows into the heat-source-side heat exchanger 12. The high-temperature gas refrigerant flowing into the heat-source-side heat exchanger 12 flows through the heat-source-side heat exchanger 12 while melting the frost forming on the heat-source-side heat exchanger 12.

Further, a flow passage of the high-temperature and high-pressure gas refrigerant discharged from the compressor 10 is connected via the backflow prevention device 14*b*, a main pipe 111, the gas-liquid separator 29, the gas refrigerant outflow pipe 113, the relay unit first opening and closing device 23, and a branch pipe 112*a* to the flow passage of a load-side heat exchanger 26 functioning as a condenser in the heating only operation mode or the heating main operation mode. Further, the pressure of the high-temperature and high-pressure gas refrigerant discharged from the compressor 10 is higher than the pressure of the refrigerant present in the load-side heat exchanger 26. For this reason, in the defrosting operation mode, the pressure of the high-temperature and high-pressure gas refrigerant discharged from the compressor 10 causes the refrigerant present between the gas-liquid separator 29 and the indoor-side expansion device 70 during the heating only operation mode or the heating main operation mode to be retained between the gas-liquid separator 29 and the indoor-side expansion device 70.

Note here that a large amount of refrigerant is present in the load-side heat exchanger 26 functioning as a condenser in the heating only operation mode or the heating main operation mode. This makes it possible to, by executing the defrosting operation mode, retain excess refrigerant in the load-side heat exchanger 26 functioning as a condenser in the heating only operation mode or the heating main operation mode, thus making it possible to reduce the amount of excess refrigerant that stays in the accumulator 19. Accordingly, during the defrosting operation mode, the air-conditioning apparatus 100 according to Embodiment 3 is configured to prevent the liquid refrigerant from overflowing from the accumulator 19 and being sucked into the compressor 10, similarly to the case with the air-conditioning apparatuses 100 according to Embodiments 1 and 2. That is, during the defrosting operation mode, the air-conditioning apparatus 100 is configured to reduce a liquid return to the compressor 10.

In particular, in a case in which the main pipes 111 are long because of limitations of environment in which the air-conditioning apparatus 100 is installed, there is an increase in the amount of excess refrigerant. For this reason, retaining excess refrigerant in the load-side heat exchanger 26 as in the case of Embodiment 1 makes it possible to better prevent, during the defrosting operation mode, the liquid refrigerant from overflowing from the accumulator 19 and being sucked into the compressor 10 than does some air-conditioning apparatus.

Further, in the air-conditioning apparatus 100 according to Embodiment 3, during the defrosting operation mode, the high-temperature refrigerant discharged from the compressor 10 can flow into the heat-source-side heat exchanger 12 by flowing only inside the outdoor unit 1, as in the case of the air-conditioning apparatuses 100 according to Embodiments 1 and 2. For this reason, during the defrosting operation mode, the air-conditioning apparatus 100 according to Embodiment 3 is configured to prevent the density of the refrigerant that flows into the heat-source-side heat exchanger 12 from decreasing because of a pressure loss, similarly to the case with the air-conditioning apparatuses 100 according to Embodiments 1 and 2. That is, similarly to the case with the air-conditioning apparatuses 100 according to Embodiments 1 and 2, the air-conditioning apparatus 100 according to Embodiment 3 makes it possible to increase the amount of refrigerant that circulates between the compressor 10 and the heat-source-side heat exchanger 12, making it also possible to reduce degradation in defrosting capacity.

Further, in the air-conditioning apparatus 100 according to Embodiment 3, the excess refrigerant retained in the load-side heat exchanger 26 can be evaporated in the heat-source-side heat exchanger 12 immediately after the switching from the defrosting operation mode to the heating only operation mode or the heating main operation mode, as in the case of the air-conditioning apparatuses 100 according to Embodiments 1 and 2. For this reason, the air-conditioning apparatus 100 according to Embodiment 3 allows more gas refrigerant to flow into the compressor 10 than in a case in which the excess refrigerant during the defrosting operation mode does not flow into the heat-source-side heat exchanger 12, making it possible to increase the amount of refrigerant that is discharged from the compressor 10, similarly to the case with the air-conditioning apparatuses 100 according to Embodiments 1 and 2. Accordingly, the air-conditioning apparatus 100 according to Embodiment 3 is configured to heat the air-conditioning target space sooner after the termination of the defrosting operation mode than in a case in which the excess refrigerant during the defrosting operation mode does not flow into the heat-source-side heat exchanger 12, thus making it possible to improve user's comfort, similarly to the case with the air-conditioning apparatuses 100 according to Embodiments 1 and 2.

It should be noted that a section of the refrigerant pipe 110 including a main pipe 111 from an outlet side of the relay unit 3 to the backflow prevention device 14*c* is lower in temperature than the refrigerant discharged from the compressor 10. For this reason, when the refrigerant discharged from the compressor 10 flows into the section of the refrigerant pipe 110, the high-temperature and high-pressure gas refrigerant discharged from the compressor 10 may condense and stay. In the defrosting operation mode, the following two flow passages are flow passages through which the refrigerant discharged from the compressor 10 flows into the section of the refrigerant pipe 110 including the main pipe 111 from the outlet side of the relay unit 3 to the backflow prevention device 14*c*.

The first flow passage is a flow passage through which the refrigerant discharged from the compressor 10 and flowing into the relay unit 3 passes through the gas-liquid separator 29, the gas refrigerant outflow pipe 113, the relay unit first opening and closing device 23, the relay unit second opening and closing device 24, and the relay unit outflow pipe 115 and flows into the section of the refrigerant pipe 110 including the main pipe 111 from the outlet side of the relay unit 3 to the backflow prevention device 14*c*. During the defrosting operation mode, keeping the relay unit second opening and closing device 24 in a closed state makes it possible to prevent the refrigerant discharged from the compressor 10 from flowing through the first flow passage into the section of the refrigerant pipe 110 including the main pipe 111 from the outlet side of the relay unit 3 to the backflow prevention device 14*c*. The second flow passage is a flow passage through which the refrigerant discharged from the compressor 10 and flowing into the relay unit 3 passes through the gas-liquid separator 29, the liquid refrigerant outflow pipe 114, the relay unit first expansion device 30, the relay unit bypass pipe 116, the relay unit second expansion device 27, and the relay unit outflow pipe 115 and flows into the section of the refrigerant pipe 110 including the main pipe 111 from the outlet side of the relay unit 3 to the backflow prevention device 14*c*. Bringing at least either the relay unit first expansion device 30 or the relay unit second expansion device 27 into a closed state makes it possible to prevent the refrigerant discharged from the compressor 10 from flowing through the second flow passage into the section of the refrigerant pipe 110 including the main pipe 111 from the outlet side of the relay unit 3 to the backflow prevention device 14*c*.

Accordingly, it is preferable that in executing the defrosting operation mode, the control unit 63 of the controller 60 bring the relay unit second opening and closing device 24 into a closed state and bring at least either the relay unit first expansion device 30 or the relay unit second expansion device 27 into a closed state. This makes it possible to prevent the high-temperature and high-pressure gas refrigerant discharged from the compressor 10 from condensing or staying in the section of the refrigerant pipe 110 including the main pipe 111 from the outlet side of the relay unit 3 to the backflow prevention device 14*c*. This results in allowing more of the high-temperature and high-pressure gas refrigerant discharged from the compressor 10 to flow into the heat-source-side heat exchanger 12, thus bringing about further improvement in the defrosting capacity of the air-conditioning apparatus 100.

In executing the defrosting operation mode, the control unit 63 of the controller 60 may bring all of the relay unit first expansion device 30, the relay unit second expansion device 27, the relay unit first opening and closing device 23, the relay unit second opening and closing device 24, and the indoor-side expansion device 70 each into a closed state. Such a configuration too makes it possible to prevent the high-temperature and high-pressure gas refrigerant discharged from the compressor 10 from condensing or staying in the section of the refrigerant pipe 110 including the main pipe 111 from the outlet side of the relay unit 3 to the backflow prevention device 14*c*. This results in allowing more of the high-temperature and high-pressure gas refrigerant discharged from the compressor 10 to flow into the heat-source-side heat exchanger 12, thus bringing about further improvement in the defrosting capacity of the air-conditioning apparatus 100.

Note here that in the heating only operation mode and the heating main operation mode, refrigerant flowing out from the load-side heat exchanger 26, which functions as a condenser, and flowing into the heat-source-side heat exchanger 12, which functions as an evaporator, flows through the relay unit second expansion device 27. For this reason, in the air-conditioning apparatus 100 according to Embodiment 3, the relay unit second expansion device 27, as well as the indoor-side expansion device 70, functions as a load-side expansion device 25. For this reason, the relay unit second expansion device 27 may be used as a load-side expansion device 25. Specifically, in executing the defrosting operation mode, the control unit 63 of the controller 60 may bring the relay unit second expansion device 27 instead of the indoor-side expansion device 70 into a closed state. Executing the defrosting operation mode in this way too makes it possible to bring about effects that are similar to those of the aforementioned defrosting operation mode during which the indoor-side expansion device 70 is in a closed state.

In a case in which the relay unit second expansion device 27 is used as a load-side expansion device 25 to execute the defrosting operation mode, the aforementioned first flow passage is a flow passage through which the refrigerant discharged from the compressor 10 flows into the section of the refrigerant pipe 110 including the main pipe 111 from the outlet side of the relay unit 3 to the backflow prevention device 14*c*. For this reason, in a case in which the relay unit second expansion device 27 is used as a load-side expansion device 25 to execute the defrosting operation mode, it is preferable that the control unit 63 of the controller 60 bring the relay unit second opening and closing device 24 into a closed state. This makes it possible to prevent the high-temperature and high-pressure gas refrigerant discharged from the compressor 10 from condensing or staying in the section of the refrigerant pipe 110 including the main pipe 111 from the outlet side of the relay unit 3 to the backflow prevention device 14*c*. This results in allowing more of the high-temperature and high-pressure gas refrigerant discharged from the compressor 10 to flow into the heat-source-side heat exchanger 12, thus bringing about further improvement in defrosting capacity of the air-conditioning apparatus 100.

In a case in which the relay unit second expansion device 27 is used as a load-side expansion device 25 to execute the defrosting operation mode too, the control unit 63 of the controller 60 may bring all of the relay unit first expansion device 30, the relay unit second expansion device 27, the relay unit first opening and closing device 23, the relay unit second opening and closing device 24, and the indoor-side expansion device 70 each into a closed state. Such a configuration too makes it possible to prevent the high-temperature and high-pressure gas refrigerant discharged from the compressor 10 from condensing or staying in the section of the refrigerant pipe 110 including the main pipe 111 from the outlet side of the relay unit 3 to the backflow prevention device 14*c*. This results in allowing more of the high-temperature and high-pressure gas refrigerant discharged from the compressor 10 to flow into the heat-source-side heat exchanger 12, thus bringing about further improvement in the defrosting capacity of the air-conditioning apparatus 100.

Embodiment 4

An air-conditioning apparatus 100 according to Embodiment 4 is configured such that the air-conditioning apparatus 100 shown in Embodiment 3 includes the second opening and closing device 15 shown in Embodiment 2. It should be noted that matters that are not referred to in Embodiment 4 are similar to those referred to in any of Embodiments 1 to 3.

Figure 15:
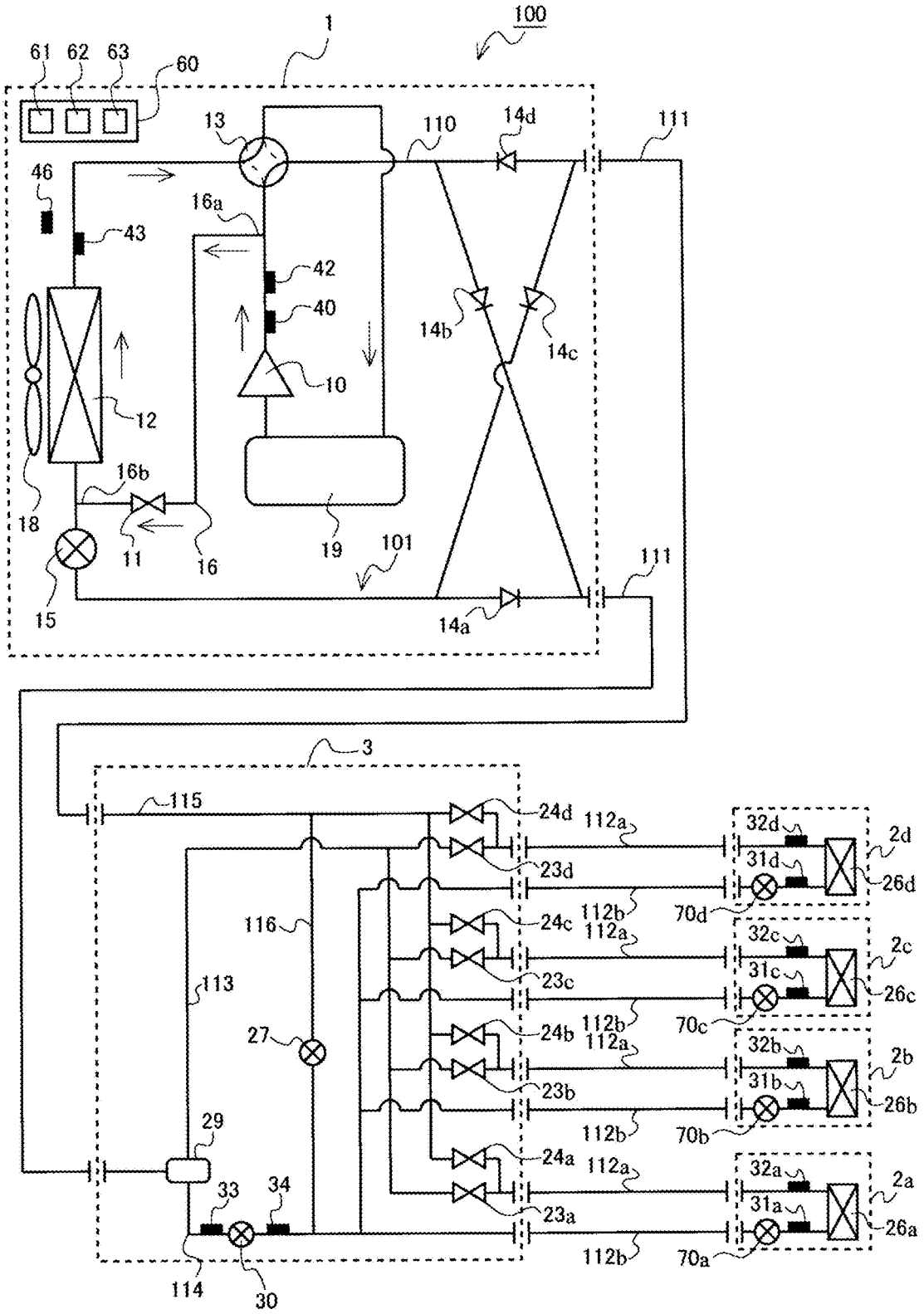
FIG. 15 is a schematic view showing a circuit configuration of an air-conditioning apparatus according to Embodiment 4 and a diagram showing a state in which the air-conditioning apparatus is operating in the defrosting operation mode with solid arrows indicating the direction of flow of refrigerant in FIG. 15.

FIG. 15 is a schematic view showing a circuit configuration of an air-conditioning apparatus according to Embodiment 4 and a diagram showing a state in which the air-conditioning apparatus is operating in the defrosting operation mode. In FIG. 15, the direction of flow of the refrigerant is indicated by solid arrows.

The air-conditioning apparatus 100 according to Embodiment 4 includes a second opening and closing device 15. The second opening and closing device 15 is configured to open and close a flow passage of the refrigerant at a place at which the second opening and closing device 15 is installed. The second opening and closing device 15 is provided in the refrigerant circuit 101 and at an inflow side of the heat-source-side heat exchanger 12 through which the refrigerant flows into the heat-source-side heat exchanger 12 when the heat-source-side heat exchanger 12 functions as an evaporator and faces the heat-source-side heat exchanger 12 across a place with which the outlet-side end 16*b* of the bypass pipe 16 is connected. Further, in Embodiment 4, the second opening and closing device 15 is mounted in the outdoor unit 1.

The second opening and closing device 15 is controlled by the controller 60. Specifically, during the cooling only operation mode, the cooling main operation mode, the heating only operation mode, and the heating main operation mode, the control unit 63 of the controller 60 keeps the second opening and closing device 15 in an open state. Further, in executing the defrosting operation mode, the control unit 63 changes the second opening and closing device 15 from an open state to a closed state.

During the defrosting operation mode, the high-temperature and high-pressure gas refrigerant discharged from the compressor 10 passes through the bypass pipe 16 and flows into the heat-source-side heat exchanger 12. In a case in which the second opening and closing device 15 is not provided, part of the high-temperature and high-pressure gas refrigerant discharged from the compressor 10 is to pass through the backflow prevention device 14*a*, a main pipe 111, the relay unit 3, and a branch pipe 112 and flow toward the indoor-side expansion device 70 after flowing out from the bypass pipe 16. In a section of the refrigerant pipe 110 that forms a flow passage from the second opening and closing device 15 to the indoor-side expansion device 70, there is a pipe that is lower in temperature than the refrigerant discharged from the compressor 10. For this reason, when the refrigerant discharged from the compressor 10 flows into the section of the refrigerant pipe 110 that forms the flow passage from the second opening and closing device 15 to the indoor-side expansion device 70, the high-temperature and high-pressure gas refrigerant discharged from the compressor 10 may condense and stay at a portion of a pipe at low temperature.

However, keeping the second opening and closing device 15 in a closed state during the defrosting operation mode makes it possible to prevent the refrigerant discharged from the compressor 10 from flowing into the section of the refrigerant pipe 110 that forms the flow passage from the second opening and closing device 15 to the indoor-side expansion device 70. That is, keeping the second opening and closing device 15 in a closed state during the defrosting operation mode makes it possible to prevent the high-temperature and high-pressure gas refrigerant discharged from the compressor 10 from condensing or staying at a portion of a pipe at low temperature in the section of the refrigerant pipe 110 that forms the flow passage from the second opening and closing device 15 to the indoor-side expansion device 70. Accordingly, the air-conditioning apparatus 100 according to Embodiment 4 allows more of the high-temperature and high-pressure gas refrigerant discharged from the compressor 10 to flow into the heat-source-side heat exchanger 12, thus bringing about further improvement in defrosting capacity.

Although, in FIG. 15, an electronic expansion valve capable of adjusting the flow rate of refrigerant is illustrated as the second opening and closing device 15, the second opening and closing device 15 may be an opening and closing device capable of blocking a flow passage of refrigerant, such as a two-way valve and a solenoid valve.

Embodiment 5

As mentioned above, the load-side heat exchanger 26 may be configured to cause refrigerant and a heat medium to exchange heat with each other. Embodiment 5 introduces an example of an air-conditioning apparatus 100 including a load-side heat exchanger 26 configured to cause refrigerant and a heat medium to exchange heat with each other. It should be noted that matters that are not referred to in Embodiment 5 are similar to those referred to in any of Embodiments 1 to 4.

Figure 16:
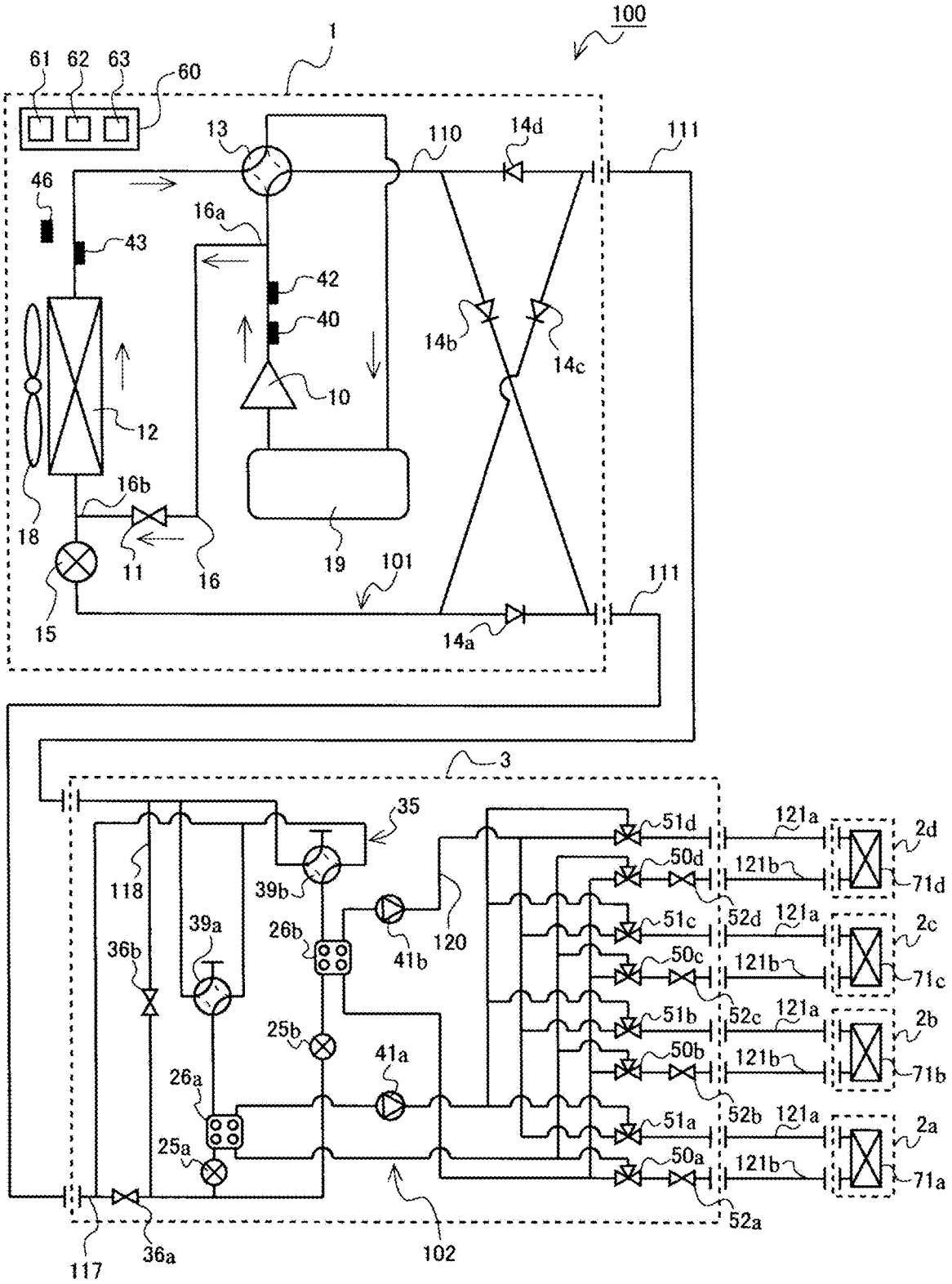
FIG. 16 is a schematic view showing a circuit configuration of an air-conditioning apparatus according to Embodiment 5 and a diagram showing a state in which the air-conditioning apparatus is operating in the defrosting operation mode.

FIG. 16 is a schematic view showing a circuit configuration of an air-conditioning apparatus according to Embodiment 5 and a diagram showing a state in which the air-conditioning apparatus is operating in the defrosting operation mode.

As is the case with the air-conditioning apparatus 100 described in Embodiment 3, the air-conditioning apparatus 100 according to Embodiment 5 executes four operation modes. The first operation mode is the cooling only operation mode, in which all indoor units 2 in operation are enabled to execute cooling operation. The second operation mode is the heating only operation mode, in which all indoor units 2 in operation are enabled to execute heating operation. The third operation mode is the cooling main operation mode, which is executed in a case of cooling and heating mixed operation in which a cooling load is higher than a heating load. The fourth operation mode is the heating main operation mode, which is executed in a case of cooling and heating mixed operation in which a heating load is higher than a cooling load.

As shown in FIG. 16, the load-side heat exchanger 26 is configured to cause refrigerant and a heat medium to exchange heat with each other. The term "heat medium" refers to liquid, such as water and antifreeze, that is different from refrigerant that circulates through the heat-source-side heat exchanger 12 and the load-side heat exchanger 26. The load-side heat exchanger 26 is mounted in the relay unit 3. The indoor unit 2 is mounted with an indoor heat exchanger 71, connected to the load-side heat exchanger 26 by a heat medium pipe 120, through which the heat medium subjected to heat exchange with the refrigerant in the load-side heat exchanger 26 flows. That is, the load-side heat exchanger 26 forms the refrigerant circuit 101 by being connected to the heat-source-side heat exchanger 12 and other devices by the refrigerant pipe 110 and forms a heat medium circuit 102 by being connected to the indoor heat exchanger 71 and other devices by the heat medium pipe 120. Specifically, a refrigerant flow passage of the load-side heat exchanger 26 is connected to the refrigerant pipe 110, and a heat medium flow passage of the load-side heat exchanger 26 is connected to the heat medium pipe 120. It should be noted that the air-conditioning apparatus 100 according to Embodiment 5 includes a plurality of the indoor units 2. FIG. 16 illustrates an indoor unit 2*a*, an indoor unit 2*b*, an indoor unit 2*c*, and an indoor unit 2*d* arranged in this order from the bottom of the drawing.

The outdoor unit 1 and the relay unit 3 are connected by a plurality of main pipes 111 through which refrigerant flows. The main pipes 111 are parts of the refrigerant pipe 110 of the refrigerant circuit 101. Further, the relay unit 3 and each of the indoor units 2 are connected by corresponding ones of a plurality of branch pipes 121. The branch pipes 121 are parts of the heat medium pipe 120 of the heat medium circuit 102.

[Relay Unit 3]

The relay unit 3 is mounted with a load-side heat exchanger 26, a load-side expansion device 25, and a relay unit flow switching mechanism 35 as components of the refrigerant circuit 101. Further, in Embodiment 5, the relay unit 3 includes two sets that each have a load-side heat exchanger 26 and a load-side expansion device 25 to achieve cooling and heating mixed operation. Specifically, the relay unit 3 includes a load-side heat exchanger 26*a*, a load-side heat exchanger 26*b*, a load-side expansion device 25*a* connected to the load-side heat exchanger 26*a* by the refrigerant pipe 110, and a load-side expansion device 25*b* connected to the load-side heat exchanger 26*b* by the refrigerant pipe 110.

Further, the relay unit 3 is provided with a plurality of pumps 41, a plurality of first heat medium flow switching devices 50, a plurality of second heat medium flow switching devices 51, and a plurality of heat medium flow control devices 52 as components of the heat medium circuit 102. It should be noted that the pumps 41 are needed for the respective load-side heat exchangers 26. For this reason, in Embodiment 5, the relay unit 3 includes two pumps 41. Specifically, the relay unit 3 includes a pump 41*a* connected to the load-side heat exchanger 26*a* by the heat medium pipe 120 and a pump 41*b* connected to the load-side heat exchanger 26*b* by the heat medium pipe 120. Further, the first heat medium flow switching devices 50, the second heat medium flow switching devices 51, and the heat medium flow control devices 52 are needed for the respective indoor units 2. For this reason, in Embodiment 5, the relay unit 3 includes four first heat medium flow switching devices 50, four second heat medium flow switching devices 51, and four heat medium flow control devices 52.

The load-side heat exchanger 26*a* and the load-side heat exchanger 26*b* function as condensers or evaporators. The load-side heat exchanger 26*a* and the load-side heat exchanger 26*b* perform heat exchange between the refrigerant and the heat medium to transfer, to the heat medium, cooling energy or heating energy generated in the outdoor unit 1 and stored in the refrigerant. Specifically, in the cooling only operation mode, the load-side heat exchanger 26*a* and the load-side heat exchanger 26*b* function as evaporators to cool the heat medium. In the heating only operation mode, the load-side heat exchanger 26*a* and the load-side heat exchanger 26*b* function as condensers to heat the heat medium. During cooling and heating mixed operation, the load-side heat exchanger 26*a* functions as a condenser to heat the heat medium. Further, during cooling and heating mixed operation, the load-side heat exchanger 26*b* functions as an evaporator to cool the heat medium.

The relay unit flow switching mechanism 35 is configured to, according to an operation mode, switch between connection destinations for the load-side expansion devices 25*a* and 25*b* and switch between connection destinations for the load-side heat exchangers 26*a* and 26*b*. The relay unit flow switching mechanism 35 includes a refrigerant inflow pipe 117, a relay unit first opening and closing device 36*a*, a refrigerant outflow pipe 118, a relay unit second opening and closing device 36*b*, a relay unit flow switching device 39*a*, and a relay unit flow switching device 39*b*.

The refrigerant inflow pipe 117 connects an inlet of the relay unit 3 for the refrigerant with the load-side expansion devices 25. Specifically, one end of the refrigerant inflow pipe 117 is connected to the inlet of the relay unit 3 for the refrigerant. The other end of the refrigerant inflow pipe 117 branches to be connected to the load-side expansion device 25*a* and the load-side expansion device 25*b*. The refrigerant inflow pipe 117 is a pipe through which the refrigerant flows, and also is part of the refrigerant pipe 110. The relay unit first opening and closing device 36*a* is a two-way valve or other device. The relay unit first opening and closing device 36*a* is provided in the refrigerant inflow pipe 117 to open and close a flow passage of the refrigerant at a place at which the relay unit first opening and closing device 36*a* is installed.

One end of the refrigerant outflow pipe 118 is connected to a point in the refrigerant inflow pipe 117 located between the relay unit first opening and closing device 36*a* and the load-side expansion devices 25. The other end of the refrigerant outflow pipe 118 is connected to an outlet of the relay unit 3 for the refrigerant. The refrigerant outflow pipe 118 is a pipe through which the refrigerant flows, and also is part of the refrigerant pipe 110. The relay unit second opening and closing device 36*b* is a two-way valve or other device. The relay unit second opening and closing device 36*b* is provided in the refrigerant outflow pipe 118 to open and close a flow passage of the refrigerant at a place at which the relay unit second opening and closing device 36*b* is installed.

The relay unit flow switching device 39*a* is a four-way valve or other device. The relay unit flow switching device 39*a* is configured to change between connecting the load-side heat exchanger 26*a* to the inlet of the relay unit 3 for the refrigerant and connecting the load-side heat exchanger 26*a* to the outlet of the relay unit 3 for the refrigerant. Specifically, the relay unit flow switching device 39*a* switches between connection destinations for one end of the load-side heat exchanger 26*a* opposite in a refrigerant flow passage to the other end to which the load-side expansion device 25*a* is connected. The relay unit flow switching device 39*b* is a four-way valve or other device. The relay unit flow switching device 39*b* is configured to change between connecting the load-side heat exchanger 26*b* to the inlet of the relay unit 3 for the refrigerant and connecting the load-side heat exchanger 26*b* to the outlet of the relay unit 3 for the refrigerant. Specifically, the relay unit flow switching device 39*b* switches between connection destinations for one end of the load-side heat exchanger 26*b* opposite in a refrigerant flow passage to the other end to which the load-side expansion device 25*b* is connected.

The control unit 63 of the controller 60 switches, according to each operation mode, corresponding components of the relay unit flow switching mechanism 35 in the following manner.

For example, in executing the cooling only operation mode, the control unit 63 brings the relay unit first opening and closing device 36*a* into an open state and brings the relay unit second opening and closing device 36*b* into a closed state. Further, the control unit 63 switches a flow passage of the relay unit flow switching device 39*a* to a flow passage through which the load-side heat exchanger 26*a* and the outlet of the relay unit 3 for the refrigerant are connected to each other. Further, the control unit 63 switches a flow passage of the relay unit flow switching device 39*b* to a flow passage through which the load-side heat exchanger 26*b* and the outlet of the relay unit 3 for the refrigerant are connected to each other. Switching corresponding components of the relay unit flow switching mechanism 35 in this way causes the refrigerant discharged by the compressor 10 and condensed by the heat-source-side heat exchanger 12 functioning as a condenser to flow into the refrigerant inflow pipe 117 through the inlet of the relay unit 3 for the refrigerant and then flow into the load-side expansion device 25*a* and the load-side expansion device 25*b*. The refrigerant flowing into the load-side expansion device 25*a* is expanded by the load-side expansion device 25*a* and flows into the load-side heat exchanger 26*a*, which functions as an evaporator. Further, the refrigerant flowing into the load-side expansion device 25*b* is expanded by the load-side expansion device 25*b* and flows into the load-side heat exchanger 26*b*, which functions as an evaporator. The refrigerant cooling the heat medium while evaporating in the load-side heat exchanger 26*a* and the load-side heat exchanger 26*b* flows out from the relay unit 3 through the outlet of the relay unit 3 for the refrigerant and returns to the outdoor unit 1. This makes it possible to supply the indoor heat exchanger 71 of each indoor unit 2 with the heat medium cooled in the load-side heat exchanger 26*a* and the load-side heat exchanger 26*b*, making it possible to execute the cooling only operation mode.

For example, in executing the heating only operation mode, the control unit 63 brings the relay unit first opening and closing device 36*a* into a closed state and brings the relay unit second opening and closing device 36*b* into an open state. Further, the control unit 63 switches the flow passage of the relay unit flow switching device 39*a* to a flow passage through which the load-side heat exchanger 26*a* and the inlet of the relay unit 3 for the refrigerant are connected to each other. Further, the control unit 63 switches the flow passage of the relay unit flow switching device 39*b* to a flow passage through which the load-side heat exchanger 26*b* and the inlet of the relay unit 3 for the refrigerant are connected to each other. Switching corresponding components of the relay unit flow switching mechanism 35 in this way causes the refrigerant discharged by the compressor 10 to flow into the load-side heat exchanger 26*a* and the load-side heat exchanger 26*b*, which function as condensers, through the inlet of the relay unit 3 for the refrigerant. The refrigerant flowing into the load-side heat exchanger 26*a* heats the heat medium while condensing and flows out from the load-side heat exchanger 26*a*. The refrigerant flowing out from the load-side heat exchanger 26*a* is expanded by the load-side expansion device 25*a*. The refrigerant flowing into the load-side heat exchanger 26*b* heats the heat medium while condensing and flows out from the load-side heat exchanger 26*b*. The refrigerant flowing out from the load-side heat exchanger 26*b* is expanded by the load-side expansion device 25*b*. The refrigerant flowing out from the load-side expansion device 25*a* and the load-side expansion device 25*b* merges, passes through the refrigerant inflow pipe 117 and the refrigerant outflow pipe 118, flows out from the relay unit 3 through the outlet of the relay unit 3 for the refrigerant, and returns to the outdoor unit 1. This makes it possible to supply the indoor heat exchanger 71 of each indoor unit 2 with the heat medium heated in the load-side heat exchanger 26*a* and the load-side heat exchanger 26*b*, making it possible to execute the heating only operation mode.

For example, in executing the cooling main operation mode and the heating main operation mode, the control unit 63 brings the relay unit first opening and closing device 36*a* into a closed state and brings the relay unit second opening and closing device 36*b* into a closed state. Further, the control unit 63 switches the flow passage of the relay unit flow switching device 39*a* to the flow passage through which the load-side heat exchanger 26*a* and the inlet of the relay unit 3 for the refrigerant are connected to each other. Further, the control unit 63 switches the flow passage of the relay unit flow switching device 39*b* to the flow passage through which the load-side heat exchanger 26*b* and the outlet of the relay unit 3 for the refrigerant are connected to each other. Switching corresponding components of the relay unit flow switching mechanism 35 in this way causes the refrigerant flowing into the relay unit 3 through the inlet of the relay unit 3 for the refrigerant to flow into the load-side heat exchanger 26*a*, which functions as a condenser. The refrigerant flowing into the load-side heat exchanger 26*a* heats the heat medium while condensing and flows out from the load-side heat exchanger 26*a*. The refrigerant flowing out from the load-side heat exchanger 26*a* flows through the load-side expansion device 25*a* and then flows through the load-side heat exchanger 26*b*. At this time, refrigerant is expanded by the load-side expansion device 25*b*. The refrigerant expanded by the load-side expansion device 25*b* flows into the load-side heat exchanger 26*b*, which functions as an evaporator. The refrigerant cooling the heat medium while evaporating in the load-side heat exchanger 26*b* flows out from the relay unit 3 through the outlet of the relay unit 3 for the refrigerant and returns to the outdoor unit 1. This makes it possible to, by supplying the indoor heat exchanger 71 of one or more of the indoor units 2 with the heat medium heated in the load-side heat exchanger 26*a*, enable heating operation in the one or more of the indoor units 2. This also makes it possible to, by supplying the indoor heat exchanger 71 of another one or more of the indoor units 2 with the heat medium cooled in the load-side heat exchanger 26*b*, enable cooling operation in the other one or more of the indoor units 2.

The pump 41*a* and the pump 41*b* pressurize the heat medium flowing through the heat medium pipe 120 and cause the heat medium to circulate. The pump 41*a* is provided in a section of the heat medium pipe 120 connecting the load-side heat exchanger 26*a* with the plurality of second heat medium flow switching devices 51. The pump 41*b* is provided in a section of the heat medium pipe 120 connecting the load-side heat exchanger 26*b* with the plurality of second heat medium flow switching devices 51. The pump 41*a* and the pump 41*b* are, for example, capacity-controllable pumps.

The four first heat medium flow switching devices 50 are three-way valves or other devices and switch flow passages of the heat medium. Each of the four first heat medium flow switching devices 50 has three ends one of which is connected to the load-side heat exchanger 26*a*, another one of which is connected to the load-side heat exchanger 26*b*, and the other one of which is connected to a corresponding one of the heat medium flow control devices 52. Further, each of the four first heat medium flow switching devices 50 is provided at an outlet side of a heat medium flow passage in the indoor heat exchanger 71 of a corresponding one of the indoor units 2. It should be noted that FIG. 16 illustrates a first heat medium flow switching device 50*a*, a first heat medium flow switching device 50*b*, a first heat medium flow switching device 50*c*, and a first heat medium flow switching device 50*d* arranged in this order from the bottom of the drawing in correspondence with the indoor units 2.

The four second heat medium flow switching devices 51 are three-way valves or other devices and switch flow passages of the heat medium. Each of the four second heat medium flow switching devices 51 has three ends one of which is connected to the load-side heat exchanger 26*a*, another one of which is connected to the load-side heat exchanger 26*b*, and the other one of which is connected to a corresponding one of the indoor heat exchangers 71. Further, each of the four second heat medium flow switching devices 51 is provided at an inlet side of the heat medium flow passage in the indoor heat exchanger 71 of a corresponding one of the indoor units 2. It should be noted that FIG. 16 illustrates a second heat medium flow switching device 51*a*, a second heat medium flow switching device 51*b*, a second heat medium flow switching device 51*c*, and a second heat medium flow switching device 51*d* arranged in this order from the bottom of the drawing in correspondence with the indoor units 2.

The four heat medium flow control devices 52 are two-way valves or other devices capable of controlling opening areas and control the rates of flow through the heat medium pipe 120. Each of the four heat medium flow control devices 52 has two ends one of which is connected to a corresponding one of the indoor heat exchangers 71 and the other one of which is connected to a corresponding one of the first heat medium flow switching devices 50. Further, each of the four heat medium flow control devices 52 is provided at the outlet side of the heat medium flow passage in the indoor heat exchanger 71 of a corresponding one of the indoor units 2. FIG. 16 illustrates a heat medium flow control device 52*a*, a heat medium flow control device 52*b*, a heat medium flow control device 52*c*, and a heat medium flow control device 52*d* arranged in this order from the bottom of the drawing in correspondence with the indoor units 2. Alternatively, each of the four heat medium flow control devices 52 may be provided at the inlet side of the heat medium flow passage in the indoor heat exchanger 71 of the corresponding one of the indoor units 2.

Further, the relay unit 3 is provided with various types of sensor (not illustrated). The sensors output detection results as detection signals to the after-mentioned controller 60.

[Configuration of Plurality of Indoor Units 2]

The plurality of indoor units 2 are for example identical in configuration to each other. Each of the plurality of indoor units 2 has an indoor heat exchanger 71. A plurality of the indoor heat exchangers 71 are each connected to the relay unit 3 via a branch pipe 121*a* and a branch pipe 121*b*. In each of the indoor heat exchangers 71, air supplied by the load-side air-sending device (not illustrated) is subjected to heat exchange with the heat medium, so that cooling air or heating air to be supplied to the air-conditioning target space is generated. It should be noted that FIG. 16 illustrates an indoor heat exchanger 71*a*, an indoor heat exchanger 71*b*, an indoor heat exchanger 71*c*, and an indoor heat exchanger 71*d* arranged in this order from the bottom of the drawing in correspondence with the indoor units 2.

[Defrosting Operation Mode]

The defrosting operation mode that the air-conditioning apparatus 100 executes is described with reference to FIG. 16. In FIG. 16, the direction of flow of the refrigerant is indicated by solid arrows.

In a case in which conditions for executing the defrosting operation mode in the heating only operation mode or the heating main operation mode are met, the controller 60 starts the defrosting operation mode. In the defrosting operation mode, the refrigerant flow switching device 13 is in the same state as the heating only operation mode. That is, in the defrosting operation mode, as shown in FIG. 16, a flow passage of the refrigerant through the refrigerant flow switching device 13 is the same as a flow passage through which the refrigerant discharged from the compressor 10 flows into a load-side heat exchanger 26. Further, the load-side expansion device 25*a* and the load-side expansion device 25*b* are brought each into a closed state. The first opening and closing device 11 changes from a closed state to an open state to allow passage of the refrigerant through the bypass pipe 16. Further, the heat-source-side air-sending device 18 and the load-side air-sending device (not illustrated) are suspended in operation. In this case, the load-side expansion device 25*a* and the load-side expansion device 25*b* may be each preferably brought into a closed state after the first opening and closing device 11 is brought into an open state. This makes it possible to prevent a clogging of refrigerant flow passages and prevent an excessive rise in pressure in the refrigerant circuit 101.

The high-temperature and high-pressure gas refrigerant discharged from the compressor 10 passes through the bypass pipe 16 and flows into the heat-source-side heat exchanger 12. The high-temperature gas refrigerant flowing into the heat-source-side heat exchanger 12 flows through the heat-source-side heat exchanger 12 while melting the frost forming on the heat-source-side heat exchanger 12.

Further, the pressure of the high-temperature and high-pressure gas refrigerant discharged from the compressor 10 makes it possible to retain excess refrigerant in a load-side heat exchanger 26 functioning as a condenser in the heating only operation mode or the heating main operation mode, thus making it possible to reduce the amount of excess refrigerant that stays in the accumulator 19. Accordingly, during the defrosting operation mode, the air-conditioning apparatus 100 according to Embodiment 5 is configured to prevent the liquid refrigerant from overflowing from the accumulator 19 and being sucked into the compressor 10, similarly to the case with the air-conditioning apparatuses 100 according to Embodiments 1 to 4. That is, during the defrosting operation mode, the air-conditioning apparatus 100 is configured to reduce a liquid return to the compressor 10.

Further, in the air-conditioning apparatus 100 according to Embodiment 5 too, during the defrosting operation mode, the high-temperature refrigerant discharged from the compressor 10 can flow into the heat-source-side heat exchanger 12 by flowing only inside the outdoor unit 1, as in the case of the air-conditioning apparatuses 100 according to Embodiments 1 to 4. For this reason, during the defrosting operation mode, the air-conditioning apparatus 100 according to Embodiment 5 too is configured to prevent the density of the refrigerant that flows into the heat-source-side heat exchanger 12 from decreasing because of a pressure loss, similarly to the case with the air-conditioning apparatuses 100 according to Embodiments 1 to 4. That is, similarly to the case with the air-conditioning apparatuses 100 according to Embodiments 1 to 4, the air-conditioning apparatus 100 according to Embodiment 5 too makes it possible to increase the amount of refrigerant that circulates between the compressor 10 and the heat-source-side heat exchanger 12, making it also possible to reduce degradation in defrosting capacity.

Further, in the air-conditioning apparatus 100 according to Embodiment 5 too, the excess refrigerant retained in the load-side heat exchanger 26 can be evaporated in the heat-source-side heat exchanger 12 immediately after the switching from the defrosting operation mode to the heating only operation mode or the heating main operation mode, as in the case of the air-conditioning apparatuses 100 according to Embodiments 1 to 4. For this reason, the air-conditioning apparatus 100 according to Embodiment 5 too allows more gas refrigerant to flow into the compressor 10 than in a case in which the excess refrigerant during the defrosting operation mode does not flow into the heat-source-side heat exchanger 12, making it possible to increase the amount of refrigerant that is discharged from the compressor 10, similarly to the case with the air-conditioning apparatuses 100 according to Embodiments 1 to 4. Accordingly, the air-conditioning apparatus 100 according to Embodiment 5 too is configured to heat the air-conditioning target space sooner after the termination of the defrosting operation mode than in a case in which the excess refrigerant during the defrosting operation mode does not flow into the heat-source-side heat exchanger 12, thus making it possible to improve user's comfort, similarly to the case with the air-conditioning apparatuses 100 according to Embodiments 1 to 4.

As mentioned above, the relay unit flow switching mechanism 35 of the air-conditioning apparatuses 100 according to Embodiment 5 includes the refrigerant inflow pipe 117, the relay unit first opening and closing device 36*a*, the refrigerant outflow pipe 118, and the relay unit second opening and closing device 36*b*. In a case in which an air-conditioning apparatus 100 including such a relay unit flow switching mechanism 35 executes the defrosting operation mode, the refrigerant discharged from the compressor 10 may condense and stay in the section of the refrigerant pipe 110 including the main pipe 111 from the outlet side of the relay unit 3 to the backflow prevention device 14*c* when the relay unit first opening and closing device 36*a* and the relay unit second opening and closing device 36*b* are each in an open state. For this reason, in a case in which an air-conditioning apparatus 100 including such a relay unit flow switching mechanism 35 executes the defrosting operation mode, it is preferable that the relay unit first opening and closing device 36*a* be each brought into a closed state. This makes it possible to prevent the refrigerant discharged from the compressor 10 from flowing into the section of the refrigerant pipe 110 including the main pipe 111 from the outlet side of the relay unit 3 to the backflow prevention device 14*c*, making it possible to prevent the refrigerant having condensed from staying in the section of the refrigerant pipe 110. This results in allowing more of the high-temperature and high-pressure gas refrigerant discharged from the compressor 10 to flow into the heat-source-side heat exchanger 12, thus bringing about further improvement in the defrosting capacity of the air-conditioning apparatus 100.

Further, as shown in FIG. 16, the air-conditioning apparatus 100 according to Embodiment 5 includes a second opening and closing device 15, similarly to the case with the air-conditioning apparatus 100 shown in Embodiment 4. For this reason, the air-conditioning apparatus 100 according to Embodiment 5 makes it possible to, during the defrosting operation mode, prevent the high-temperature and high-pressure gas refrigerant discharged from the compressor 10 and flowing out from the bypass pipe 16 from flowing in a direction opposite to the heat-source-side heat exchanger 12, similarly to the case with the air-conditioning apparatus 100 shown in Embodiment 4. That is, the air-conditioning apparatus 100 according to Embodiment 5 makes it possible to, during the defrosting operation mode, prevent the high-temperature and high-pressure gas refrigerant discharged from the compressor 10 from condensing or staying in a low-temperature piping portion, similarly to the case with the air-conditioning apparatus 100 shown in FIG. 4. For this reason, the air-conditioning apparatus 100 according to Embodiment 5 brings about further improvement in defrosting capacity, similarly to the case with the air-conditioning apparatus 100 shown in Embodiment 4.

Although examples of air-conditioning apparatuses according to the present disclosure have been described in Embodiments 1 to 5 above, air-conditioning apparatuses according to the present disclosure are not limited to the configurations shown in Embodiments 1 to 5. For example, each of the air-conditioning apparatuses 100 shown in Embodiments 3 to 5 is configured such that the outdoor unit 1 and the relay unit 3 are connected by two main pipes 111. However, the outdoor unit 1 and the relay unit 3 can be connected by use of a variety of publicly-known configurations. In a configuration, for example, the outdoor unit 1 and the relay unit 3 may be connected by three main pipes 111. The aforementioned effects are brought about even when an air-conditioning apparatus according to the present disclosure is configured in this way. Further, for example, an air-conditioning apparatus according to the present disclosure may of course be configured by combining configurations described in different embodiments.

REFERENCE SIGNS LIST

1: outdoor unit, 2 (2*a*, 2*b*, 2*c*, 2*d*): indoor unit, 3: relay unit, 10: compressor, 11: first opening and closing device, 12: heat-source-side heat exchanger, 13: refrigerant flow switching device, 14*a*, 14*b*, 14*c*, 14*d*: backflow prevention device, 15: second opening and closing device, 16: bypass pipe, 16*a*: inlet-side end, 16*b*: outlet-side end, 18: heat-source-side air-sending device, 19: accumulator, 23 (23*a*, 23*b*, 23*c*, 23*d*): relay unit first opening and closing device, 24 (24*a*, 24*b*, 24*c*, 24*d*): relay unit second opening and closing device, 25 (25*a*, 25*b*): load-side expansion device, 26 (26*a*, 26*b*, 26*c*, 26*d*): load-side heat exchanger, 27: relay unit second expansion device, 29: gas-liquid separator, 30: relay unit first expansion device, 31 (31*a*, 31*b*, 31*c*, 31*d*): load-side first temperature sensor, 32 (32*a*, 32*b*, 32*c*, 32*d*): load-side second temperature sensor, 33: inlet-side pressure sensor, 34: outlet-side pressure sensor, 35: relay unit flow switching mechanism, 36*a*: relay unit first opening and closing device, 36*b*: relay unit second opening and closing device, 39*a*: relay unit flow switching device, 39*b*: relay unit flow switching device, 40: discharge pressure sensor, 41 (41*a*, 41*b*): pump, 42: discharge temperature sensor, 43: heat-source-side heat exchanger temperature sensor, 46: outside air temperature sensor, 50 (50*a*, 50*b*, 50*c*, 50*d*): first heat medium flow switching device, 51 (51*a*, 51*b*, 51*c*, 51*d*): second heat medium flow switching device, 52 (52*a*, 52*b*, 52*c*, 52*d*): heat medium flow control device, 60: controller, 61: input unit, 62: arithmetic unit, 63: control unit, 70 (70*a*, 70*b*, 70*c*, 70*d*): indoor-side expansion device, 71 (71*a*, 71*b*, 71*c*, 71*d*): indoor heat exchanger, 100: air-conditioning apparatus, 101: refrigerant circuit, 102: heat medium circuit, 110: refrigerant pipe, 111: main pipe, 112 (112*a*, 112*b*): branch pipe, 113: gas refrigerant outflow pipe, 114: liquid refrigerant outflow pipe, 115: relay unit outflow pipe, 116: relay unit bypass pipe, 117: refrigerant inflow pipe, 118: refrigerant outflow pipe, 120: heat medium pipe, 121 (121*a*, 121*b*): branch pipe

The invention claimed is:

1. An air-conditioning apparatus comprising:

a refrigerant circuit that has a compressor configured to compress and discharge refrigerant, a heat-source-side heat exchanger configured to function as an evaporator in a heating only operation mode in which an indoor unit performs a heating operation, a refrigerant flow switching device including a 4-way valve and configured to switch flow passages of the refrigerant according to an operation mode, a load-side heat exchanger configured to function as a condenser when indoor air is sent to the load-side heat exchanger during heating operation, and a load-side expansion device including a first electronic expansion valve and configured such that the refrigerant flowing from the load-side heat exchanger functioning as a condenser and flowing into the heat-source-side heat exchanger functioning as an evaporator flows through the load-side expansion device, that is formed by the compressor, the heat-source-side heat exchanger, the load-side expansion device, and the load-side heat exchanger being connected by a refrigerant pipe, and through which the refrigerant circulates;

a bypass pipe that has one end that is an inlet-side end connected to a point in the refrigerant circuit located between a discharge outlet of the compressor and the refrigerant flow switching device and an other end that is an outlet-side end connected to a point in the refrigerant circuit located between the load-side expansion device and the heat-source-side heat exchanger;

a first opening and closing device including a first valve and provided in the bypass pipe and configured to open and close a flow passage of the refrigerant at a place at which the first opening and closing device is installed;

a controller configured to control the refrigerant flow switching device, the load-side expansion device, and the first opening and closing device; and an outdoor unit mounted with the compressor, the heat-source-side heat exchanger, the refrigerant flow switching device, the bypass pipe, and the first opening and closing device, the controller being configured to, in response to determining that a condition is met for executing a defrosting operation mode of defrosting the heat-source-side heat exchanger in the heating only operation mode, cause a flow passage of the refrigerant through the refrigerant flow switching device to be a flow passage through which the refrigerant discharged from the compressor flows into the load-side heat exchanger, change the first opening and closing device from a closed state to an open state, change the load-side expansion device from an open state to a closed state, stop the indoor air from being sent to the load-side heat exchanger, cause the refrigerant discharged from the compressor to flow into the heat-source-side heat exchanger from the bypass pipe, and executing the defrosting operation mode with the load-side expansion device being in the closed state and with the indoor air not being sent to the load-side heat exchanger, while the refrigerant present between the refrigerant flow switching device and the load-side expansion device during the heating only operation mode is caused to be retained between the refrigerant flow switching device and the load-side expansion device.

2. The air-conditioning apparatus of claim 1, wherein the controller is configured to, in executing the defrosting operation mode, bring the load-side expansion device into a closed state after bringing the first opening and closing device into an open state.

3. The air-conditioning apparatus of claim 1, further comprising a discharge temperature sensor configured to measure a temperature of the refrigerant discharged from the compressor, wherein the controller is configured to control a driving frequency of the compressor, and the controller is configured to, in the defrosting operation mode, lower the driving frequency of the compressor when a temperature detected by the discharge temperature sensor is higher than or equal to a specified temperature.

4. The air-conditioning apparatus of claim 1, further comprising a second opening and closing device that is provided in the refrigerant circuit and at an inflow side of the heat-source-side heat exchanger through which the refrigerant flows into the heat-source-side heat exchanger when the heat-source-side heat exchanger functions as an evaporator and that faces the heat-source-side heat exchanger across a place with which the outlet-side end of the bypass pipe is connected, wherein the controller is configured to control the second opening and closing device, and the controller is configured to, in executing the defrosting operation mode, change the second opening and closing device from an open state to a closed state.

5. The air-conditioning apparatus of claim 1, wherein the controller is configured to, in executing the defrosting operation mode, bring the first opening and closing device into an open state before bringing the load-side expansion device and the second opening and closing device each into a closed state.

6. The air-conditioning apparatus of claim 1, further comprising a container in which to accumulate an excess of the refrigerant, wherein the container is present between the refrigerant flow switching device and a suction port of the compressor or between the heat-source-side heat exchanger and the load-side expansion device, and a capacity of the container is smaller than a volume of the refrigerant that is charged into the refrigerant circuit when all of the refrigerant is in liquid form.

7. The air-conditioning apparatus of claim 1, further comprising the indoor unit mounted with the load-side expansion device and the load-side heat exchanger.

8. The air-conditioning apparatus of claim 1, further comprising:

the indoor unit mounted with the load-side expansion device and the load-side heat exchanger; and a relay unit that connects the outdoor unit with the indoor unit, wherein the relay unit includes, as components of the refrigerant circuit, a gas-liquid separator that separates the refrigerant flowing in from the outdoor unit into liquid refrigerant and gas refrigerant, a gas refrigerant outflow pipe being part of the refrigerant pipe and connected to an outlet of the gas-liquid separator for the gas refrigerant, a liquid refrigerant outflow pipe being part of the refrigerant pipe, of which one end is connected to an outlet of the gas-liquid separator for the liquid refrigerant, and of which an other end is connected to the load-side expansion device, a relay unit first opening and closing device including a second valve and of which one end is connected to the gas refrigerant outflow pipe and of which an other end is connected to the load-side heat exchanger, a relay unit outflow pipe being part of the refrigerant pipe and through which the refrigerant flowing out from the relay unit passes, a relay unit second opening and closing device including a third valve and of which one end is connected to the relay unit outflow pipe and of which an other end is connected to the load-side heat exchanger, a relay unit first expansion device including a second electronic expansion valve and provided in the liquid refrigerant outflow pipe and configured to decompress the refrigerant flowing through a place at which the relay unit first expansion device is installed, a relay unit bypass pipe being part of the refrigerant pipe, of which one end is connected to a point in the liquid refrigerant outflow pipe located between the relay unit first expansion device and the load-side expansion device, and of which an other end is connected to the relay unit outflow pipe, and a relay unit second expansion device including a third electronic expansion valve and provided in the relay unit bypass pipe and configured to decompress the refrigerant flowing through a place at which the relay unit second expansion device is installed, the air-conditioning apparatus includes a plurality of sets that each have the indoor unit, the relay unit first opening and closing device, and the relay unit second opening and closing device, and in executing the defrosting operation mode, the controller is configured to bring at least either the relay unit first expansion device or the relay unit second expansion device into a closed state and bring the relay unit second opening and closing device into a closed state.

9. The air-conditioning apparatus of claim 1, further comprising:

an indoor-side expansion device including a second electronic expansion valve and configured to decompress the refrigerant flowing out from the load-side heat exchanger during the heating operation;

the indoor unit mounted with the indoor-side expansion device and the load-side heat exchanger; and a relay unit that connects the outdoor unit with the indoor unit, wherein the relay unit includes, as components of the refrigerant circuit, a gas-liquid separator that separates the refrigerant flowing in from the outdoor unit into liquid refrigerant and gas refrigerant, a gas refrigerant outflow pipe being part of the refrigerant pipe and connected to an outlet of the gas-liquid separator for the gas refrigerant, a liquid refrigerant outflow pipe being part of the refrigerant pipe, of which one end is connected to an outlet of the gas-liquid separator for the liquid refrigerant, and of which an other end is connected to the indoor-side expansion device, a relay unit first opening and closing device including a second valve and of which one end is connected to the gas refrigerant outflow pipe and of which an other end is connected to the load-side heat exchanger, a relay unit outflow pipe being part of the refrigerant pipe and through which the refrigerant flowing out from the relay unit passes, a relay unit second opening and closing device including a third valve and of which one end is connected to the relay unit outflow pipe and of which an other end is connected to the load-side heat exchanger, a relay unit first expansion device including a third electronic expansion valve and provided in the liquid refrigerant outflow pipe and configured to decompress the refrigerant flowing through a place at which the relay unit first expansion device is installed, and a relay unit bypass pipe being part of the refrigerant pipe, of which one end is connected to a point in the liquid refrigerant outflow pipe located between the relay unit first expansion device and the indoor-side expansion device, of which an other end is connected to the relay unit outflow pipe, and in which the load-side expansion device is provided, the air-conditioning apparatus includes a plurality of sets that each have the indoor unit, the relay unit first opening and closing device, and the relay unit second opening and closing device, and in executing the defrosting operation mode, the controller is configured to bring the relay unit second opening and closing device into a closed state.

10. The air-conditioning apparatus of claim 1, wherein the load-side heat exchanger is a heat exchanger in which the refrigerant circulating through the refrigerant circuit and a heat medium exchange heat with each other, the air-conditioning apparatus further comprising:

an indoor heat exchanger through which the heat medium subjected to heat exchange with the refrigerant in the load-side heat exchanger flows;

the indoor unit mounted with the indoor heat exchanger; and a relay unit that is mounted with the load-side expansion device and the load-side heat exchanger and that connects the outdoor unit with the indoor unit.

11. The air-conditioning apparatus of claim 10, wherein the relay unit includes, as components of the refrigerant circuit, a relay unit flow switching mechanism configured to switch between connection destinations for the load-side expansion device and switch between connection destinations for the load-side heat exchanger, the relay unit flow switching mechanism includes a refrigerant inflow pipe that connects an inlet of the relay unit for the refrigerant with the load-side expansion device, a relay unit first opening and closing device including a second valve and provided in the refrigerant inflow pipe and configured to open and close a flow passage of the refrigerant at a place at which the relay unit first opening and closing device is installed, a refrigerant outflow pipe of which one end connected to a point in the refrigerant inflow pipe located between the relay unit first opening and closing device and the load-side expansion device and of which an other end is connected to an outlet of the relay unit for the refrigerant, and a relay unit second opening and closing device including a third valve and provided in the refrigerant outflow pipe and configured to open and close a flow passage of the refrigerant at a place at which the relay unit second opening and closing device is installed, and in executing a defrosting operation mode of defrosting the heat-source-side heat exchanger, the controller is configured to bring the relay unit first opening and closing device into a closed state.

* * * * *